US009186902B2

(12) United States Patent
Ishizawa et al.

(10) Patent No.: US 9,186,902 B2
(45) Date of Patent: Nov. 17, 2015

(54) LIQUID CONTAINING VESSEL

(71) Applicant: SEIKO EPSON CORPORATION, Tokyo (JP)

(72) Inventors: Taku Ishizawa, Nagano (JP); Takumi Nagashima, Nagano (JP); Noriaki Okazawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/487,542

(22) Filed: Sep. 16, 2014

(65) Prior Publication Data

US 2015/0077487 A1 Mar. 19, 2015

(30) Foreign Application Priority Data

Sep. 17, 2013 (JP) ..... 2013-191456

(51) Int. Cl.
*B41J 2/175* (2006.01)
*B41J 2/20* (2006.01)

(52) U.S. Cl.
CPC ..... *B41J 2/17563* (2013.01); *B41J 2/17556* (2013.01); *B41J 2/20* (2013.01)

(58) Field of Classification Search
CPC ..... B41J 2/17563; B41J 2/19; B41J 2/20; B41J 2/17513; B41J 2/17506; B41J 2/17509; B41J 2/1752; B41J 2/17523
See application file for complete search history.

(56) References Cited

U.S. PATENT DOCUMENTS 8,033,659 B2 * 10/2011 Kobayashi ..... 347/92
2005/0204921 A1 9/2005 Ishizawa et al.

FOREIGN PATENT DOCUMENTS

JP 2005-169851 A 6/2005
JP 2007-090734 A 4/2007

* cited by examiner

*Primary Examiner* — Juanita D Jackson
(74) *Attorney, Agent, or Firm* — Global IP Counselors, LLP

(57) ABSTRACT

A liquid containing vessel includes a liquid containing chamber configured to contain a liquid. The liquid containing chamber has a filter chamber with a filter through which the liquid is configured to pass, and a low pressure chamber having a pressure that is lower than atmospheric pressure.

18 Claims, 33 Drawing Sheets

81
81A
82
64 (60F)
67 (60D)
66 64H
69
61
81F
Z
Yr
X 61
66
C
D
D
81
82
81A
86
85
C
Z
Yr 61
67
69
64 (60F)
64b
64a
67a
66
64H
Yr
X
62
93
82F
63
82a
82
81A
81
85
87
88
89
94
81K

LIQUID CONTAINING VESSEL

CROSS-REFERENCE TO RELATED APPLICATIONS

This application claims priority to Japanese Patent Application No. 2013-191456 filed on Sep. 17, 2013. The entire disclosure of Japanese Patent Application No. 2013-191456 is hereby incorporated herein by reference.

BACKGROUND

1. Technical Field

The present invention relates to a liquid containing vessel with a liquid containing chamber that can contain liquid.

2. Related Art

In the prior art, there is known an ink vessel (a liquid containing vessel) with an ink chamber (a liquid containing chamber) where it is possible for ink, which is supplied to an ink jet printer (a liquid consumption apparatus) which consumes ink (a liquid) by ejecting the ink, to be contained. With ink which flow out from the ink chamber in the ink vessel to the outside to be supplied to a printer, it is preferable that foreign matter is not mixed in so that ink is correctly ejected by a printer.

However, it is known from before that it is easy for bubbles (gas) to be generated as foreign matter in ink which is contained in the ink chamber due to chemical changes in ink, changes in pressure in the ink chamber, and the like. Therefore, there is a configuration in the ink vessel in the prior art where a low pressure chamber (a gas absorbing apparatus) which is able to absorb bubbles which are generated is provided in the ink chamber. For example, there is a configuration where the low pressure chamber (the gas absorbing apparatus), where an opening is closed off using a flexible film in a state where the internal pressure is reduced and where at least a portion of the low pressure chamber is formed with a material such that it is possible for bubbles (gas) to pass through, is provided in the ink vessel (see JP-A-2005-169851 (Patent Literature 1), for example).

SUMMARY

Here, it is recognized in recent years by the inventors that there is a concern that foreign matter other than bubbles, which did not initially exist in the ink in the ink chamber, will be generated over time depending on the type of ink. Accordingly, in the configuration in the prior art where the low pressure chamber is provided in the ink chamber, there is a concern that ink which includes foreign matter flows out from the ink chamber to the outside without it being possible to remove the foreign matter other than bubbles which is generated.

Here, these circumstances are typically shared in liquid containing vessels which supply a liquid to a liquid consumption apparatus which consumes the liquid without being limited to an ink vessel which supplies ink to an ink jet printer.

The present invention is conceived in light of these circumstances. An advantage of the present invention is to provide a liquid containing vessel with which it is possible to suppress liquid that includes bubbles (gas) and foreign matter other than bubbles from flowing out from a liquid containing chamber.

The means for solving the problem and operational effects thereof will be described below.

A liquid containing vessel which solves the problem has a liquid containing chamber configured to contain a liquid, the liquid containing chamber having a filter chamber with a filter through which the liquid is configured to pass, and a low pressure chamber having a pressure that is lower than atmospheric pressure.

According to this configuration, since the liquid containing chamber is provided with both the filter chamber and the low pressure chamber, it is possible to suppress the liquid which includes bubbles (gas) and foreign matter other than bubbles (dirt and the like) from flowing out from the liquid containing chamber through a liquid supply opening.

In the liquid containing body described above, it is preferable that the low pressure chamber is arranged such that at least a portion of the low pressure chamber overlaps with the filter chamber in a projection direction where a projection area of the filter chamber to the low pressure chamber is maximized.

According to this configuration, due to the low pressure chamber overlapping in a direction where the projection area with the filter chamber is maximized, it is possible for bubbles (gas) in the filter chamber to easily and effectively flow to the low pressure chamber.

In the liquid containing body described above, it is preferable that the length of a liquid inflow region where the liquid is configured to flow into the filter chamber in a vertical direction is shorter than the length in a direction that intersects with the vertical direction.

According to this configuration, it is possible for the liquid inflow region to be positioned in the liquid containing chamber on the gravity direction side in the vertical direction. Accordingly, since the liquid in the liquid containing vessel, which is reduced by flowing out from the liquid supply opening, physically remains on the gravity direction side, it is possible for the liquid to easy flow into the filter chamber is possible through the liquid inflow region which is positioned on the gravity direction side.

In the liquid containing body described above, it is preferable that the liquid containing vessel further has a supply member defining the liquid containing chamber by being joined with a containing chamber member, and including a liquid supply opening through which the liquid is configured to flow out from the liquid containing chamber to an outside, and a second supply member defining the filter chamber and the low pressure chamber, and being connected, when the supply member is a first supply member, with the first supply member, and that at least a portion of the filter chamber and the low pressure chamber of the second supply member being formed using a shared member.

According to this configuration, since at least a portion of the filter chamber and the low pressure chamber are formed using a shared member, it is possible for the filter chamber and the low pressure chamber to be formed at adjacent positions. Accordingly, there is a high probability that gas will be removed from the liquid which flows into the filter chamber using the low pressure chamber which is adjacent. In addition, it is possible to suppress a reduction in the amount of liquid which is possible to contain in the liquid containing chamber since it is possible to form the filter chamber and the low pressure chamber with a total volume which is smaller due to the filter chamber and the low pressure chamber being formed using the shared member.

In the liquid containing body described above, it is preferable that the second supply member is attachably and detachable connected with regard to the first supply member.

According to this configuration, replacing of members which configure the filter chamber and the low pressure chamber is possible. Accordingly, replacing is possible according to requirements when, for example, manufacturing the liquid containing vessel. In addition, for example, changing of filters in the filter chamber is also possible.

In the liquid containing body described above, it is preferable that the containing chamber member be formed using a flexible member that is deformable while the liquid flows out from the liquid containing chamber, and that the second supply member that defines the filter chamber including at least one convex section that defines a flow path in which the liquid in the liquid containing chamber is configured to flow to the filter chamber by passing through the filter between the containing chamber member and the second supply member while abutting with the containing chamber member that is deformable.

According to this configuration, it is possible for the liquid to be led to the filter chamber by flowing in a gap which is formed by the convex section so that the liquid does not remain in the liquid containing chamber.

In the liquid containing body described above, it is preferable that the filter of the filter chamber extends along a direction that intersects with a deforming direction of the containing chamber member, and that the filter chamber includes an abutting section that is abuttable with regard to the filter that deforms while the containing chamber member deforms.

According to this configuration, since the shape changing of the filter is regulated by the abutting section in the filter chamber, it is possible to suppress damage to the filter due to shape changing and suppress a reduction in the filter chamber.

In the liquid containing body described above, it is preferable that the filter chamber defines a flow path in which the liquid is configured to flow to the first supply member side, and that a cross sectional area of the flow path at a first position that is close to the first supply member is larger than a cross sectional area of the flow path at a second position that is farther from the first supply member than the first position.

According to this configuration, since the flow speed of the liquid which flows out to the first supply member side is slower in the filter chamber, it is possible for the liquid to easily flow to the liquid supply opening.

A liquid containing vessel which solves the problem has a liquid containing chamber configured to contain a liquid, the ink containing chamber having a filter chamber with a filter through which the liquid is configured to pass, and a low pressure chamber with a low pressure space having a pressure that is lower than atmospheric pressure, and the low pressure chamber is disposed at a position where a proportion of gas that is dissolved in the liquid with regard to the liquid in the filter chamber is reduced.

According to this configuration, since gas is removed from the liquid in the filter chamber using the low pressure chamber which is formed using the second supply member, it is possible to suppress the liquid which includes dirt and bubbles (gas) from flowing out from the ink containing chamber.

BRIEF DESCRIPTION OF THE DRAWINGS

Referring now to the attached drawings which form a part of this original disclosure:

FIG. 6A is a planar diagram, FIG. 6B is a cross sectional diagram along a line A-A in FIG. 6A, and FIG. 6C is an enlarged diagram of a portion which is shown with an arrow 6*c* in FIG. 6B;

FIG. 10A is a partial planar diagram and FIG. 10B is a cross sectional diagram along a line B-B in FIG. 10A;

FIG. 17A is a side surface diagram of an ink vessel, FIG. 17B is a cross sectional diagram along a line C-C in FIG. 17A, and FIG. 17C is a cross sectional diagram along a line D-D in FIG. 17A;

FIG. 18A is a planar of an ink vessel and FIG. 18B is a cross sectional diagram along a line E-E in FIG. 18A;

FIG. 21A is a diagram of a state prior to a first supply member being inserted in a through hole in a casing member, FIG. 21B is a diagram of a state where a first supply member is inserted in a through hole.

FIGS. 22A to 22C are diagrams of state which correspond to FIGS. 21A to 21C and are diagrams illustrating a state where a casing member of an ink cartridge is partially cut away;

FIG. 28A is a side surface diagram of a mounting section, FIG. 28B is a cross sectional diagram along a line G-G in FIG. 28A, and FIG. 28C is a cross sectional diagram along a line H-H in FIG. 28A;

FIG. 29A is a side surface diagram of a mounting section, FIG. 29B is a cross sectional diagram along a line I-I in FIG. 29A, and FIG. 29C is a cross sectional diagram along a line J-J in FIG. 29A;

FIG. 30A is a side surface diagram of a mounting section, FIG. 30B is a cross sectional diagram along a line K-K in FIG. 30A, and FIG. 30C is a cross sectional diagram along a line L-L in FIG. 30A;

DETAILED DESCRIPTION OF EMBODIMENTS

An embodiment of an ink jet printer which is an example of a liquid consumption apparatus will be described with reference to the drawings. The printer of the present embodiment performs printing on a sheet P by forming an image or the like due to ink, which is an example of a liquid, being ejected, that is, consumed, on the sheet P which is an example of a target which is transported in one direction.

<Printer Configuration>

Figure 1:
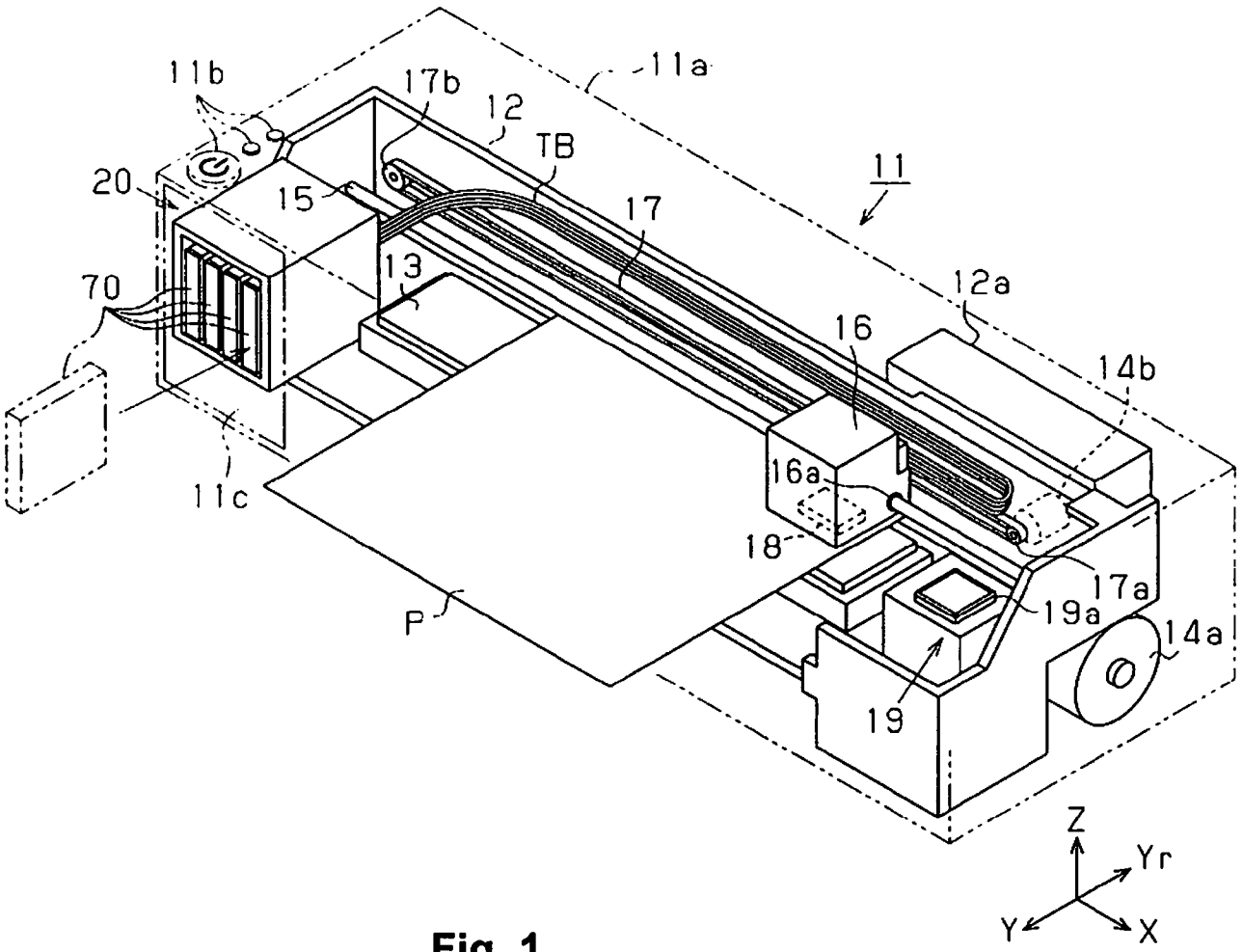
FIG. 1 is a perspective diagram illustrating an outline of an embodiment of a printer which is an example of a liquid consumption apparatus.

As shown in FIG. 1, a printer 11 of the present embodiment is provided with a casing 11*a* with substantially a rectangular cube shape with a portion thereof indicated by a two-dot chain line. Operation buttons 11*b* such as a power button for driving the printer 11 are provided on a direction Z side which is the opposite direction to the gravity direction which is an upper surface of the casing 11*a*. In addition, a cover 11*c* which is able to open and close is provided in a front surface of the casing 11*a* which is on a transport direction Y side in which the sheet P is transported. It is possible for the user to gain access inside the casing 11*a* in a state where the cover 11*c* is open.

A support platform 13, where a direction which intersects with the transport direction of the sheet P is the longitudinal direction, is provided to extend substantially in the horizontal direction at a lower section on the gravity direction side in a frame 12 with a substantially rectangular box shape which contains an internal space which is covered by the casing 11*a*. In addition, a sheet feeding motor 14*a* is provided at a lower section of the frame 12 on the rear side which is the opposite side to the transport direction. That is, the sheet P is supplied on the support platform 13 from the rear side to the front side using a sheet feeding mechanism (which is not shown in the diagrams) which is operated by being driven by the paper feeding motor 14*a*.

In addition, a guide shaft 15 is provided to span above the support platform 13 in the frame 12 along the longitudinal direction of the support platform 13. A carriage 16 is supported on the guide shaft 15 so as to be able to move back and forth in the shaft direction of the guide shaft 15. In detail, a support hole 16*a* is formed in the carriage 16 to pass through in the left and right direction and the guide shaft 15 passes through the support hole 16*a*.

A drive pulley 17*a* and a driven pulley 17*b* are respectively supported to rotate freely at an inner surface of the rear wall of the frame 12 in the vicinity of both ends of the guide shaft 15. The output shaft of the carriage motor 14*b* is linked with the drive pulley 17*a*. In addition, an endless timing belt 17 where a portion thereof is linked with the carriage 16 is wound around between the drive pulley 17*a* and the driven pulley 17*b*. Then, the carriage 16 is moved back and forth in the longitudinal direction, that is, a scanning direction X while being guided by the guide shaft 15 through the timing belt 17 due to driving of the carriage motor 14*b*.

A liquid ejecting head 18 which is an example of a liquid ejecting section is provided on the lower side of the carriage 16. An image is printed on the sheet P by ink which is supplied with regard to the liquid ejecting head 18 being ejected from the liquid ejecting head 18. Supplying of ink to the liquid ejecting head 18 is performed using an ink cartridge 70 which is an example of a liquid containing body which is mounted so as to be able to be inserted and extracted in a mounting section 20 which is provided inside the casing 11*a*. That is, the mounting section 20, in which the ink cartridge 70 is mounted, is provided to be arranged on the left side in the scanning direction X when viewed from the front of the casing 11*a* in the transport direction Y. In addition, an ink supply tube TB where it is possible for ink to flow links between the mounting section 20 and the carriage 16. Supplying of ink from the ink cartridge 70 which is mounted in the mounting section 20 to the ink ejecting head 18 is performed through the ink supply tube TB.

In the present embodiment, it is possible for four of the ink cartridges 70 (refer to FIG. 12) to be mounted in the mounting section 20 with ink vessels 80 respectively in casing members 73, where the ink vessels are examples of a liquid containing vessel where ink of each color of, for example, cyan, magenta, yellow, and black with tones which are different to each other are respectively contained. Each of the ink cartridges 70 are able to be inserted and extracted with regard to the mounting section 20 through the cover 11*c* which is open as is shown for one of the ink cartridges 70 by the two-dot chain line in FIG. 1.

In addition, a maintenance apparatus 19 is provided at a region inside the frame 12 more to the right side in the scanning direction X than the support platform 13 when viewed from the front in the transport direction Y, that is, at a home position region which is not used during printing. The maintenance apparatus 19 has a cap 19*a* which opens upward, a suction pump which is not shown in the diagrams, and the like. Then, a maintenance operation where ink is ejected stably from the ink ejecting head 18 is performed in the printer 11 by the maintenance apparatus 19 after the carriage 16 is moved to the home position region.

Various operations which are performed in the printer 11 are controlled using a control section. In the present embodiment, the control section is configured using a circuit board where electronic elements such as a CPU, a RAM, and a ROM are installed and is provided to be arranged in a box body 12*a* which is provided at, for example, the rear of the frame 12.

Furthermore, the control section performs communication of specific information (for example, data which is used for identifying types of the ink cartridges 70 and data which indicates the remaining amount of ink in the ink vessels 80) with a storage element 36 (refer to FIG. 10B) which is an example of a storage apparatus which are provided in the ink cartridges 70 in a case where ink is supplied from the ink cartridges 70. In detail, communication of information is performed by electronically connecting between an electrical connection section which is provided in the mounting section 20 and an electrical connection section which is provided in the ink cartridges 70. Here, the respective electrical connection sections in the mounting section 20 and the ink cartridges 70 will be described later.

<Configuration of Mounting Section for Ink Cartridges>

Next, the configuration of the mounting section 20 will be described.

Figure 2:
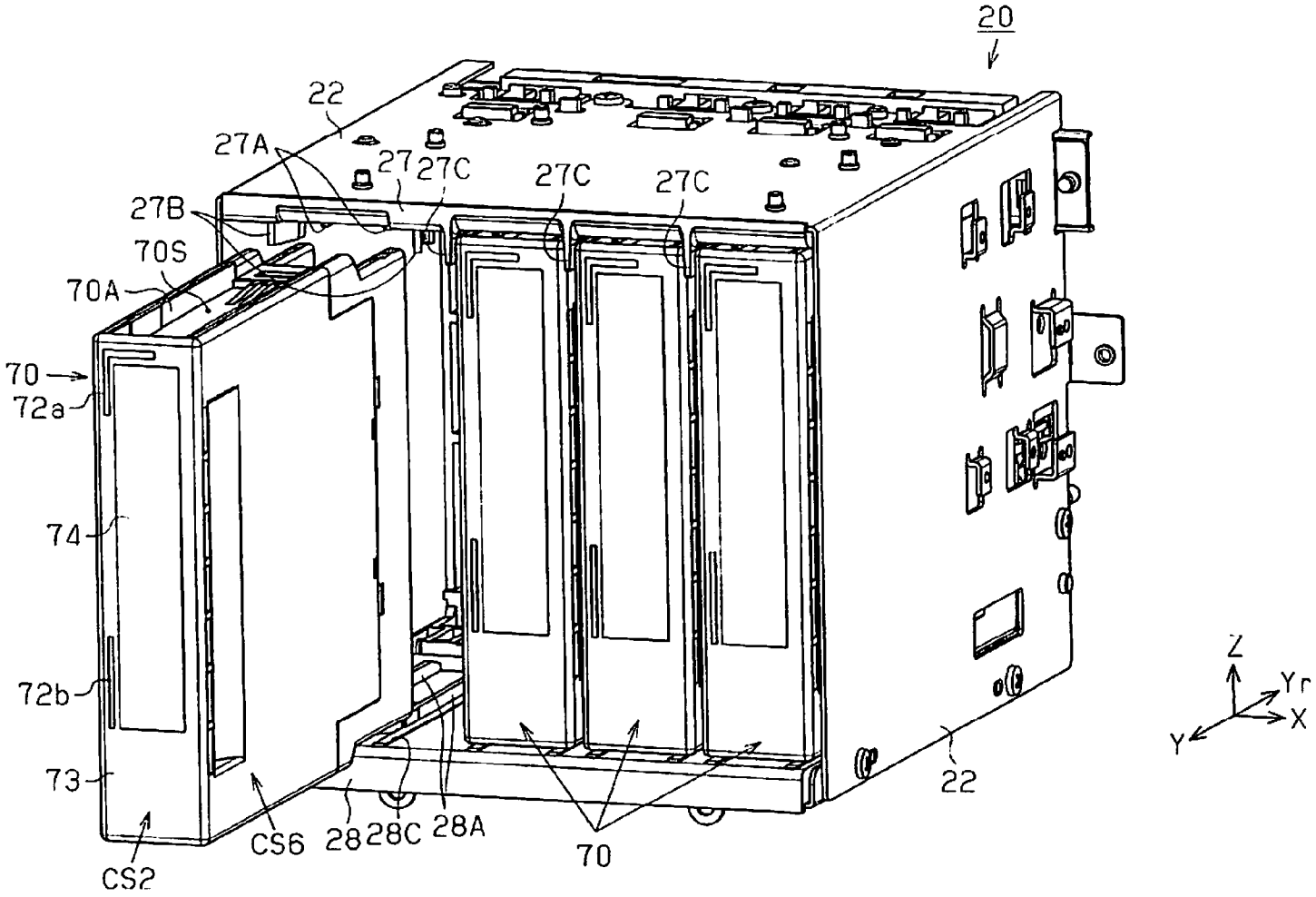
FIG. 2 is a perspective diagram illustrating a mounting section for an ink cartridge which is provided in a printer.
Figure 3:
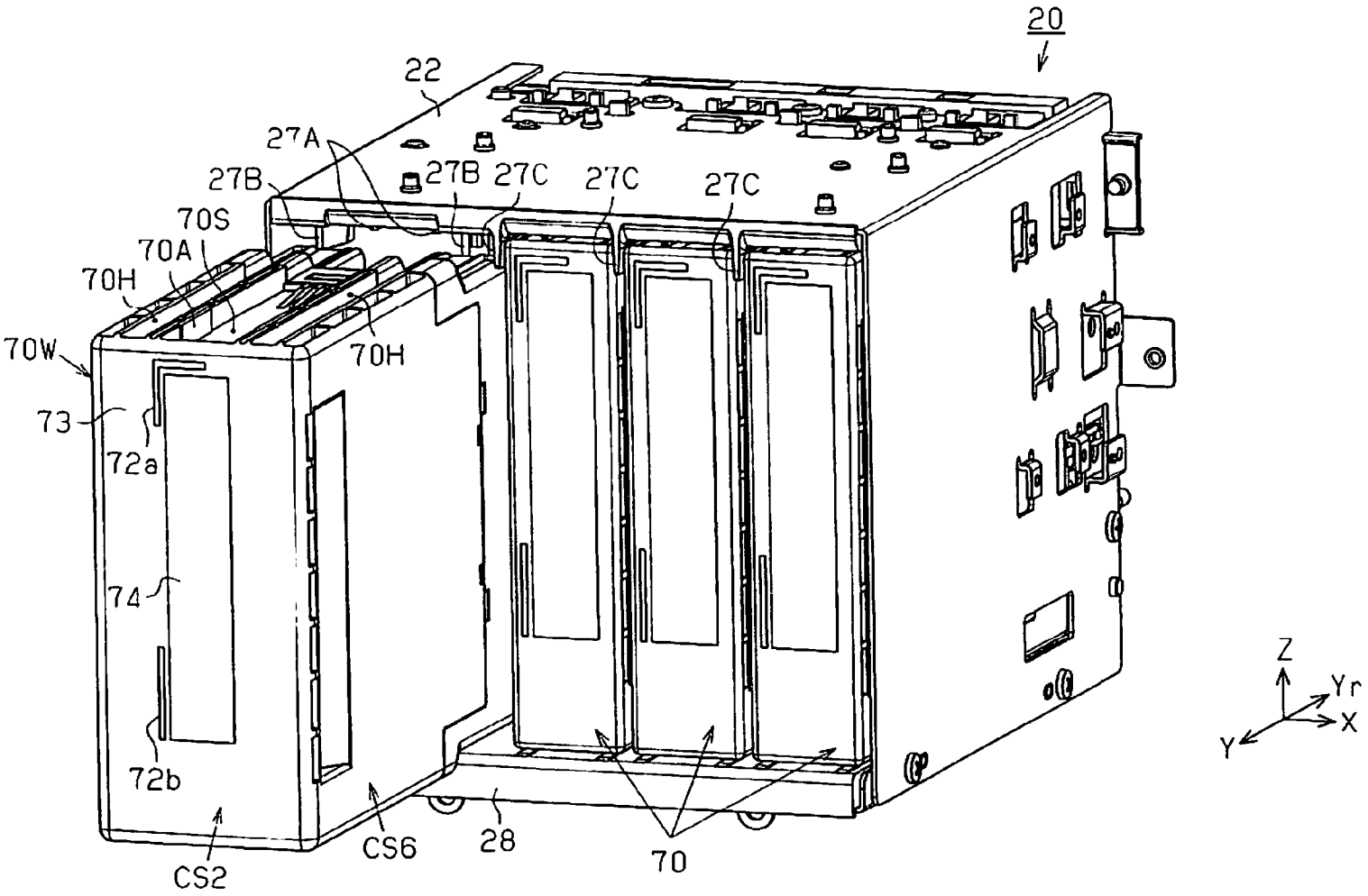
FIG. 3 is a perspective diagram illustrating a state where an ink cartridge with a larger width is mounted in a mounting section.
Figure 4:
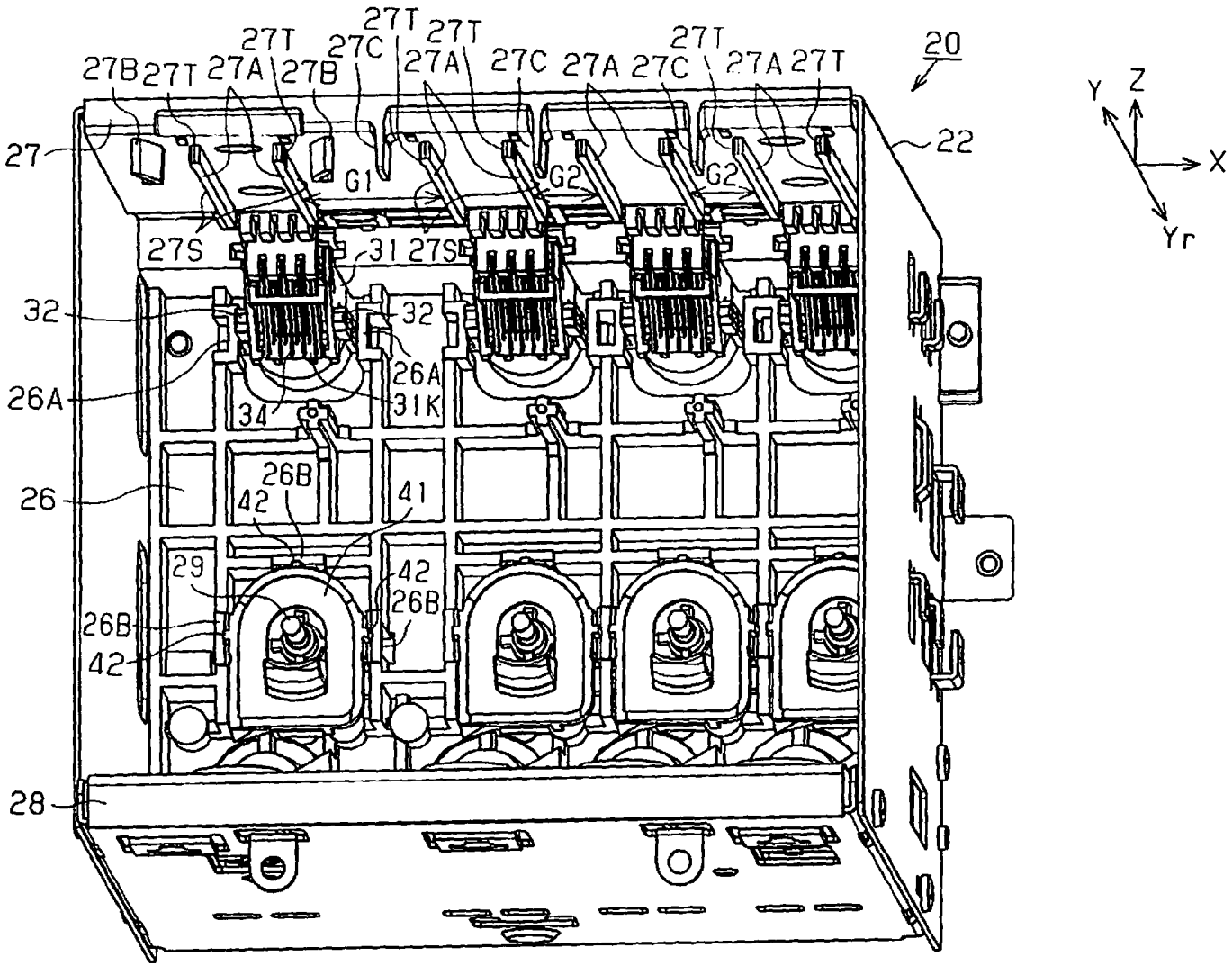
FIG. 4 is a perspective diagram illustrating a mounting section where an ink cartridge is mounted so as to be able to be inserted and extracted.

As shown in FIG. 2, FIG. 3, and FIG. 4, the mounting section 20 of the present embodiment is configured to be able to hold four of the ink cartridges 70 with substantially a rectangular cube shape in cartridge holding bodies 22 with substantially a box shape which is open on the transport direction Y side which is the opposite direction to an insertion direction Yr so that the ink cartridges 70 line up along the scanning direction X. Then, the mounting section 20 has a configuration where it is possible to hold the ink cartridges 70, where at least one of four of the ink cartridges 70 has different width dimensions in the scanning direction X which intersects with the insertion direction, in the cartridge holding bodies 22.

In detail, the mounting section 20 of the present embodiment is configured so that an ink cartridge 70W with a wider width than the ink cartridge 70 is able to be inserted and extracted as one of the ink cartridges 70, which is held in the cartridge holding body 22 farthest to the left side in the scanning direction X when viewed from the front in the transport direction Y, out of four ink cartridges 70.

That is, an upper member 27 is attached on an upper section which is positioned at the inner side of the cartridge holding body 22 with substantially a box shape in the direction Z which is the opposite direction to the gravity direction. Upper guide ribs 27A, which are a pair of guide rails which are provided to protrude downward along the insertion direction Yr for the ink cartridges 70, are provided in the upper member 27. The upper guide ribs 27A are provided to have designated intervals in the scanning direction X according to the respective insertion positions of the ink cartridges 70 to be inserted in the cartridge holding bodies 22.

The upper guide ribs 27A have a side surface 27S which opposes upper side inner walls 70A which are formed in the upper surface of the ink cartridge 70. The upper side inner walls 70A are a pair of surface on the inner side where convex sections 70S are formed along the insertion direction Yr. The side surfaces 27S function as guiding surfaces for the ink cartridge 70. That is, the position of the ink cartridge 70 which is inserted in the mounting section 20 is regulated in the cartridge holding body 22 so that the upper side surface is in the scanning direction X and movement in the insertion direction Yr is guided due to abutting of the upper side inner walls 70A which oppose the side surfaces 27S. Here, as shown in FIG. 4, ribs 27T, which protrude toward the outer side in the scanning direction X, are formed to have a specific length in the insertion direction Yr in the upper guide ribs 27A at an edge section in the opposite direction to the insertion direction Yr. The function of the ribs 27T of the upper guide ribs 27A will be described later.

As shown in FIG. 4, the upper guide ribs 27A, which correspond to the ink cartridge 70 which is held in the cartridge holding body 22 farthest to the left side, are provided in the upper member 27 so that the interval between the adjacent upper guide ribs 27A is wider than for the upper guide ribs 27A which correspond to the three other ink cartridges 70. That is, in the present embodiment, a gap G1 between the upper guide ribs 27A, which correspond to the ink cartridge 70 which is held farthest to the left side when viewed from the front in the insertion direction Yr, and the adjacent upper guide ribs 27A is set to be larger than a gap G2 between the other upper guide ribs 27A and the adjacent upper guide ribs 27A. Accordingly, due to the gap G1 being set to be larger than the gap G2 in this manner, it is possible to insert the ink cartridge 70W with a larger width as shown in FIG. 3 in the cartridge holding body 22 farthest to the left side. In other words, the gap G1 is set to have an interval so that it is possible to insert the ink cartridge 70W with a larger width.

Figure 5:
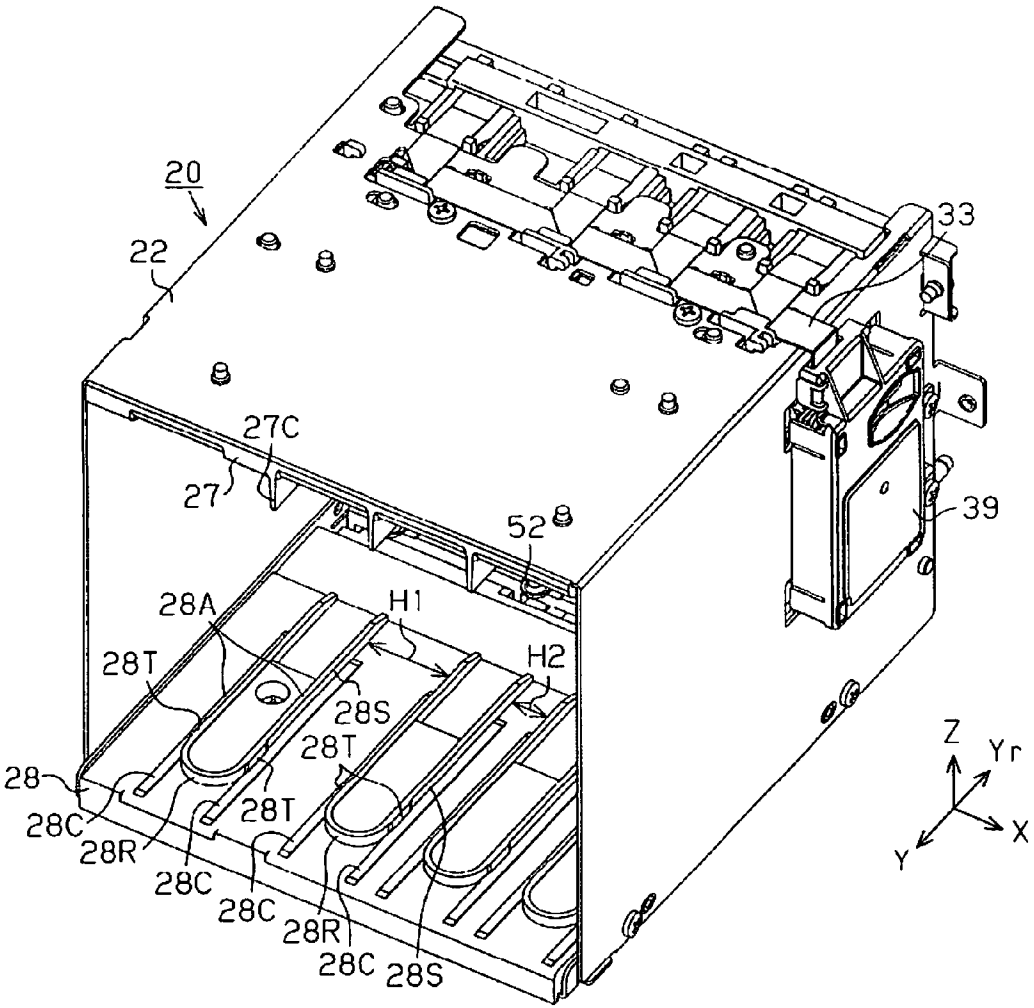
FIG. 5 is a perspective diagram of a mounting section viewed from a direction which is different to FIG. 4.

In addition, as shown in FIG. 2 and FIG. 5, a bottom member 28 is attached to a bottom section of the cartridge holding body 22 with substantially a box shape. Lower guide ribs 28A, which are a pair of guide rails which protrude upward along the insertion direction Yr for the ink cartridge 70 are provided in the bottom member 28 to have specific intervals in the scanning direction X. The lower guide ribs 28A are provided to correspond to the ink cartridges 70 which are inserted in the mounting section 20. In the present embodiment, the lower guide ribs 28A are provided in positions to substantially oppose the upper guide ribs 27A.

The pair of lower guide ribs 28A have substantially a U shape where the opposite direction side to the insertion direction Yr for the ink cartridges 70 is linked using ribs 28R with a semicircle arc shape. Then, side surfaces 28S of the lower guide ribs 28A which have substantially a U shape function as guide surfaces which oppose lower side inner walls 70B (refer to FIG. 7B and FIG. 9B) which are provided at the bottom surface of the ink cartridge 70. The lower side inner walls 70B are inner wall surfaces of a pair of lower side convex sections 70D which are formed on both sides in the scanning direction X. That is, movement of the ink cartridge 70 in the scanning direction X is regulated in the cartridge holding body 22 and movement of the ink cartridge 70 in the insertion direction Yr is guided due to the lower side inner walls 70B of the lower side convex sections 70D abutting with the side surfaces 28S of the lower guide ribs 28A.

Figure 6A:
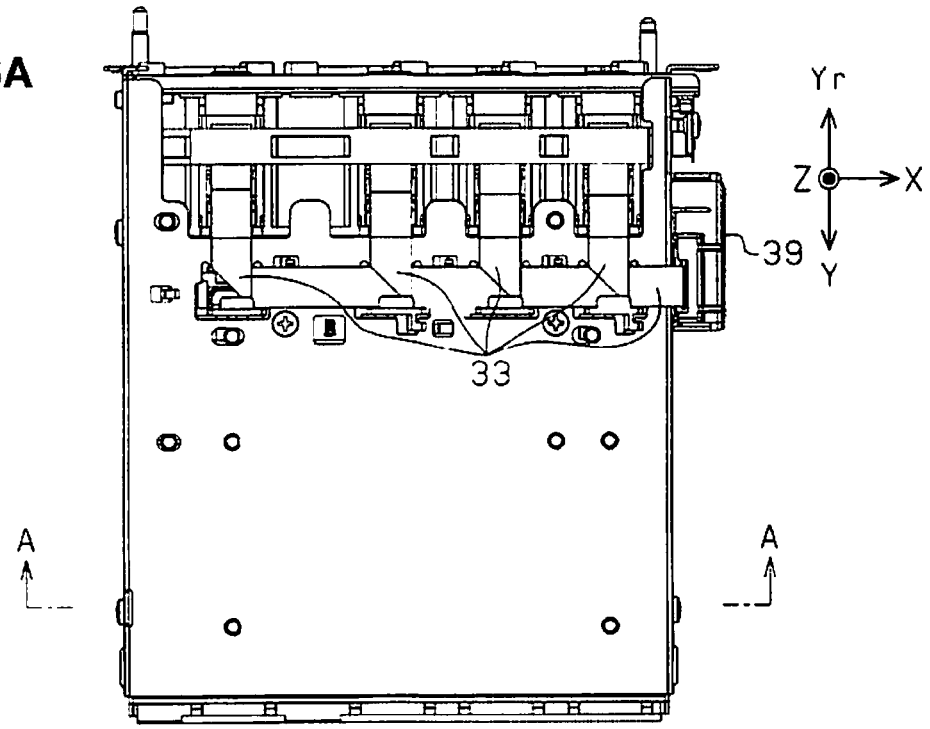
FIGS. 6A to 6C are diagrams illustrating a mounting section.
Figure 6B:
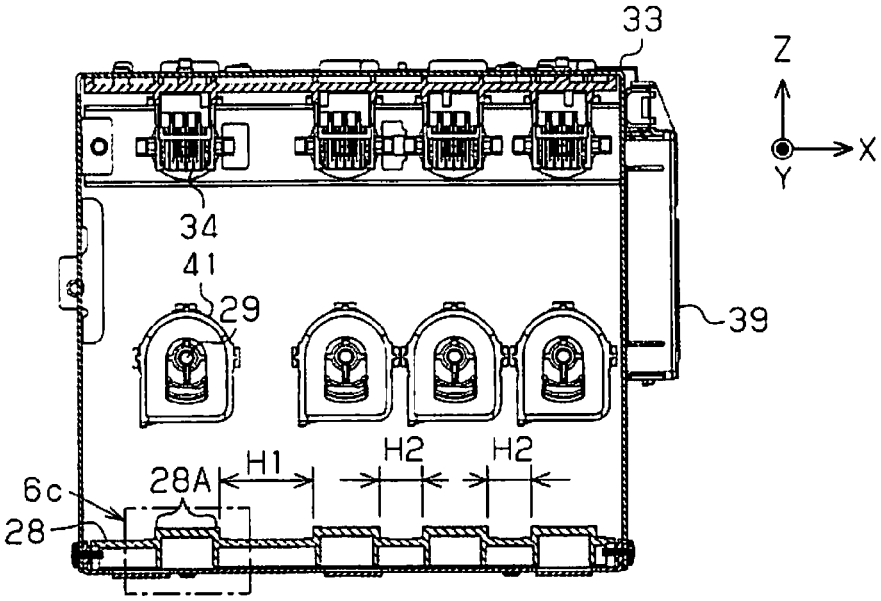
Figure 6C:
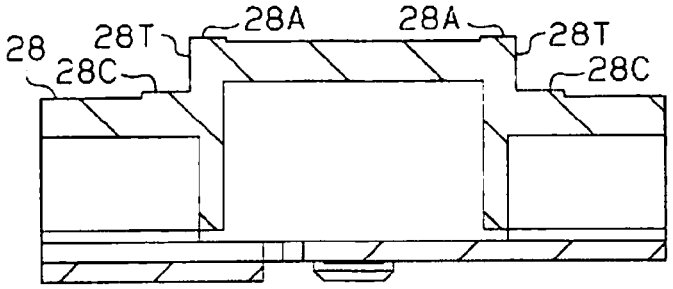

In addition, as shown in FIG. 5 and FIG. 6C, a pair of ribs 28T, which extend in the insertion direction Yr with specific lengths and protrude toward the outer side in the scanning direction X, are formed at adjacent positions to the arc shaped ribs 28R. In addition, rails 28C along the insertion direction Yr are formed to protrude in the Z direction more than the bottom surface of the bottom member 28 to be adjacent to the outer side of the lower guide ribs 28A in the scanning direction X. The function of the ribs 28T and the rails 28C of the lower guide ribs 28A will be described later.

Then, as shown in FIG. 5 and FIG. 6B, the lower guide ribs 28A, which correspond to the ink cartridge 70 which is held in the cartridge holding body 22 farthest to the left side, is provided in the bottom member 28 so that the interval with the adjacent lower guide rib 28A is wider than the interval with the lower guide ribs 28A which correspond to the three other ink cartridges 70. That is, in the present embodiment, a gap H1 between the lower guide ribs 28A, which correspond to the ink cartridge 70 which is held farthest to the left side, and the adjacent lower guide ribs 28A is set to be larger than a gap H2 between the adjacent lower guide ribs 28A among the three other lower guide ribs 28A. Accordingly, due to the gap H1 being set to be larger than the gap H2 in this manner, it is possible to insert the ink cartridge 70W with a larger width as shown in FIG. 3 at an insertion position for the ink cartridge 70 which is held in the cartridge holding body 22 farthest to the left side. In other words, the gap H1 is set to have an interval so that it is possible to insert the ink cartridge 70W with a larger width.

In addition, as shown in FIG. 3 and FIG. 4, in a case where the ink cartridge 70W with a larger width is inserted with regard to the cartridge holding body 22 at the position farthest to the left side and three of the ink cartridges 70 are inserted in the other positions, both the ink cartridge 70 and the ink cartridge 70W with a larger width are inserted while movement in the scanning direction X is regulated. That is, movement of each of the ink cartridge 70 and the ink cartridge 70W with a larger width in the scanning direction X is generally regulated due to an insertion guiding section 27C which protrudes downward from the upper member 27 at an end section on the opening side of the cartridge holding body 22 which is the opposite direction side to the insertion direction Yr side of the ink cartridge 70.

On the other hand, as shown in FIG. 2 and FIG. 4, when the ink cartridge 70 is inserted in the cartridge holding body 22 instead of the ink cartridge 70W with a larger width, the width of the ink cartridge 70 in the scanning direction X is narrower than the ink cartridge 70W. Accordingly, it is difficult to regulate movement of the ink cartridge 70 in the scanning direction X using the insertion guiding section 27C. Therefore, in the present embodiment, guide sections 27B which are a pair of guiding protuberances are provided for guiding the ink cartridge 70 in the cartridge holding body 22. The guide sections 27B are formed to engage with an upper section on the insertion direction Yr side of the ink cartridge 70 so that the upper guide ribs 27A are positioned in concave sections 70S.

That is, the guide sections 27B are formed in the upper member 27 as ribs which protrude downward at end sections on the open side of the cartridge holding body 22 on both sides with regard to the upper guide ribs 27A in an intersecting direction which intersects with the insertion direction Yr for the ink cartridge 70. The guide sections 27B are provided so that the interval between each of the guide sections 27B in the scanning direction X becomes narrower toward the insertion direction Yr. As a result, as shown in FIG. 3, grooves 70H, where it is possible for the guide section 27B to be inserted when being inserted in the cartridge holding body 22, is formed in the ink cartridge 70W with a larger width on both sides of the concave section 70S.

<Configuration of Ink Cartridge>

Next, the configurations of the ink cartridge 70 and the ink cartridge 70W will be described in detail. Here, the configuration of the ink cartridge 70 will be described first, and after this, the ink cartridge 70W will be described. Here, only the differences with the configuration of the ink cartridge 70 will be described with regard to the ink cartridge 70W with a larger width.

Figure 7B:
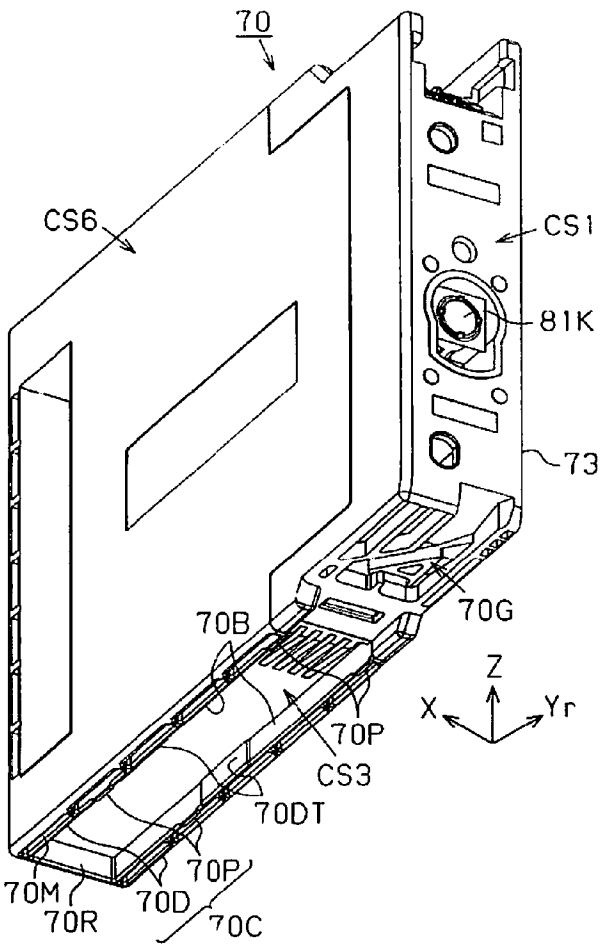
FIGS. 7A and 7B are perspective diagrams illustrating the shape of an ink cartridge.
Figure 7A:
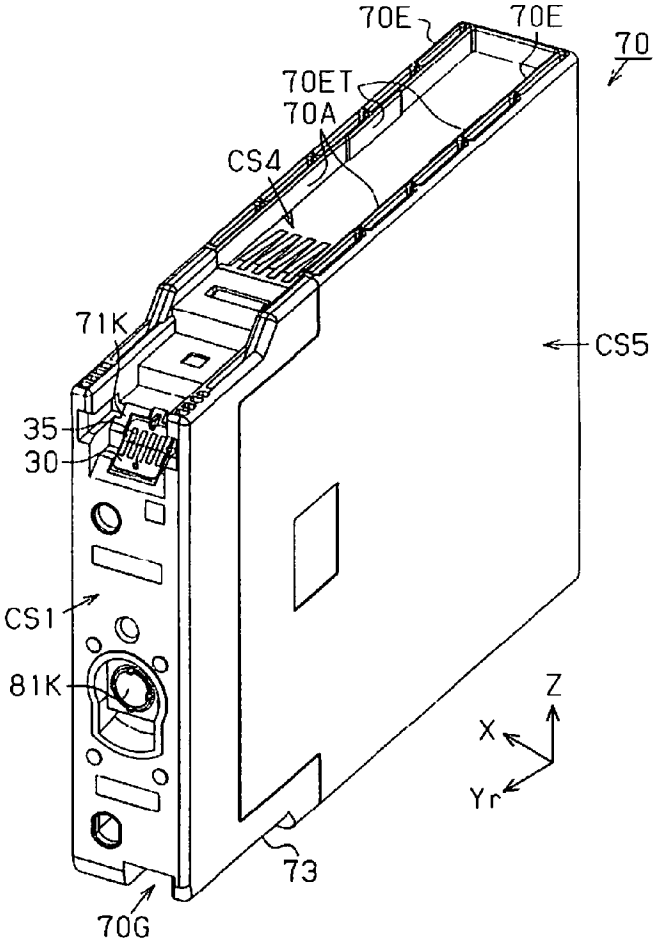

As shown in FIG. 2 and FIGS. 7A and 7B, the ink cartridge 70 has substantially a rectangular cube shape which is formed of six surfaces. That is, the ink cartridge 70 has a first surface CS1 which is the insertion direction side into the mounting section 20 and a second surface CS2 which opposes the first surface CS1. Furthermore, the ink cartridge 70 has a third surface CS3 which intersects with the first surface CS1 and the second surface CS2 and which is the gravity direction side in a state of being mounted in the mounting section 20, a fourth surface CS4 which opposes the third surface CS3, a fifth surface CS5 which extends in a direction which intersects with the first surface CS1, the second surface CS2, and the third surface CS3, and a sixth surface CS6 which opposes the fifth surface CS5. In the present embodiment, the surface on the left side in the scanning direction X viewed from the second surface CS2 side is the fifth surface CS5 and the surface on the right side in the scanning direction X viewed from the second surface CS2 side is the sixth surface CS6.

Figures 8A, 8B, 8C, 8D, 8E:
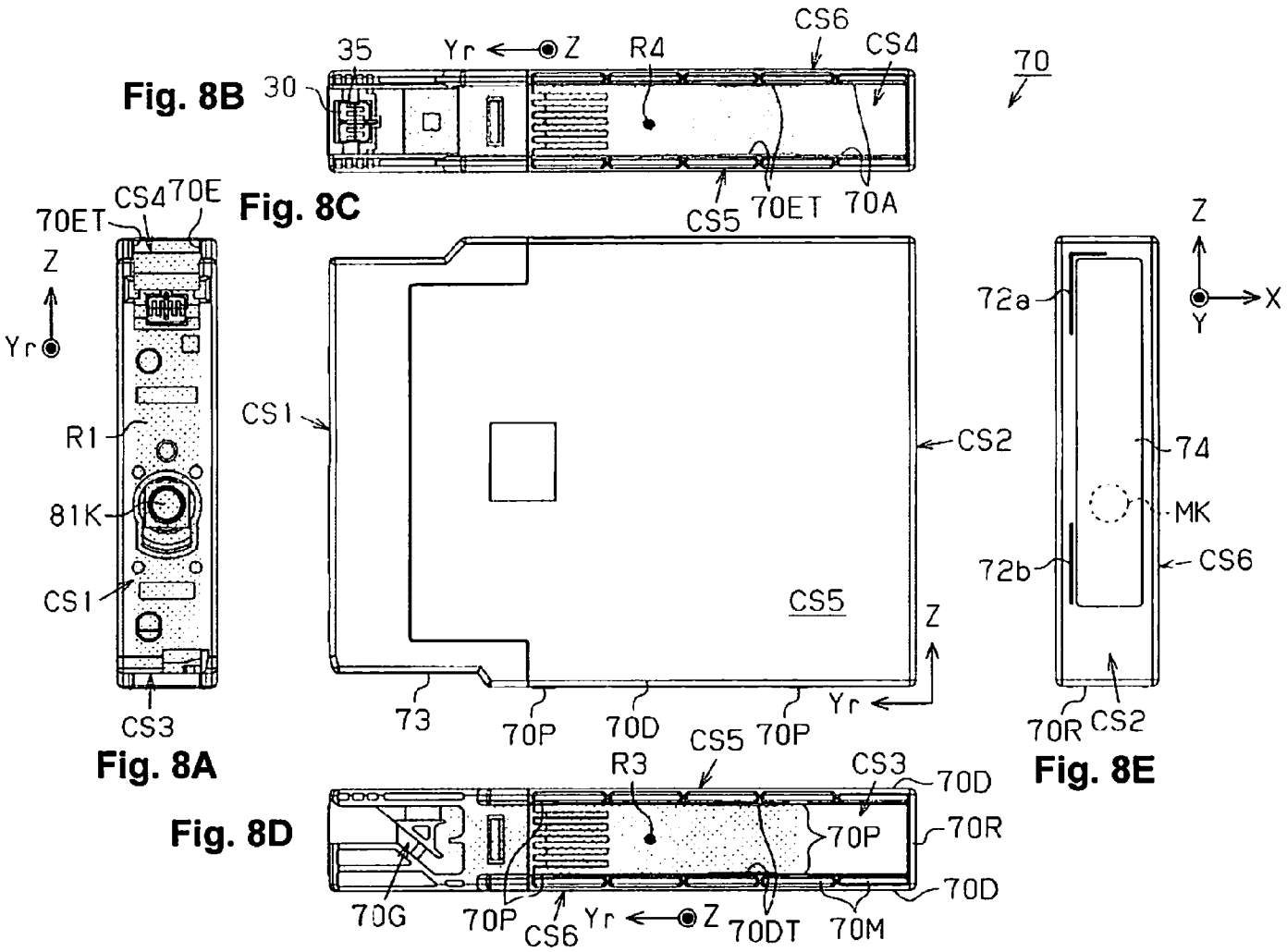
FIGS. 8A to 8E are diagrams illustrating each surface of an ink cartridge.

As shown in FIG. 7A and FIG. 8B, a pair of upper side convex sections 70E where the upper side inner walls 70A are a pair of side surfaces are provided in the fourth surface CS4 of the ink cartridge 70 in the insertion direction Yr at both end sections, which is the upper surface when mounted in the mounting section 20, in the scanning direction X. The upper side convex sections 70E are provided in a line along the insertion direction Yr on the fifth surface CS5 side and the sixth surface CS6 side. In the present embodiment, the outer side surfaces of the upper side convex sections 70E are formed as respective portions of the fifth surface CS5 and the sixth surface CS6. Upper convex wall sections 70ET which protrude to the inner side are each formed in the respective upper side convex sections 70E at positions in the upper side inner walls 70A which oppose each other with specific lengths in the insertion direction Yr. The function of the upper convex wall sections 70ET will be described later.

Then, as shown by the shaded region in FIG. 8B, a circuit board 30, where a first terminal 35 is provided as an electrical connection section which performs electrical connection with the printer 11 (the mounting section 20), is attached to an extending region R4 in the insertion direction Yr in a region which is interposed by two of the upper convex wall sections 70ET which oppose each other. In addition, the circuit board 30 is attached with a posturing so that downstream side in the insertion direction Yr is closer to the third surface CS3 side than the upstream side and is in a state of being inclined with regard to the insertion direction Yr.

As shown by FIG. 7B and FIG. 8B, the pair of lower side convex sections 70D described above are provided in the third surface CS3, which is the bottom surface when mounted in the mounting section 20, to extend in a line along the insertion direction Yr on the fifth surface CS5 side and the sixth surface CS6 side respectively. In the present embodiment, the inner side surfaces of the lower side convex sections 70D are the lower side inner walls 70B along the insertion direction Yr, and the outer side surfaces of the pair of lower side convex sections 70D are respective portions of the fifth surface CS5 and the sixth surface CS6. Lower convex wall sections 70DT which protrude to the inner side are each formed in the respective lower side convex sections 70B at positions which oppose each either with specific lengths in the insertion direction Yr. The function of the upper convex wall sections 70DT will be described later.

Then, as shown by the shaded region in FIG. 8D, a groove section 70G, which is able to engage with a moveable fastening section which is provided in the printer 11 (the mounting section 20), is formed in an extending region R3 in the insertion direction Yr in a region which is interposed by two of the lower convex wall sections 70DT which oppose each other.

In addition, as shown by FIGS. 8C and 8D, protuberance sections 70P, where a portion thereof further protrudes from the third surface CS3 to the gravity direction side, are provided in the third surface CS3 at the respective lower side convex sections 70D which are provided on the fifth surface CS5 side and the sixth surface CS6 side. In the present embodiment, a total of four of the protuberance sections 70P are formed on the bottom surface due to two of the protuberance sections 70P being provided to be spaced with an interval in the insertion direction Yr. In other words, convex sections 70C are configured by the lower side convex sections 70D which are a pair of linear convex sections along the insertion direction Yr and the protuberance sections 70P which are provided in the lower side convex sections 70D. Then, as will be described later, the convex sections 70C come into contact with the mounting section 20 due to sliding on the rails 28C which are provided in the bottom member 28.

Here, in the present embodiment, a plurality of rectangular grooves 70M are formed in the lower side convex sections 70D. The rectangular grooves 70M are formed with the object of preventing recesses being generated due to compression of composite resin which is a material for the ink cartridge 70 after molding of the ink cartridge 70. The protuberance sections 70P are provided at portions which are positioned farthest to the inner side of the lower side convex sections 70D, where the rectangular grooves 70M are formed, in the width direction. In addition, the first terminal 35, which is provided in the circuit board 30 which is attached to the fourth surface CS4, is formed so to be positioned between the protuberance sections 70P (the convex sections 70C) which are respectively provided on the fifth surface CS5 side and the sixth surface CS6 side when viewed from the insertion direction Yr into the mounting section 20 in a state where the ink cartridge 70 is mounted in the mounting section 20. In addition, the protuberance sections 70P (the convex sections 70C) pass through the center of the third surface CS3 in a direction which is from the fifth surface CS5 to the sixth surface CS6 and are formed more to the fifth surface CS5 side and the sixth surface CS6 side than a virtual plane which is parallel to the fifth surface CS5.

Furthermore, as shown in FIG. 7B and FIGS. 8D and 8E, a linking rib 70R is formed to link two of the lower side convex sections 70D (second convex sections) which are positioned between the convex sections 70C (first convex sections) which are provided in the third surface CS3 when the ink cartridge 70 of the present embodiment is viewed from the insertion direction Yr into the mounting section 20. The linking rib 70R is provided in the third surface CS3 on the second surface CS2 side in the opposite direction to the insertion direction Yr. Here, in the present embodiment, the linking rib 70R is formed to protrude so that the height from the third surface CS3 is the same height as the lower side convex section 70D and is provided so as to configure a portion of the second surface CS2.

As shown in FIGS. 7A and 7B and FIGS. 8A, 8B, and 8D, a liquid supply opening 81K, where it is possible for ink to flow to the outside from an ink chamber IS (refer to FIG. 12) which is an example of a liquid containing chamber which is provided in the ink cartridge 70, is provided in the first surface CS1 of the ink cartridge 70 in a region R1 which intersects with the extending region R3 and the extending region R4. That is, as shown by the shaded region in FIG. 8A, the region R1 in the first surface CS1 is a region which is continuous with the extending region R3 and the extending region R4. The liquid supply opening 81K is provided in the region R1 at a position which is closer to the third surface CS3 than the fourth surface CS4. Here, in the present embodiment, the liquid supply opening 81K is provided in the region R1 in substantially the center of a direction from the third surface CS3 toward the fourth surface CS4 and in substantially the center of a direction from the fifth surface CS5 toward the sixth surface CS6.

As shown in FIG. 2 and FIG. 8E, positioning marks 72*a* and 72*b*, which indicate the positions for adhering a label 74 which is for identifying the ink cartridge 70, are formed in the second surface CS2 which is the opposite direction side to the insertion direction Yr into the mounting section 20. The positioning marks 72*a* and 72*b* are formed with a convex shape or a concave shape with regard to the surface of the second surface CS2 and it is possible for a user to easily adhere the label 74 at an appropriate position on the second surface CS2 with the positioning marks 72*a* and 72*b* as markers.

In addition, although omitted from the diagram, it is possible for a mark MK, which indicates the position for a user to press when inserting the ink cartridge 70 in the mounting section 20, such as the letters for "press", to be written on the label 74 which is adhered to the second surface CS2. Here, it is preferable for the mark MK to be written in the label 74 which is adhered to the second surface CS2 at a position which opposes the liquid supply opening 81K which is provided in the first surface CS1 as shown by the dashed line circle in FIG. 8E.

Figure 9B:
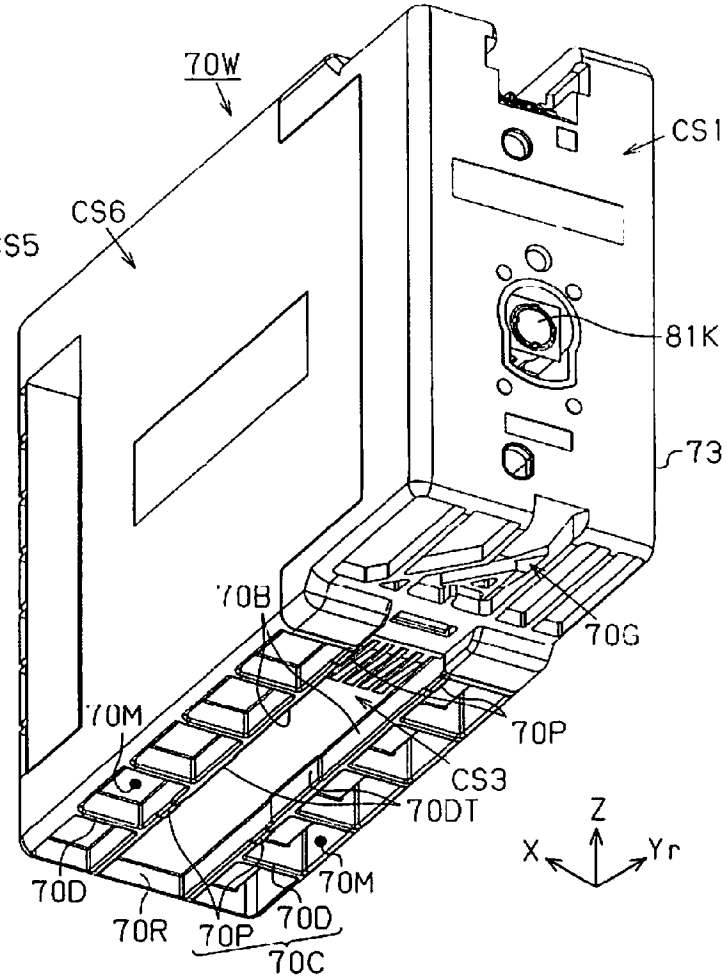
FIGS. 9A and 9B are perspective diagrams illustrating the shape of an ink cartridge with a larger width.
Figure 9A:
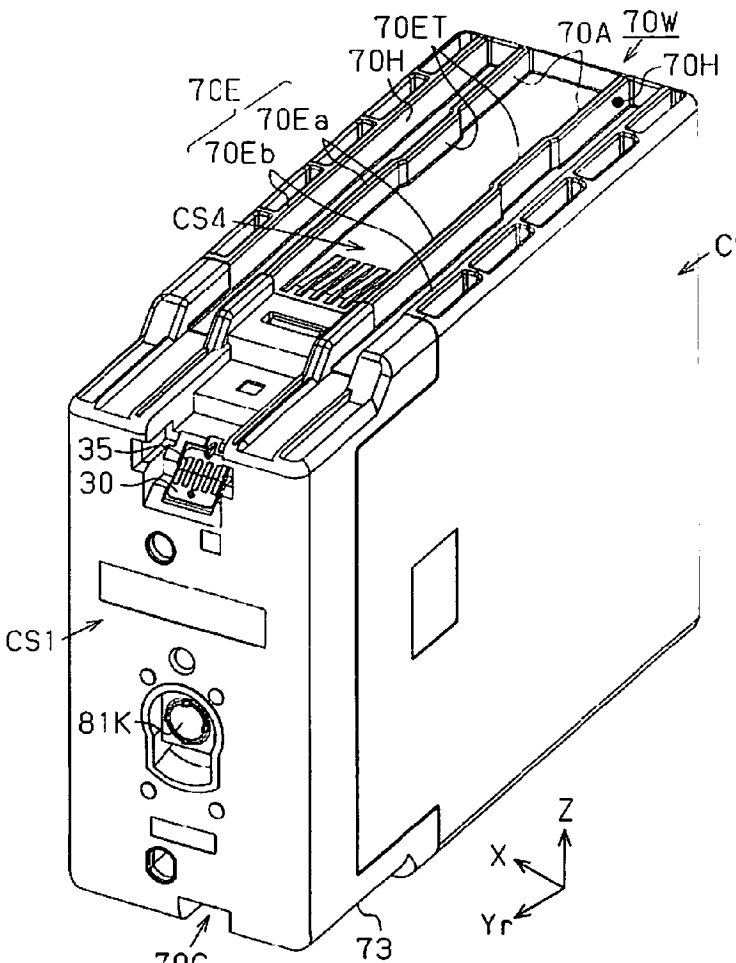

Next, as shown in FIG. 3 and FIGS. 9A and 9B, the liquid supply opening 81K, the groove section 70G, the circuit board 30, and the label 74 in the ink cartridge 70W with a larger width have the same shape with regard to the ink cartridge 70, and the ink cartridge 70W with a larger width is a shape where the casing member 73 is wide in the width direction (the scanning direction X). Accordingly, the shapes of the fifth surface CS5 and the sixth surface CS6 of the ink cartridge 70W with a larger width is the same shape as the ink cartridge 70 and the shapes of the first surface CS1, the second surface CS2, the third surface CS3, and the fourth surface CS4 of the ink cartridge 70W with a larger width are different to the ink cartridge 70.

In the present embodiment, the first surface CS1 where the liquid supply opening 81K is provided and the second surface CS where the label 74 is adhered are shapes where the casing member 73 is provided to extend with a length which is equal at both sides in the width direction. In addition, the third surface CS3 is a shape where the width of the lower side convex sections 70D are wider. In the lower side convex sections 70D which are wider, the protuberance sections 70P are provided at portions which are positioned farthest to the inner side in the width direction and are at the same positions as in the ink cartridge 70.

The fourth surface CS4 is different to the third surface CS3 and the pair of upper side convex sections 70E are respectively configured by an inner side convex section 70Ea and an outer side convex section 70Eb. The upper convex wall sections 70ET is provided in the inner side convex section 70Ea which is positioned more to the inner side in the width direction than the outer side convex section 70Eb. In addition, the gap between the inner side convex section 70Ea and the outer side convex section 70Eb is a groove 70H which is the groove section along the insertion direction Yr. The groove 70H is provided as a groove where it is possible for the guide section 27B which is a guiding protuberance to be inserted when inserting in the cartridge holding body 22. In addition, there is a configuration where it is possible for the inner side convex section 70Ea to be inserted between the upper guide rib 27A and the guide section 27B and the upper side inner wall 70A is guided by the upper guide rib 27A. In this manner, in the present embodiment, the upper side convex section 70E and the groove 70H are provided in the ink cartridge 70W in the fourth surface CS4 which is one of the side surfaces.

<Configuration of Mechanisms for Mounting Ink Cartridge in Mounting Section>

Here, a terminal connecting mechanism which transfers specific information data by electrically connecting with the storage element 36 which is provided in the ink cartridge 70 (70W) which is inserted in the mounting section 20, and a flow path connecting mechanism, where ink flows from the liquid supply opening 81K of the ink cartridge 70 (70W) which is inserted into the mounting section 20, are provided in the mounting section 20 of the present embodiment. In addition, a holding mechanism is provided which holds the ink cartridge 70 (70W) which is inserted so as to not fall out from the cartridge holding body 22. Next, the terminal connecting mechanism, the flow path connecting mechanism, and the holding mechanism will be described with reference to the drawings with a case where the ink cartridge 70 is mounted as an example. It is obvious that the case where the ink cartridge 70W is mounted is the same.

First, the configuration of the terminal connecting mechanism will be described.

Figure 10A:
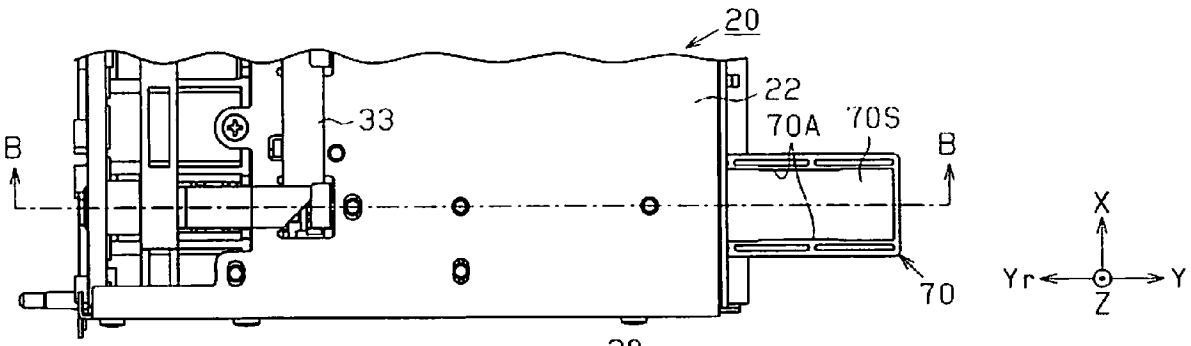
FIGS. 10A and 10B are diagrams illustrating a state where an ink cartridge is partially inserted in a mounting section.
Figure 10B:
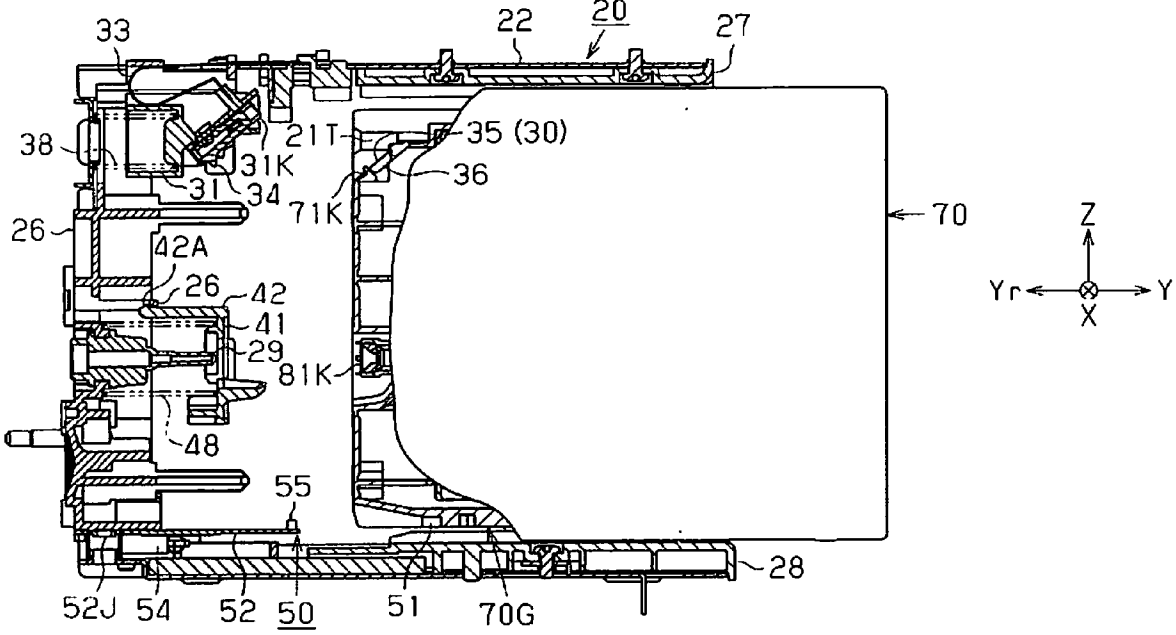

As shown in FIG. 4 and FIGS. 10A and 10B, a wall member 26 which extends in a direction which is orthogonal to the insertion direction Yr is formed on an inner section, which is opposite to the opening side of the cartridge holding body 22 with a box shape, as a portion which configures a far wall surface of the cartridge holding body 22. A second terminal 34 is provided as an electrical connection section on the mounting section 20 side on the side of the wall member 26. The first terminal 35 which is the electrical connection section which is provided in the ink cartridge 70 electrically connects by abutting with regard to the second terminal 34. Then, due to the electrical connection between the first terminal 35 and the second terminal 34, information, which is sent from a wiring board 33 such as a flexible board through the second terminal 34, is stored by being transferred to the storage element 36 which is the storage apparatus which is provided in the ink cartridge 70 through the first terminal 35.

In detail, as shown in FIG. 4, a moveable member 31 which is able to move by sliding along the insertion direction Yr is provided in the wall member 26 of the cartridge holding body 22. That is, a pair of slide guide sections 26A with a guide hole (which is not shown in the diagrams) which are provided along the insertion direction Yr are formed in the wall member 26 so as to correspond with each of the ink cartridges 70. A pair of slide sections 32, where a portion is formed as a sliding section (which is not shown in the diagram) which slides in the guide hole, are provided in the moveable member 31. Accordingly, a sliding mechanism is configured by the slide sections 32 moving along the slide guide sections 26A (the guide holes), and the moveable member 31 moves along the insertion direction Yr. Here, the moveable member 31 regulates movement to the insertion direction Yr side due to the rear end sections of the slide sections 32 abutting with the slide guide sections 26A.

In addition, in the present embodiment, an inclined surface 71K, which is inclined so as to intersect with regard to the insertion direction Yr, is formed in the ink cartridge 70 as shown in FIG. 4, FIG. 7A, and FIGS. 10A and 10B at an end section of the fourth surface CS4 on the insertion direction Yr side toward the cartridge holding body 22. The first terminal 35 is provided on the inclined surface 71K. In addition, an opposing section 31K, which opposes the first terminal 35 when the ink cartridge 70 is inserted in the cartridge holding body 22, is formed on the front side (in the opposite direction to the insertion direction Yr) of the moveable member 31. Furthermore, the second terminal 34 is provided on the opposing section 31K. Then, the moveable section 31 is provided at a position where it is possible for the second terminal 34 to abut with regard to the first terminal 35 when moved by sliding along the insertion direction Yr on the wall member 26.

Here, in the present embodiment, the first terminal 35 which is the electrical connection section is a metal pattern which is formed on the circuit board 30, where the board surface is provided to be arranged along the inclined surface 71K of the ink cartridge, in more detail, is formed on the board surface. Then, a memory which is an IC chip which is provided on the circuit board 30 functions as the storage element 36. In addition, the second terminal 34 is a metal plate which is attached to the opposing section 31K of the moveable member 31 in a state of one end being held and it is possible for the connection portion (abutting portion) with the first terminal 35 to be slightly displaced so that the metal plate reliably abuts with the first terminal 35.

In addition, the area of the board surface along the inclined surface 71K in the circuit board 30, which is provided on the inclined surface 71K which is inclined with regard to the insertion direction Yr, is large compared with the projection area of the inclined surface 71K in the insertion direction Yr. Accordingly, it is possible to form a plurality of metal patterns on the board surface of the circuit board 30.

The moveable member 31 of the present embodiment presses the opposing section 31K in a direction to be closer to the first terminal 35 of the ink cartridge 70 (here, the opposite direction to the insertion direction Yr). That is, a second pressing member 38, which presses the moveable member 31 in the opposite direction to the insertion direction Yr, that is, in a direction where the opposing section 31K is closer to the first terminal 35, is provided in the wall member 26. Here, in the present embodiment, a compressed coil spring is used as the second pressing member 38 and the moveable member 31 is in a state of being pressed by the second pressing member 38 in a state where movement to the front direction is regulated.

Here, as shown in FIG. 5 and FIGS. 6A and 6B, the wiring board 33 performs communication of specific information with the control section which is provided in the printer 11 through a relay device 39 which is attached to one of the side surfaces of the cartridge holding body 22. The terminal connecting mechanism is configured in this manner.

Next, the configuration of the flow path connecting mechanism will be described.

As shown in FIG. 4, due a supply needle 29 which is provided in the wall member 26 being inserted in the liquid supply opening 81K which is provided in the ink cartridge 70, ink which is contained in the ink chamber IS in the ink cartridge 70 flows into the inside of the supply needle 29. Ink which flows into the inside of the supply needle 29 is supplied to the liquid ejecting head 18 using a liquid supply mechanism which is not shown in the diagrams through a flow path (which is not shown in the diagrams) which is formed in the wall member 26.

In addition, as shown in FIG. 4 and FIG. 10B, a moving body 41, which is provided to be arranged to surround the supply needle 29 and is able to move along the insertion direction Yr, and a first pressing member 48, which is a first surface pressing member which presses the moving body 41 in the opposite direction to the insertion direction Yr, are provided in the mounting section 20. In the present embodiment, the first pressing member 48 uses a compressed coil spring and is provided to be arranged in the wall member 26 so that the supply needle 29 is positioned at the inner side of the coil shape.

Accordingly, the first pressing member 48 functions as the first surface pressing member which presses the first surface CS1 of the ink cartridge 70 due to the moving body 41 abutting with regard to the ink cartridge 70 which is inserted. Then, a portion, which is centered on the liquid supply opening 81K in the first surface CS1 which abuts with the moving body 41, functions as a first surface pressed member. Here, in the present embodiment, the liquid supply opening 81K is provided in the first surface CS1 at a position which is closer to the third surface CS3 than the fourth surface CS4. Accordingly, the first surface pressed member is positioned in the first surface CS1 in the same manner at a position which is closer to the third surface CS3 than the fourth surface CS4.

Here, in the present embodiment, three protruding sections 42 which are provided along the insertion direction Yr are formed in the moving body 41 and the moving body 41 moves along the insertion direction Yr due to each of the protruding sections 42 moving along three groove sections 26B which are provided in the wall member 26. In addition, the moving body 41 regulates movement to the insertion direction Yr side due to rear end sections 42A of each of the protruding sections 42 abutting with the wall member 26. The flow path connecting mechanism is configured in this manner.

Next, the configuration of the holding mechanism will be described.

After the ink cartridge 70 which is inserted in the cartridge holding body 22 abuts with the moving body 41, a pressing force is generated in the mounting section 20 of the present embodiment in the opposite direction to the insertion direction Yr in order for the first pressing member 48 to be compressed to accompany the movement of the ink cartridge 70 in the insertion direction Yr. The pressing force which is generated acts as a force to press back the ink cartridge 70 through the moving body 41. As a result, it is difficult for the ink cartridge 70 to be held in the cartridge holding body 22 in a state of being pushed against the pressing force of the first pressing member 48. Therefore, in the present embodiment, the holding mechanism is provided so that the ink cartridge 70, which is pushed in the cartridge holding body 22, does not fall out.

Figure 11A:
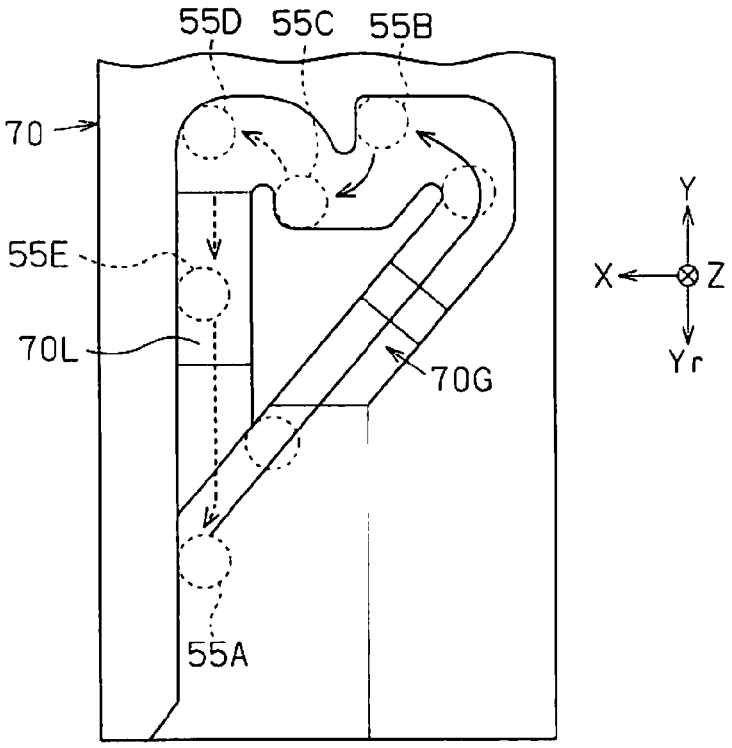
FIG. 11A is a partial bottom surface diagram illustrating a groove section of an ink cartridge which is engaged with a moveable fastening section and FIG. 11B is a schematic diagram illustrating a configuration of a lever member which functions as a movable fastening section which is provided in a mounting section.
Figure 11B:
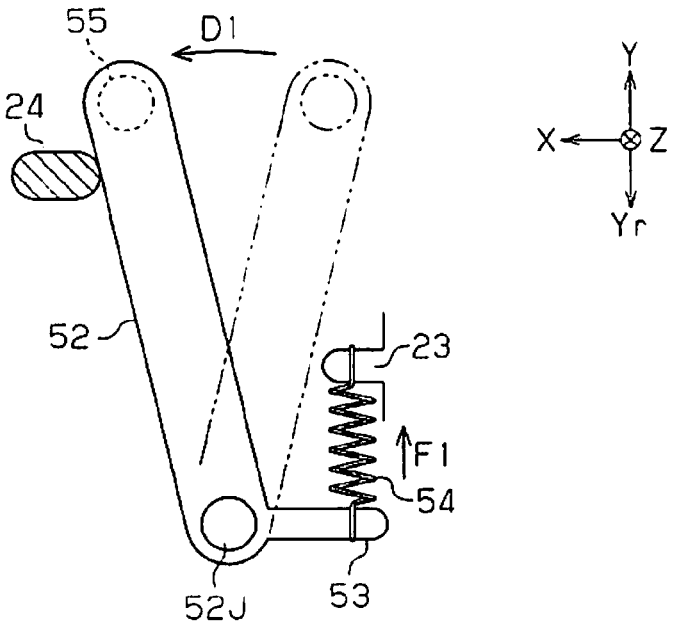

As shown in FIG. 10B and FIGS. 11A and 11B, the holding mechanism is configured using the groove section 70G which is provided in the third surface CS3 (the bottom surface) of the ink cartridge 70 and a lever member 52 which is the moveable fastening section which is pivotally supported by the cartridge holding body 22 (the bottom member 28) to rotate freely. That is, the groove section 70G of the ink cartridge 70 has a cam shape and the ink cartridge 70 is held by being fastening with the mounting section 20 by the groove section 70G which has the cam shape engaging with regard to the lever member 52.

The lever member 52 rotates centered on a shaft section 52J which has an axis which is orthogonal to the inner bottom surface of the cartridge holding body 22 where a base end side of the lever member 52 is formed, and a pin 55, which is formed on the upper side at a front end side which is opposite to the base end side of the lever member 52, swings. Then, the lever member 52 is normally pressed so as to swing in one direction D1 (here, a counterclockwise direction viewed from below) centered on the shaft section 52J due to a tension force F1 of a spring 54 which is provided to span between a hanger section 53 which is formed on the lever member 52 and a hanger section 23 which is provided on the cartridge holding body 22. As a result, the pin 55 which is formed in the lever member 52 is normally pressed to swing in the one direction D1. Here, rotating of the lever member 52 in the one direction D1 is regulated using a regulating section 24 which is provided in the cartridge holding body 22.

In the holding mechanism which is configured in this manner, the pin 55 moves in the order of a path which is set by the groove section 70G with a cam shape to accompany the inserting of the ink cartridge 70 in the cartridge holding body 22 as shown by the dashed line circles in FIG. 11A. In other words, the groove section 70G in the ink cartridge 70 functions as a cam and the pin 55 in the lever member 52 functions as a cam follower.

That is, the pin 55 in the ink cartridge 70 is in a state of moving from a start position which is indicated by the reference numeral 55A to a position which is indicated by the reference numeral 55B by moving as shown by the solid line arrows in FIG. 11A when the ink cartridge 70 is pushed in the cartridge holding body 22 against the pressing force of the first pressing member 48. Then, when pushing is terminated in this state, the ink cartridge 70 is slightly pressed back to the front by the first pressing member 48, and the pin 55 moves along the cam shape of the groove section 70G by swinging in the one direction D1 and moves to a position which is indicated by the reference numeral 55C. This position is a regulating position where movement of the pin 55 is regulated by the groove section 70G, and due to the pin 55 moving to the regulating position, the ink cartridge 70 is held in the regulated state, where movement in an extraction direction (here, the opposite direction to the insertion direction Yr) which is opposite to the insertion direction Yr is regulated due to the pressing force of the first pressing member 48. That is, due to the pin 55 moving to the regulating position, the groove section 70G is fastened with the pin 55 in the lever member 52 and the ink cartridge 70 is in a holding state where movement in the extraction direction from the mounting section 20 is regulated.

In the present embodiment, the holding state of the ink cartridge 70 is a mounting state of the ink cartridge 70 in the mounting section 20, and in the mounting state, the lever member 52 generates a pressing force on the ink cartridge 70 which pushes up the pin 55 in the groove section 70G. That is, the lever member 52 is configured so that the lever member 52 abuts in a state of being pressurized with regard to the groove section 70G so that reliable movement is possible along the cam shape of the groove section 70G. Accordingly, the lever member 52 functions as a moveable fastening section and also functions as a third surface pressing member which presses the third surface. Then, the groove section 70G functions as the third surface pressed section which is pressed by the lever member 52.

After this, when the ink cartridge 70 which is in the mounting state is again pushed in the insertion direction Yr into the cartridge holding body 22 against the pressing force of the first pressing member 48, restricting with regard to the movement of the pin 55 in the groove section 70G is terminated and the pin 55 moves from the restricting position to a position which is indicated by the reference numeral 55D in FIG. 11A. Then, when pushing of the ink cartridge 70 is terminated with movement to the position which is indicated by the reference numeral 55D, the ink cartridge 70 is pressed back in the extraction direction (the opposite direction to the insertion direction Yr) by the first pressing member 48 and the pin 55 moves from the position which is indicated by the reference numeral 55D to a position which is indicated by the reference numeral 55E. Furthermore, to accompany the ink cartridge 70 moving in the extraction direction due to the pressing force of the first pressing member 48, the pin 55 moves to an inclined section 70L while being pressed downward along the inclined section 70L which is formed with a cam shape and returns from the position which is indicated by the reference numeral 55E to the start position which is indicated by the reference numeral 55A as shown by the dashed line arrows in FIG. 11A. In this manner, the pin 55 repeatedly moves between the start position and the restricting position in the holding mechanism to accompany the operation of the ink cartridge 70 being pressed. The holding mechanism is configured in this manner.

<Configuration of Members in Ink Cartridge>

Next, the configuration of the ink cartridge 70 and the ink cartridge 70W with a larger width will be described.

Figure 12:
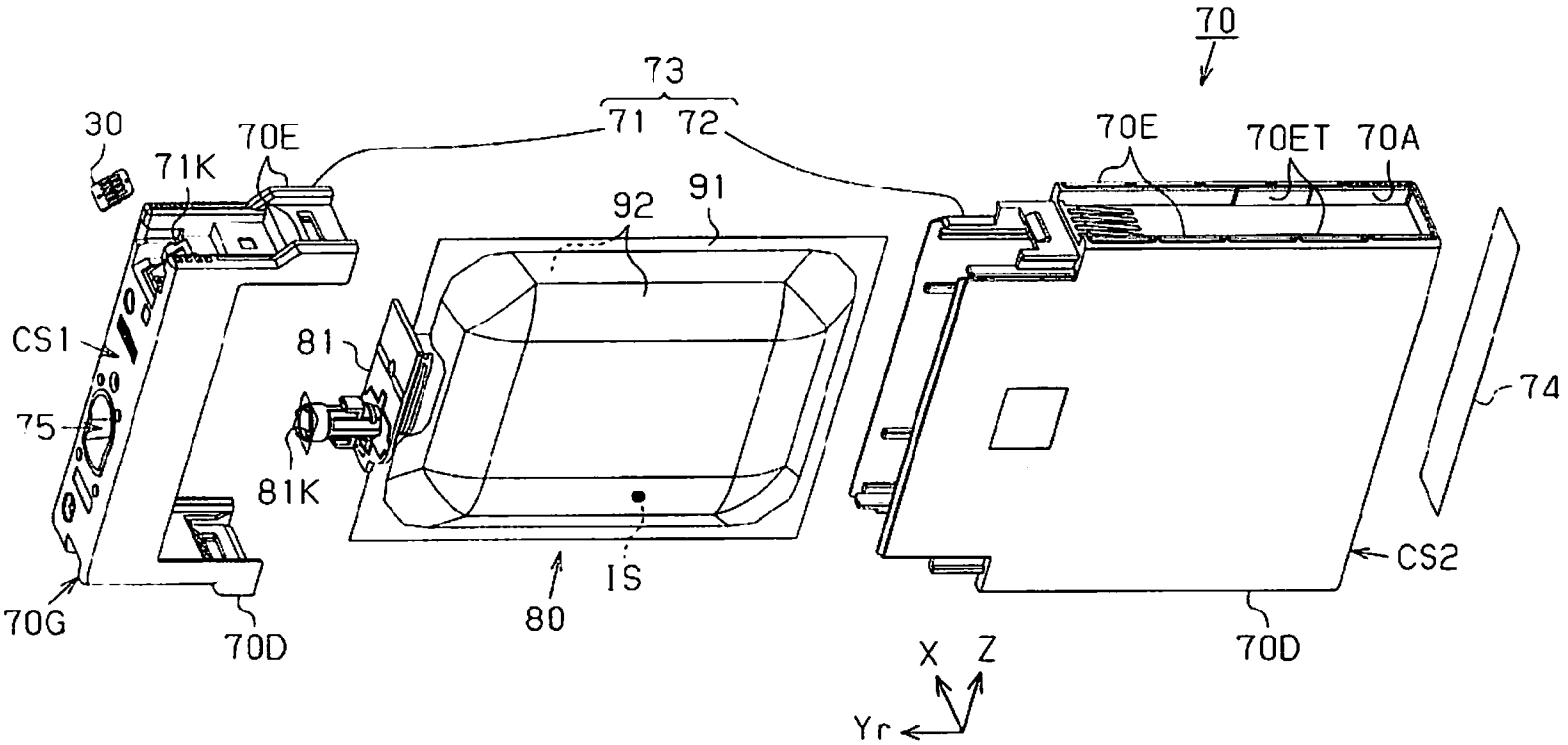
FIG. 12 is an exploded perspective diagram illustrating a configuration of an ink cartridge.

As shown in FIG. 12, the ink vessel 80 which is the liquid containing vessel is contained in the ink cartridge 70 in the casing member 73 where two members of a first casing member 71 on the insertion direction Yr side and a second casing member 72 on the opposite direction side to the insertion direction Yr are combined. The inclined surface 71K, where it is possible for the circuit board 30 to be attached at an end section on the insertion direction Yr side, is provided in the first casing member 71 on the upper surface side which is the Z side which is the opposite direction to the gravity direction when mounted in the mounting section 20, and the groove section 70G is provided in the first casing member 71 on the lower surface side. In addition, the liquid supply opening 81K is provided in the surface of the first casing member 71 on the insertion direction Yr side, that is, the first surface CS1, through a through hole 75H (refer to FIG. 21A and FIG. 22A) in a through hole forming section 75 which is provided in the first casing member 71 due to a first supply member 81 which is a supply member which is provided with the liquid supply opening 81K being supporting by being combined with the first casing member 71. The label 74 is adhered in the second casing member 72 on a surface on the opposite direction side to the insertion direction Yr, that is, on the second surface CS2 which opposes the first surface CS1. The ink cartridge 70 is completed by the second casing member 72 being combined with regard to the first casing member 71 which supports the ink vessel 80 by being moved by sliding in the insertion direction Yr.

The ink vessel 80 is formed in a state of a so-called ink pack where the opening side of a pack body 91 with a bag shape which is an example of a containing chamber member is joined with regard to the first supply member 81, and the inside of the ink vessel 80 is the ink chamber IS which is an example of the liquid containing chamber which it is possible for ink to be contained. In the present embodiment, the pack body 91 is formed using film which is an example of a flexible member and two pack members 92 with a rectangular thin plate shape, which extend in a direction which intersects with the scanning direction X, are formed initially in a bag shape by fusing three of the four outer sides. Then, the inside of the pack body 91 becomes the ink chamber IS by the pack body 91 being joined with the first supply member 81 due to one side on the opening side being fused together with the first supply member 81 in a state where the first supply member 81 is inserted in the opening side of the bag which is formed. Accordingly, the pack body 91 which has flexibility changes shape so that the gap with the two pack members 92 which oppose each other in the scanning direction X is reduced to accompany a reduction in the volume of the ink chamber IS due to ink flowing out.

Figure 13:
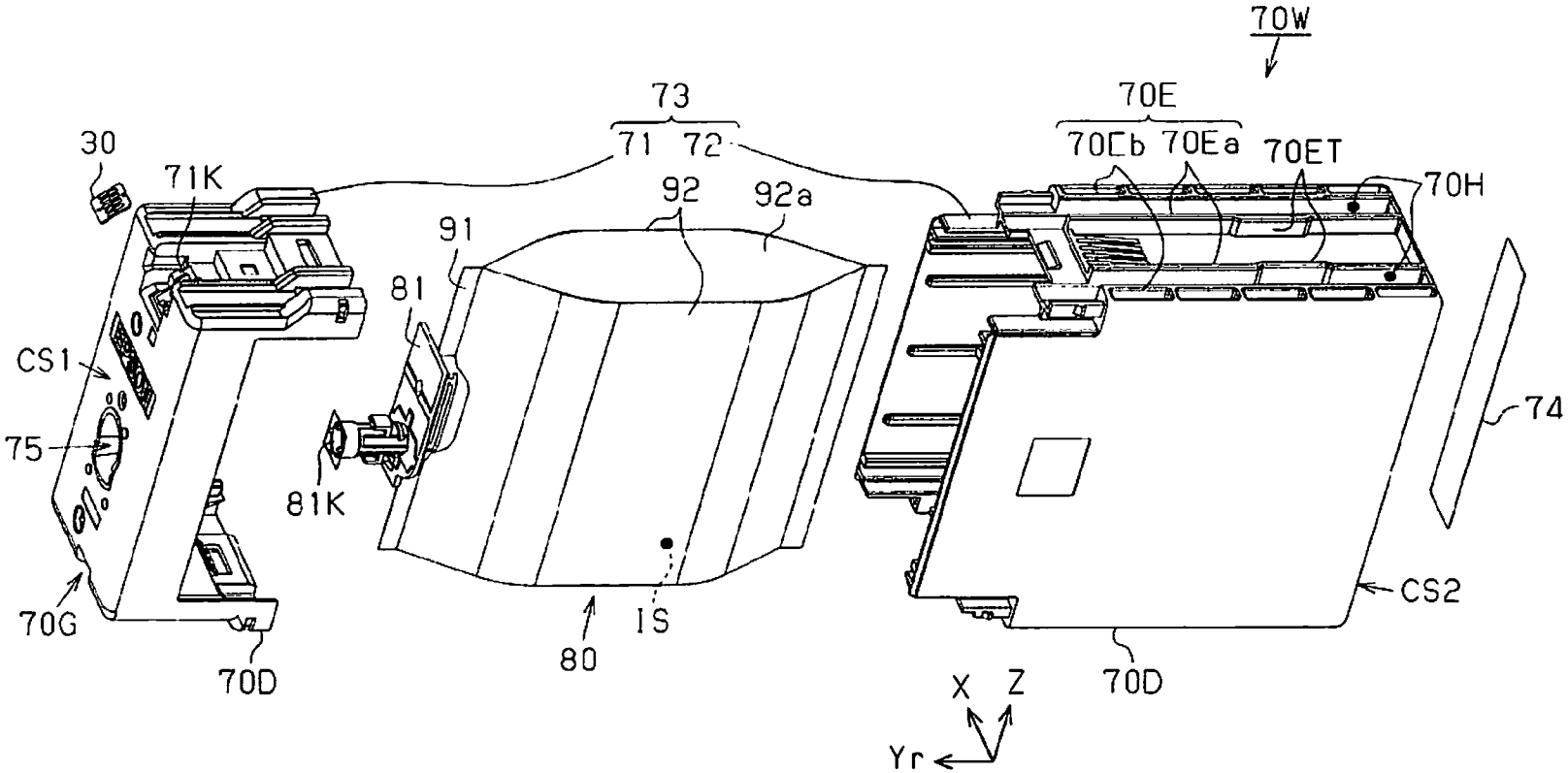
FIG. 13 is an exploded perspective diagram illustrating a configuration of an ink cartridge with a larger width.

As shown in FIG. 13, the ink vessel 80 which is the liquid containing vessel is contained in the ink cartridge 70W with a larger width in the same manner as in the ink cartridge 70 in the casing member 73 where the two members of the first casing member 71 on the insertion direction Yr side and the second casing member 72 on the opposite direction side to the insertion direction Yr are combined. The first casing member 71 and the second casing member 72 in the ink cartridge 70W are configured in the same manner as the first casing member 71 and the second casing member 72 in the ink cartridge 70 except for the respective widths being different. Then, out of the configuration of the ink vessel 80, the shape of the pack body 91 is configured to be different to the shape in the ink cartridge 70 to correspond to the width which is larger.

That is, in the pack body 91 which is formed in the ink vessel 80 of the ink cartridge 70W, the pack members 92 are a cylindrical shape with a matching portion 92*a*, which is folded in the up and down direction which intersects with the insertion direction Yr, which passes through in the insertion direction Yr. Then, after the pack members 92 with the cylindrical shape are formed in a bag shape by the opposite side to the insertion direction Yr side being fusing, the remaining opening side in the insertion direction Yr is joined by fusing with regard to the first supply member 81. Accordingly, the ink chamber IS is formed so that the pack bag 91 of the ink cartridge 70W has a relatively large volume by the matching portion 92*a* being extended in a state where ink is contained in the ink chamber IS. In addition, since the matching portion 92*a* shrinks to return to the state of being folded to accompany the reduction in volume of the ink chamber IS due to ink flowing out, there is a change in shape in the pack body 91 so as to reduce the gap between the pack members 92 which oppose each other in the scanning direction X.

<Configuration of Members in Ink Vessel>

Next, the configuration of the members in the ink vessel 80 will be described. Here, in the present embodiment, only the pack body 91 is different in the ink cartridge 70 and the ink cartridge 70W and the configuration of the other members is the same.

Figure 14A:
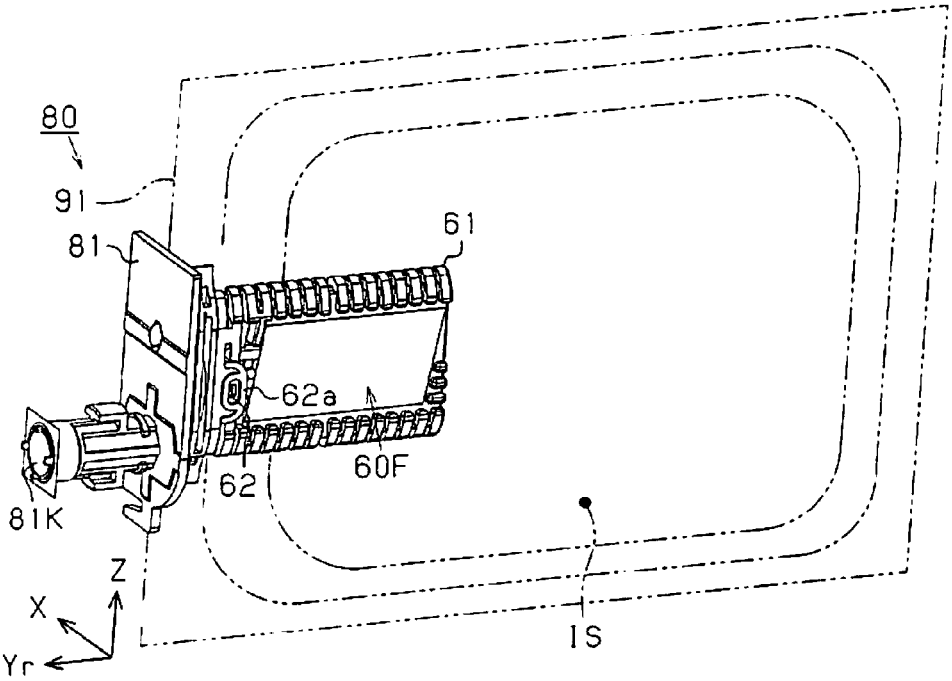
FIGS. 14A and 14B are diagrams illustrating an ink vessel which is provided inside an ink cartridge and FIGS. 14A and 14B are perspective diagrams of an ink vessel viewed in states which are the reverse of each other.
Figure 14B:
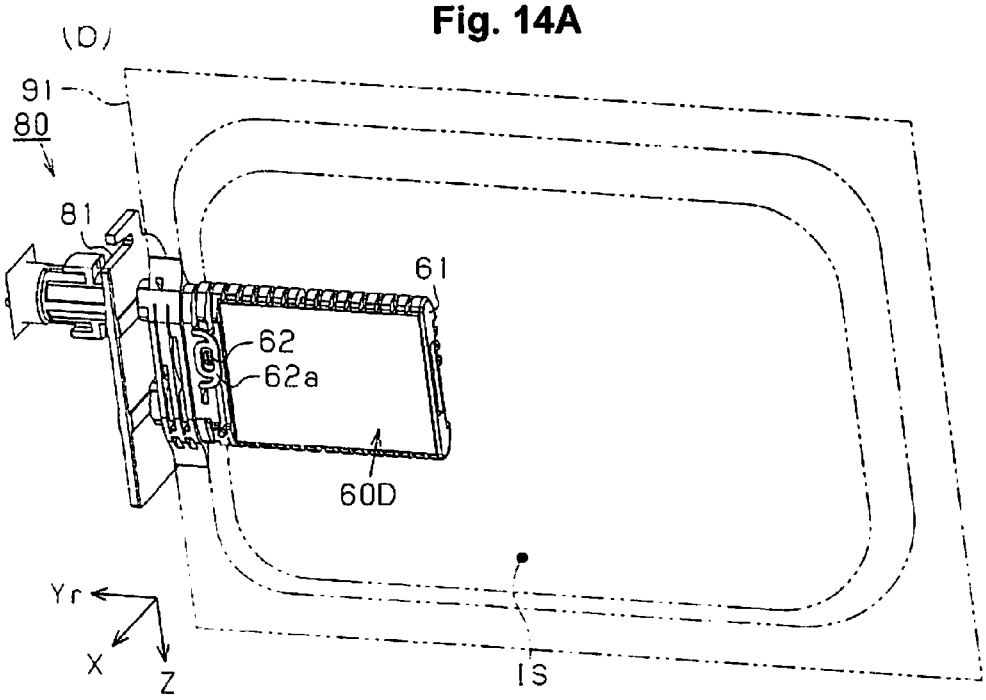

As shown in FIGS. 14A and 14B, the ink vessel 80 is provided with a filter chamber 60F and a low pressure chamber 60D in the ink chamber IS which is a space for containing ink which is formed with the first supply member 81 where the liquid supply opening 81K is formed and the pack body 91 which is joined to the first supply member 81. In the present embodiment, the filter chamber 60F and the low pressure chamber 60D are formed in a second supply member 61 which is configured to be able to be connected with the first supply member 81 and are provided to be arranged at positions which overlap when viewed from a direction which is the scanning direction X when mounted in the mounting section 20, that is, positions with a front and back relationship to each other.

An injection opening 62 where ink is injected in the ink chamber IS and an annular rib 62*a* which surrounds the injection opening 62 are provided in the second supply member 61. After injecting of ink, the injection opening 62 is blocked off so that communication with the ink chamber IS is impeded by the pack body 91 (the pack members 92) being joined (fused) with the annular rib 62*a*.

Next, the first supply member 81 and the second supply member 61 will be described with reference to the drawings. Here the drawings which are referenced are shown with the pack body 91 being omitted.

Figure 15A:
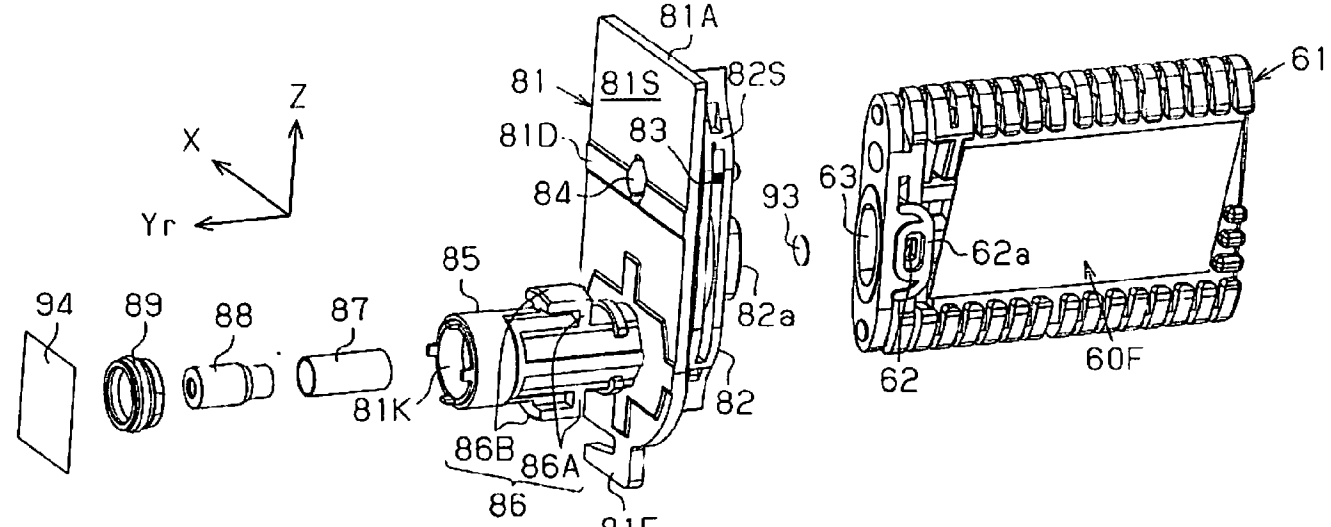
FIGS. 15A and 15B are exploded diagrams illustrating a configuration of an ink vessel and FIGS. 15A and 15B are perspective diagrams viewed from the same respective directions as FIGS. 14A and 14B.
Figure 15B:
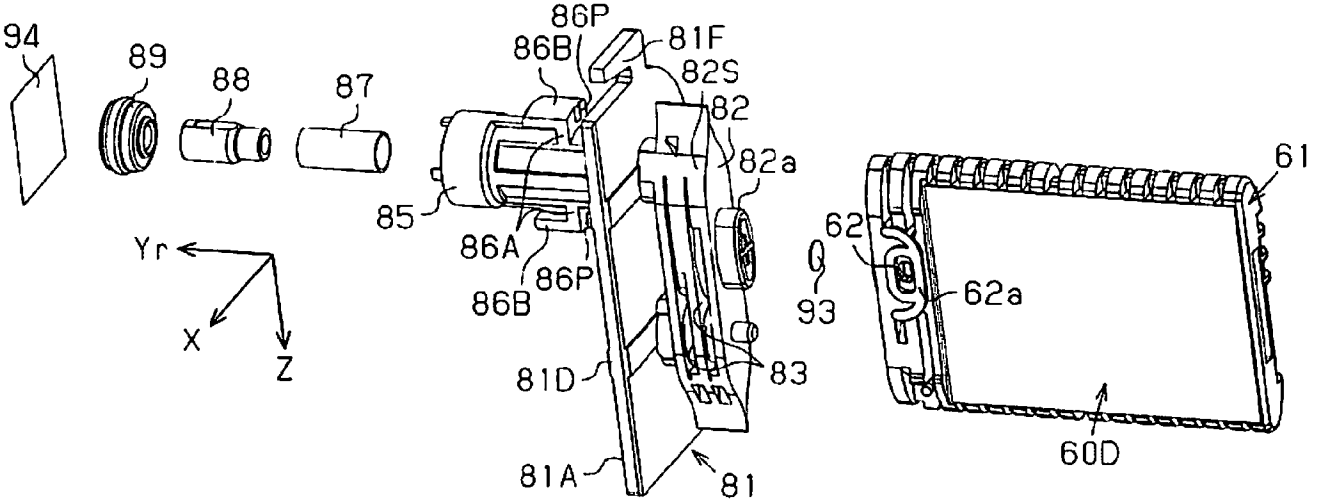

As shown in FIGS. 15A and 15B, the first supply member 81 has a connecting section 82*a* where the cross section is an oval pillar shape and the second supply member 61 has a connected section 63 where the cross section is a hole with an oval shape. The first supply member 81 and the second supply member 61 are connected by the connecting section 82*a* being inserted with regard to the connected section 63 after being inserted in a valve 93 (a check valve). Here, in the present embodiment, the first supply member 81 and the second supply member 61 are connected by the connecting section 82*a* and the connected section 83 so as to be able to be attached and detached.

The portion where the connecting section 82*a* is formed in the first supply member 81 is a long boat shape in one direction where the boat shape is formed at both ends in the longitudinal direction viewed from the insertion direction Yr. The side surface of the boat shape is a joining surface 82S where the pack body 91 is joined by fusing or the like. Accordingly, a portion of the boat shape is a joining section 82 of the pack body 91. Here, the longitudinal direction of the joining section 82 is a direction along the vertical direction when mounted in the mounting section 20.

In addition, a main body 81A with substantially a rectangular plate shape, where the insertion direction Yr is a plate thickness direction and the longitudinal direction is in the same direction as the longitudinal direction of the joining section 82, is formed in the first supply member 81 on the insertion direction Yr side of the joining section 82 toward the mounting section 20. In the present embodiment, the main body 81A is formed in an asymmetrical manner when viewed from the insertion direction Yr. In detail, one end in the longitudinal direction is rectangular while the other end in the longitudinal direction is formed as substantially an L shape section 81F with an L shape.

A cylindrical flow path section 85, where the liquid supply opening 81K is formed at the front end, is provided in the main body 81A in the first supply member 81. The cylindrical flow path section 85 is provided to protrude toward the insertion direction Yr side which is the plate thickness direction of the main body 81A at a position which is closer to the other end side where the L shape section 81F is formed. An engaged section 86, which is able to be engaged with the first casing member 71 when fixed in the first casing member 71 and which regulates movement in the opposite direction to the insertion direction Yr when engaged with, is provided in the cylindrical flow path section 85. The engaged section 86 is formed in the cylindrical flow path section 85 on both sides in a direction along the longitudinal direction of the main body 81A. The engaged section 86 is configured by a first engaged section 86A, which protrudes to have a plate shape which is substantially parallel to the main body 81A, and a second engaged section 86B which is provided from the front end of the first engaged section 86A toward the insertion direction Yr side so as to be substantially at right angles with the first engaged section 86A. Here, a circular pillar 86P is provided in the first engaged section 86A to slightly protrude so as to form a circular pillar side surface on the upper surface of the body on the main body 81A side.

In addition, a supply opening spring 87, a supply opening spring seat 88, and a supply opening rubber seal 89 are inserted in this order in the cylindrical flow path section 85 from the liquid supply opening 81K side which is formed at the front end of the cylindrical flow path section 85, and last of all, a supply opening film 94 is joined to the front end of the cylindrical flow path section 85 by fusing or the like. The liquid supply opening 81K is in a state of being sealed due to being joined with the supply opening film 94. Then, here, although omitted from the drawings, due to the supply needle 29 being inserted with regard to the liquid supply opening 81K which is formed at the front end of the cylindrical flow path section 85, the seal of the supply opening film 94 is broken and the supply opening spring seat 88, which blocks off the ink flow path by abutting with the supply opening rubber seal 89, is pushed so as to separate from the supply opening rubber seal 89. As a result, a gap is formed so that a flow of ink is possible in the liquid supply opening 81K and ink flows in with regard to the supply needle 29 from the gap which is formed.

On the other hand, the second supply member 61 which is connected with regard to the joining section 82 of the first supply member 81 has substantially a rectangular cube shape where the outer shape is long in the insertion direction Yr. The shape of the first supply member 81 on the connecting side is an oval shape where the longitudinal direction is the same direction as the longitudinal direction of the boat shape of the joining section 82 and both ends in the longitudinal direction are a semicircular shape or a semielliptical shape. Then, the oval shape of the second supply member 61 on the connecting side is a shape which fits into the boat shape of the joining section 82 when viewed from the insertion direction Yr.

Figure 16A:
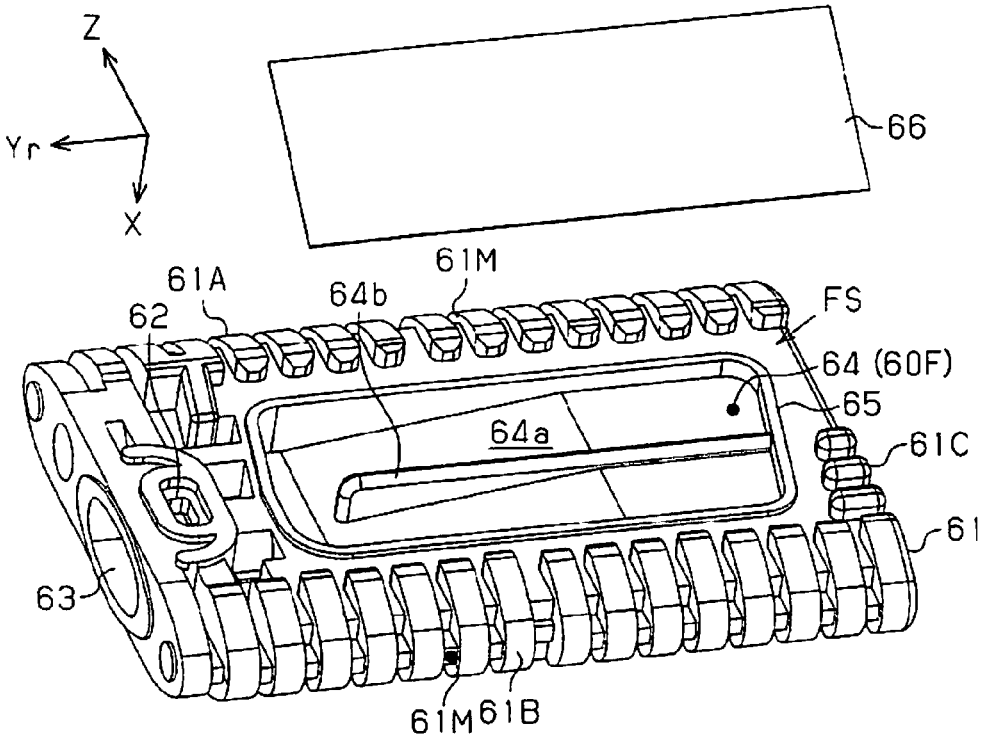
FIG. 16A is an exploded perspective diagram illustrating a configuration of a filter chamber inside an ink vessel and FIG. 16B is an exploded perspective diagram illustrating a configuration of a low pressure chamber inside an ink vessel.
Figure 16B:
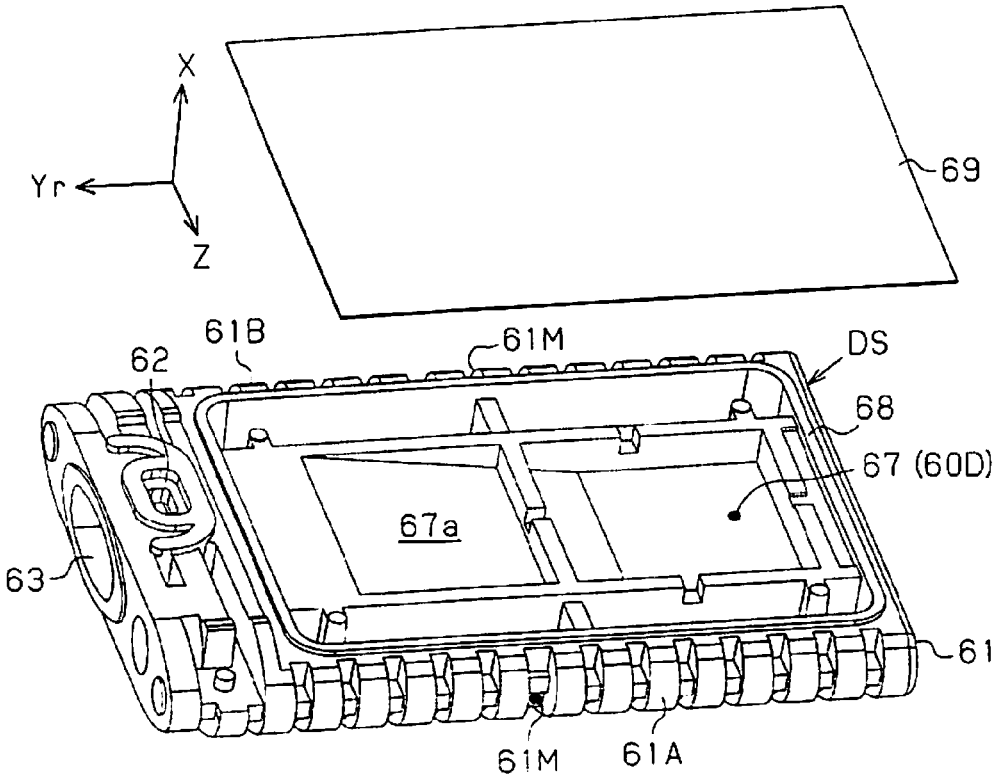

As shown in FIGS. 16A and 16B, out of the two flat surface where the area, which is positioned to oppose both sides in the scanning direction X, is maximized in the rectangular cube shape of the second supply member 61, the filter chamber 60F is formed on a first flat surface FS side and the low pressure chamber 60D is formed on a second flat surface DS. Then, in the present embodiment, at least a portion of the second supply member 61 is a shared member which forms the filter chamber 60F and the low pressure chamber 60D.

The filter chamber 60F is configured as shown in FIG. 16A. That is, a first concave region 64, which has a first opening section 65 with substantially a parallelogram shape which is long in the insertion direction Yr and short in a direction which intersects with the insertion direction Yr, is provided in the second supply member 61 on the first flat surface FS side. Then, an inclined surface 64*a*, which is inclined toward the connected section 63 side which is connected with the connecting section 82*a*, is provided in the bottom surface of the first concave region 64. The inclined surface 64*a* is inclined so that the bottom surface of the connected section 63 is positioned more to the X direction side than the bottom surface on the first opening section 65 side. Furthermore, a filter 66, where it is possible for ink to permeate and permeating of foreign matter is suppressed, has an outer shape which is substantially a parallelogram shape with the insertion direction Yr as the long side. The filter chamber 60F is formed due to the filter 66 being attached to the second supply member 61 so that the first opening section 65 in the first concave region 64 is blocked off. That is, the filter chamber 60F is configured on the first flat surface FS side of the second supply member 61 due to the first concave region 64 functioning as a liquid inflow region where it is possible for ink to flow in through the first opening section 65 by passing through the filter 66.

In the present embodiment, a rib 64*b* is provided along the insertion direction Yr in the first concave region 64 which becomes the filter chamber 60F. The rib 64*b* functions as an abutting section which abuts with the filter 66 in a case where the filter 66 changes shape toward the inner side of the filter chamber 60F and it is possible to suppress the filter 66 from changing shape.

In addition, in the present embodiment, the filter 66 is formed by cutting a sheet, where fibers are weaved into a base material, and is designed so that the cut surface is inclined with regard to the weave direction of the fibers in the base material due to the outer shape being a parallelogram shape so that the weaved fibers in the base material do not unravel.

The low pressure chamber 60D is configured as shown in FIG. 16B. That is, a second concave region 67, which has a second opening section 68 with substantially a rectangular shape which is long in the insertion direction Yr and short in a direction which intersects with the insertion direction Yr, is provided in the second supply member 61 on the second flat surface DS side. An inclined surface 67*a* is provided in the second concave region 67 at a position which substantially overlaps with the inclined surface 64*a* of the first concave region 64 when viewed from the scanning direction. The inclined surface 67*a* is inclined so that the bottom surface on the opposite direction side to the insertion direction Yr is separated from the second opening section 68 more than the bottom surface on the connected section 63 side.

In addition, in the present embodiment, the second concave region 67 is formed so that the projection area, where the scanning direction X is the projection direction, is maximized. The first concave region 64 which functions as the filter chamber 60F is formed so as to be positioned inside the second concave region 67 when viewed from the projection direction, that is, the scanning direction X.

Then, the second concave region 67 is a tightly sealed space and a low pressure space with a pressure which is lower than atmospheric pressure due to a film 69 being adhered to the second supply member 61 in a low pressure environment so that the second opening section 68 is blocked off. The film 69 is a film which has the properties where it is possible for gas which is dissolved in the ink or bubbles which are generated in the ink to pass through. Due to this, the second concave region 67 configures the low pressure chamber 60D inside the second supply member 61 on the second flat surface DS side of the second supply member 61 becoming the inside of the second supply member 61. Here, it is sufficient if the second concave region 67 is a low pressure space with a pressure which is lower than atmospheric pressure and it is not necessary for the second concave region 67 to be a tightly sealed space.

Additionally, as shown in FIGS. 16A and 16B, a plurality of convex sections 61A, 61B, and 61C are provided in the second supply member 61. In the present embodiment, the convex sections 61A and 61B are formed at both end sections of the second supply member 61 in the latitudinal direction (the vertical direction Z) which intersects with the insertion direction Yr so as to interpose the filter 66. The shape is a convex section which extends along the latitudinal direction of the second supply member 61. The convex section is a semicircular shape or a semielliptical shape when viewed from the insertion direction Yr. That is, the convex sections 61A and 61B are formed in the second supply member 61 so that a plurality of portions, with substantially the same semicircular shape or semielliptical shape as the oval shape of the connecting side of the first supply member 81, extend to line up along the insertion direction Yr. Then, gaps are formed between the convex sections of each of the convex sections 61A, 61B, and 61C and the gaps between each of the convex sections of the convex sections 61A and 61B are provided as grooves 61M which reach from the film 69 in the low pressure chamber 60D to the filter 66 in the filter chamber 60F.

Accordingly, the grooves 61M, which are provided, for example, between the convex sections in each of the convex sections 61A and 61B, are formed as gaps where it is possible for ink to pass through in a case where the pack members 92 come into contact with the convex sections 61A, 61B, and 61C due to the pack body 61 changing shape so as to reduce the gap between the pack members 92 which oppose each other in the scanning direction X. Accordingly, it is possible for ink in the ink chamber IS to flow into the filter 66 through the grooves 61M.

Figures 17A, 17B, 17C:
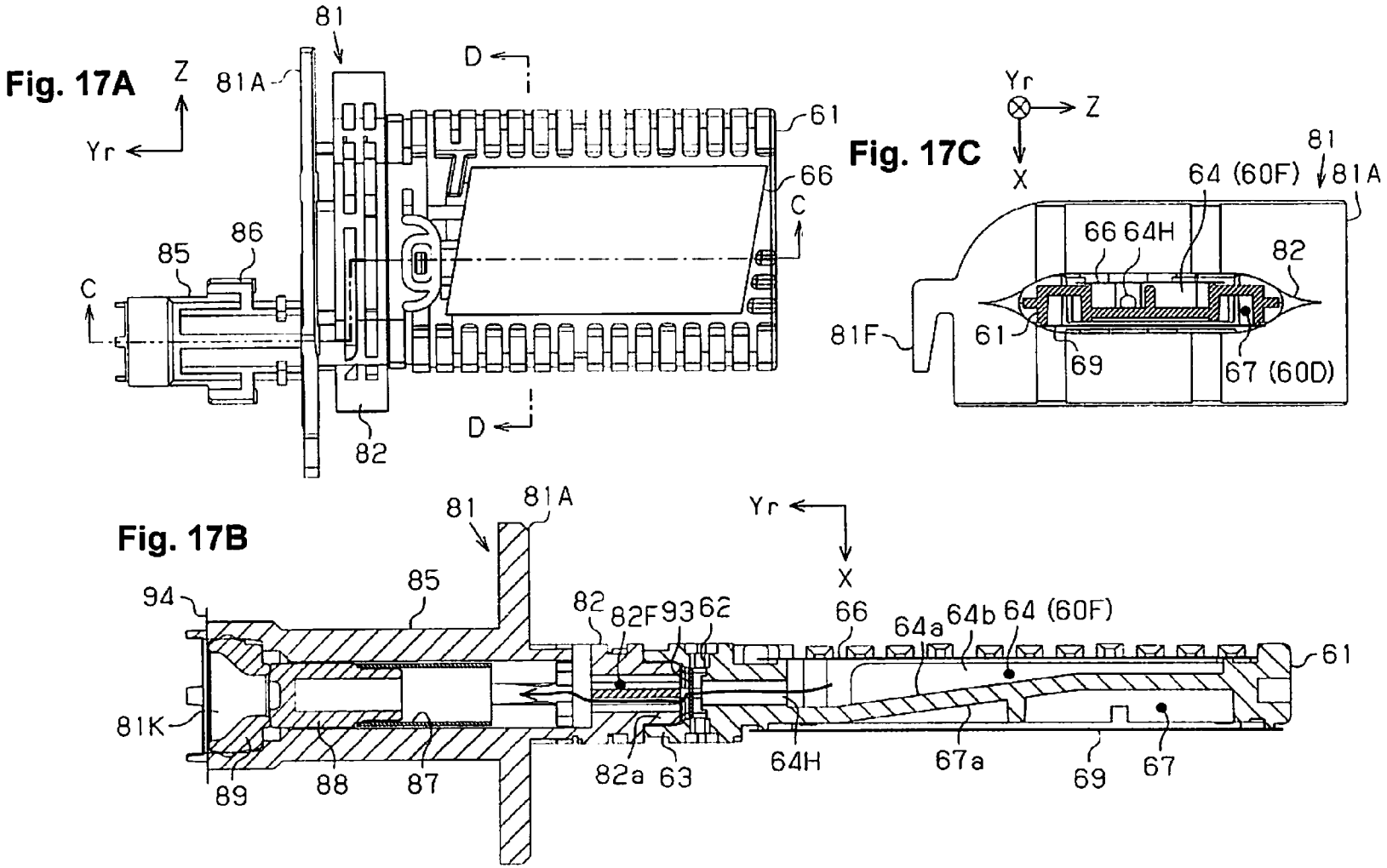
FIGS. 17A to 17C are diagrams illustrating a configuration of a filter chamber and a low pressure chamber.
Figure 18A:
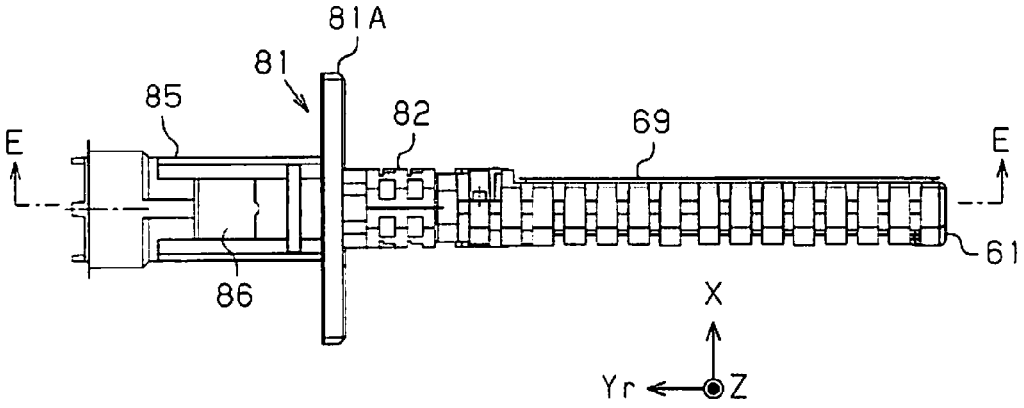
FIGS. 18A and 18B are diagrams illustrating an ink flow path which is provided in a first supply member.
Figure 18B:
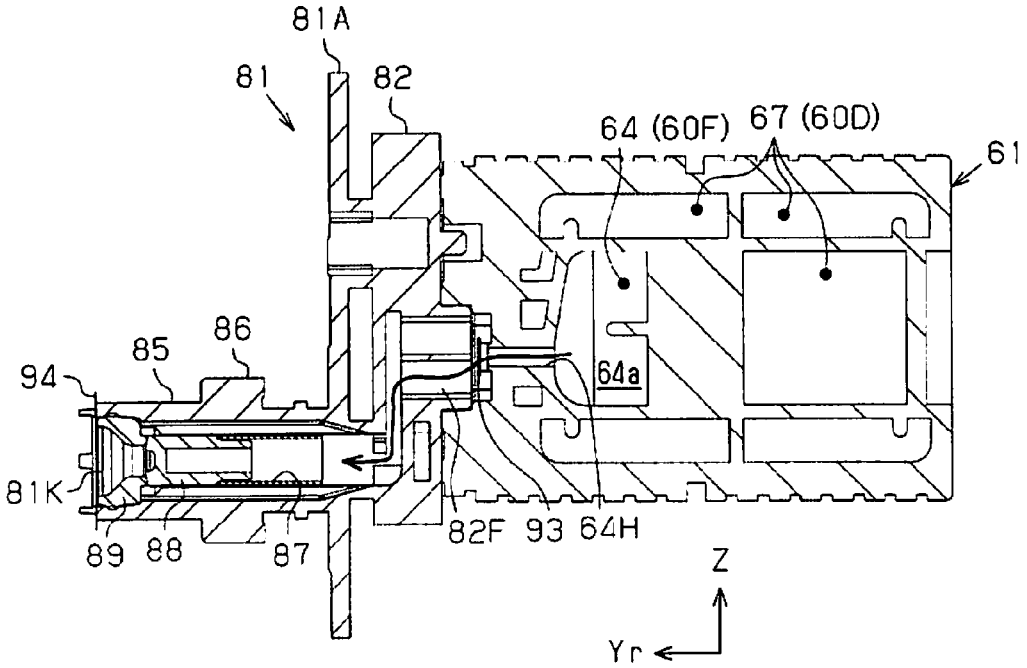

In addition, as shown in FIGS. 17B and 17C and FIG. 18B, the filter chamber 60F is provided to be arranged so as to surround the low pressure chamber 60D due to the configuration where the filter chamber 60F and the low pressure chamber 60D are respectively formed on the first flat surface FS side and the second flat surface DS side which are both sides of the second supply member 61. That is, the filter chamber 60F overlaps with the low pressure chamber 60D in the scanning direction X and is provided at both sides in the vertical direction at positions which interpose the low pressure chamber 60D. In this manner, the second supply member 61 is configured so that it is possible to form the low pressure chamber 60D at a position where it is possible for the proportion of gas which is dissolved in the ink in the filter chamber 60F to be reduced.

In addition, as shown in FIG. 16A and FIGS. 17A, 17B, and 17C, the inclined surface 64*a*, which is inclined so that the bottom surface of the connected section 63 is positioned more to the X direction side than the bottom surface on the first opening section 65 side, is formed in the filter chamber 60F. Then, an ink outflow opening 64H where ink flows out is provided in the first concave region 64 on the first supply member 81 side. Accordingly, a flow path is formed in the filter chamber 60F for ink which flows to the first supply member 81 side. In addition, the cross sectional area of the flow path at a first position on the downstream side which is close to the first supply member 81 is larger than the cross sectional area of the flow path at a second position on the upstream side which is further from the first supply member 81 than the first position. Due to this flow path, it is possible for ink which flows into the filter chamber 60F to flow out from the liquid supply opening 81K in a state where loss of pressure is suppressed from becoming high, that is, in a state where the flow speed is suppressed from being high.

In this manner, ink which is contained in the ink chamber IS, where the filter chamber 60F and the low pressure chamber 60D which configure the second supply member 61 are provided, flows to the liquid supply opening 81K through the ink outflow opening 64H in the filter chamber 60F. Then, ink, which flows to the liquid supply opening 81K, flows out to the supply needle 29 side, and after this, is supplied to the liquid ejecting head 18.

That is, as shown by the solid arrow lines in FIG. 17B and FIG. 18B, ink which flows in from the ink chamber IS into the filter chamber 60F flows through a relay flow path 82F which is formed in the joining section 82 by passing through the valve 93 after flowing into the ink outflow opening 64H and flows into the cylindrical flow path section 85 which communicates with the relay flow path 82F. In this manner, ink in the ink chamber IS is led to the liquid supply opening 81K through the filter 66. Here, the valve 93 functions as a check valve which permits the flow of ink from the ink chamber IS side to the liquid supply opening 81K side and regulates the reverse flow of ink from the liquid supply opening 81K side to the ink chamber IS side.

As shown in FIGS. 15A and 15B and FIGS. 19A and 19B, a plurality of grooves are formed in the joining section 82, which is joined with the pack body 91 by fusing or the like, along the longitudinal direction in a side surface of the boat shape which is the joining surface 82S. A space 83 is provided due to the plurality of grooves in a state where the pack body 91 is joined (fused) to the joining surface 82S. The space 83 is configured to communicate with air which is an example of a noncontaining space (other than the ink chamber IS) where ink is not contained (no communication with the ink chamber IS).

Figure 19B:
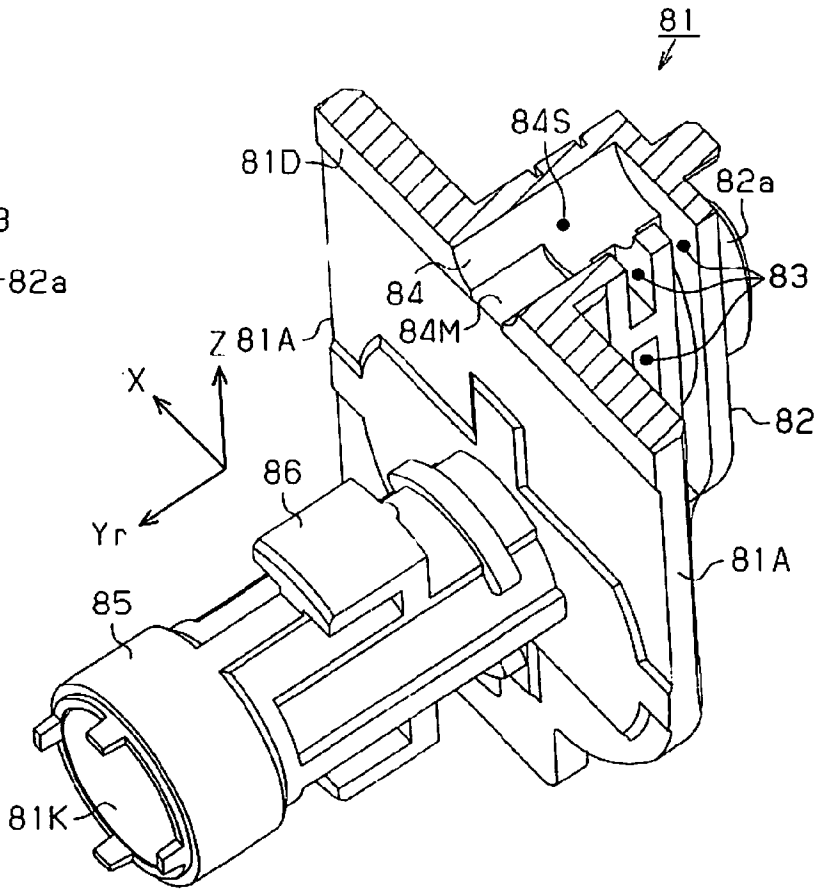
FIG. 19A is a perspective diagram illustrating a first supply member and FIG. 19B is a cross sectional perspective diagram where a first supply member is cut at a position which intersects with a communication opening.
Figure 19A:
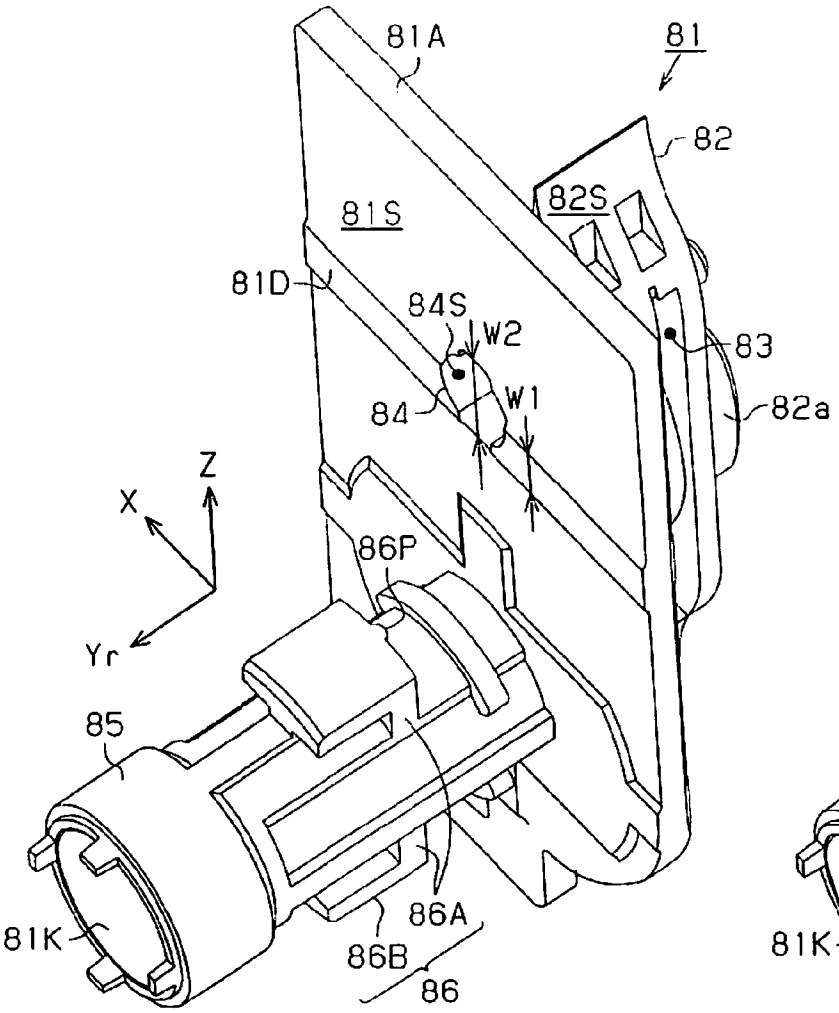

That is, as shown in FIGS. 19A and 19B, in the present embodiment, a space 84S with a cylindrical shape, where an communication opening 84 which communicates with air is formed, is provided in the first supply member 81 in the main body 81A in a main body upper surface 81S with a plate shape on the opposite side to the joining section 82, and the space 84S with the cylindrical shape communicates with the space 83. Accordingly, the space 83 is formed as a space where the communication opening 84 communicates with air through the space 84S with the cylindrical shape.

In addition, in the present embodiment, a side wall groove 84M with a designated width and depth is formed on the communication opening 84 side of the cylindrical side surface in the space 84S with the cylindrical shape on both sides along the longitudinal direction of the base 81A. As a result, the shape of the communication opening 84 is a polygon shape which changes shape from a circular shape as an arc in an opposing portion bulges to the outside. Furthermore, a stepped section 81D, where at least a portion forms the edge of the communication opening 84, is provided in the main body upper surface 81S in the first supply member 81. In the present embodiment, the stepped section 81D protrudes outwards from the main body upper surface 81S to the opposite side to the joining section 82 and is formed in a direction along a latitudinal portion of the main body 81A.

In addition, the stepped section 81D is positioned on the gravity direction side of the communication opening 84 and is formed in a direction along the scanning direction X in a state where the ink cartridge 70 (70W) is mounted, that is, in a state where the ink vessel 80 is mounted, in the mounting section 20 of the printer 11. Then, the width of the stepped section 81D along the vertical direction, that is, a width W1 of a convex section is formed as a width which is narrower than a width W2 of the communication opening 84 along the vertical direction.

In the same manner, the communication opening 84 is positioned more to the Z side, which is the opposite direction to the gravity direction, than the liquid supply opening 81K in a state where the ink cartridge 70 (70W) is mounted, that is, in a state where the ink vessel 80 is mounted, in the mounting section 20 of the printer 11. In addition, the communication opening 84, which is formed in the main body 81A on the opposite side to the joining section 82, is positioned in the first supply member 81 on the insertion direction Yr side toward the mounting section 20.

Next, actions according to the configuration of the present invention will be described in order of actions of the ink vessel 80, actions of assembling the ink cartridges 70 and 70W, and actions of mounting the ink cartridges 70 and 70W in the mounting section 20.

<Actions of Ink Vessel>

Due to the space 83, which communicates with air which is an example of a space (other than in the ink chamber IS) where ink is not contained, being provided in the joining section 82 of the first supply member 81 as shown in FIG. 19A, it is possible for air to escape from the space 83 so that air is not trapped in a fusing surface when the pack body 91 is fused.

In addition, due to the shape of the communication opening 84 being a polygon shape and not circular, blocking off of the communication opening 84 due to, for example, a circular rod is easily suppressed. In addition, due to the stepped section 81D with a narrow width which is provided in the main body upper surface 81S of the main body 81A where the communication opening 84 is formed, at least one step is formed in the communication opening 84. Accordingly, blocking off of the communication opening 84 is suppressed using the step which is formed even in a case where, for example, the communication opening 84 is covered by a sheet member. Furthermore, since the communication opening 84 is positioned more to the Z side, which is the opposite direction to the gravity direction, than the liquid supply opening 81K, there is a low probability that ink which leaks out from the liquid supply opening 81K will flow into the communication opening 84. In addition, since the communication opening 84 is positioned in the first supply member 81 on the insertion direction Yr side toward the mounting section 20, there is a low probability that the communication opening 84 will be blocked off due to foreign matter which enters from the outside of the printer 11 in a state where the ink vessel 80 (the ink cartridge 70 (70W)) is mounted in the printer 11.

Figure 20B:
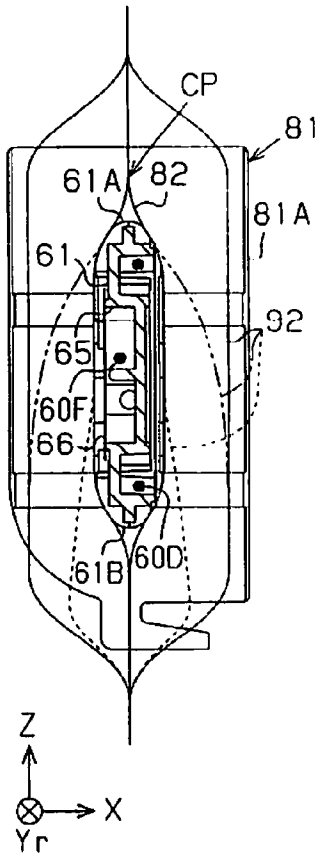
FIG. 20A is a side surface diagram illustrating an ink vessel and FIG. 20B is a cross sectional diagram along a line F-F in FIG. 20A.
Figure 20A:
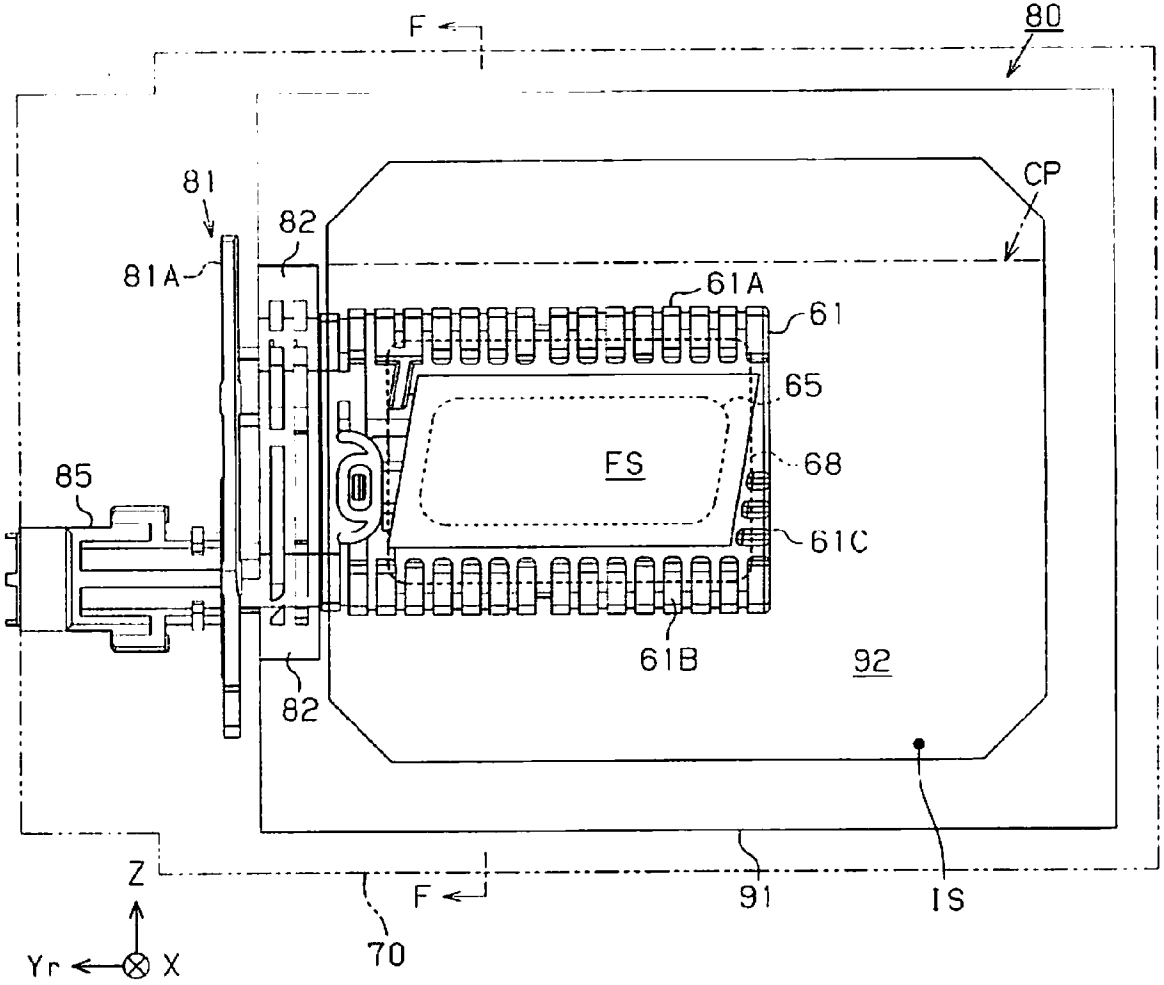

In addition, as shown in FIGS. 20A and 20B, the ink vessel 80 is such that the perpendicular direction of the first flat surface FS (and the second flat surface DS) in the second supply member 61 is in a direction (the scanning direction X) which intersects with the vertical direction in a state where the ink cartridge 70 (70W) is mounted in the mounting section 20. Then, the shape of the opening in the filter chamber 60F with substantially a parallelogram shape, where the filter 66 is adhered, is arranged in the ink chamber IS in a state of being longer in the insertion direction Yr and shorter in the vertical direction which is a direction which intersects with the insertion direction Yr as shown by the fine dashed line in FIG. 20A. Here, in order for description to be easier, only the outer contours of the pack body 91 (the pack members 92) are shown in FIGS. 20A and 20B.

Accordingly, when the amount of ink is reduced according to ink in the ink chamber IS flowing out from the liquid supply opening 81K, the pack body 91 changes shape in a state where most of the ink remains on the gravity direction side in the ink chamber IS due to the gap between the pack members 92 narrowing as shown by the two-dot chain line in FIG. 20B. That is, a contact position CP, where the pack members 92 come into contact with each other, gradually moves from the Z side which is the opposite direction to the gravity direction to the gravity direction side as shown by the one-dot chain line in FIG. 20A.

The first opening section 65 which is the inflow region of ink into the filter chamber 60F is longer on the insertion direction Yr side which intersects with the vertical direction than in the vertical direction. Accordingly, it is possible for a large amount of ink to flow out until the first opening section 65 is covered by the pack body 91 (the pack members 92) which changes shape (so that the contact position CP moves in the gravity direction) to accompany the reduction in the amount of ink compared to a case where the first opening section 65 is longer in the vertical direction. In addition, it is possible for ink in the ink chamber IS to flow in from the low pressure chamber 60D side to the filter chamber 60F side through the gap which is provided between the convex sections 61A in a case where the pack members 92 come into contact with a plurality of the convex sections 61A at the contact position CP.

In addition, in the present embodiment, since the second supply member 61 is formed to be longer in a direction which intersects with the vertical direction according to the shape of the first opening section 65, it is possible for the second supply member 61 to be arranged toward the gravity direction side in the ink chamber IS although description of this is omitted in the drawings. As a result, it is possible for a large amount of ink to flow out until first opening section 65 is covered by the pack body 91 (the pack members 92) which changes shape along with ink flowing out from the ink chamber IS.

In addition, the pack body 91, which changes shape as more ink flows out so that the gap between the pack members 92 further narrows as shown by the dashed line in FIG. 20B, comes into contact with the first flat surface FS of the second supply member 61. In this contacting state, it is possible for ink which is positioned in the ink chamber IS on the gravity direction side to flow into the filter chamber 60F through the gap which is provided between the convex sections 61B and 61C in a case where the pack members 92 come into contact with the convex sections 61B and 61C in addition to the plurality of convex sections 61A.

In addition, as shown by a thick dashed line and a thin dashed line in FIG. 20A, the first opening section 65 in the filter chamber 60F is arranged so as to overlap to be inside the second opening section 68 in the low pressure chamber 60D when viewed from the +X direction side. As a result, in a case where gas is dissolved in ink which flows in the filter chamber 60F, it is easy for the dissolved gas to move to the low pressure chamber 60D through a member portion of the second supply member 61 which exists between the filter chamber 60F and the low pressure chamber 60D, that is, the shared member portion which forms the filter chamber 60F and the low pressure chamber 60D. It is obvious that, in this case, the second supply member 61 is formed so that at least the shared member portion is a resin material where gas permeability is high.

<Actions of Assembling Ink Cartridges>

As shown in FIGS. 21A, 21B, and 21C and FIGS. 22A, 22B, and 22C, the ink cartridge 70 (70W) is supported in a state where the ink vessel 80 is attached with regard to the first casing member 71 before the ink cartridge 70 (70W) is assembled by combining the first casing member 71 and the second casing member 72.

Figure 21C:
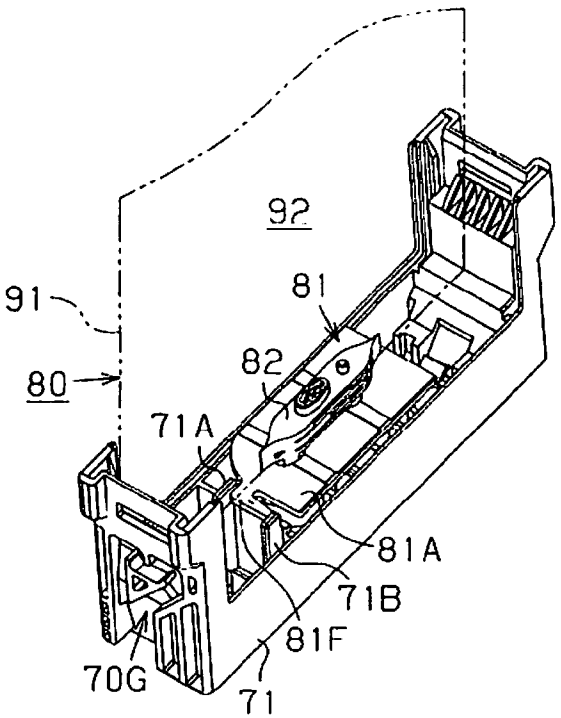
FIGS. 21A to 21C are perspective diagrams illustrating a first supply member which is supported by a casing member of an ink cartridge.
Figure 21B:
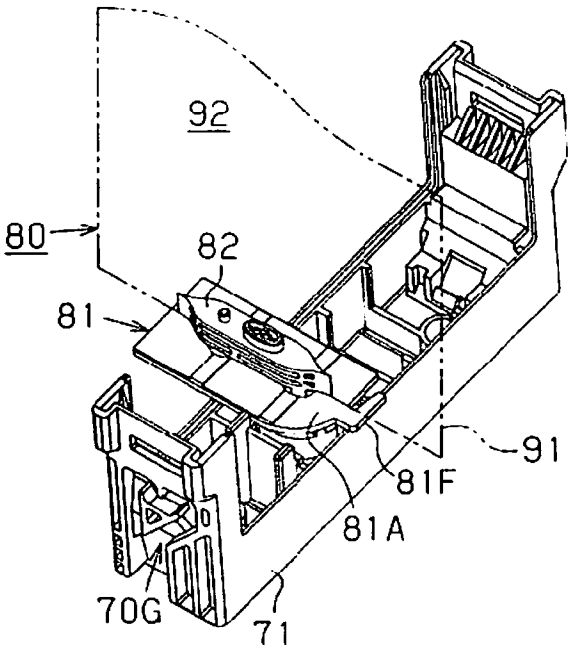
Figure 21A:
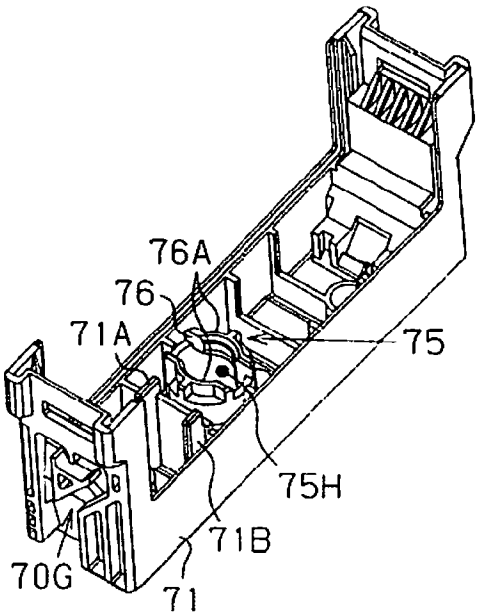
Figure 22C:
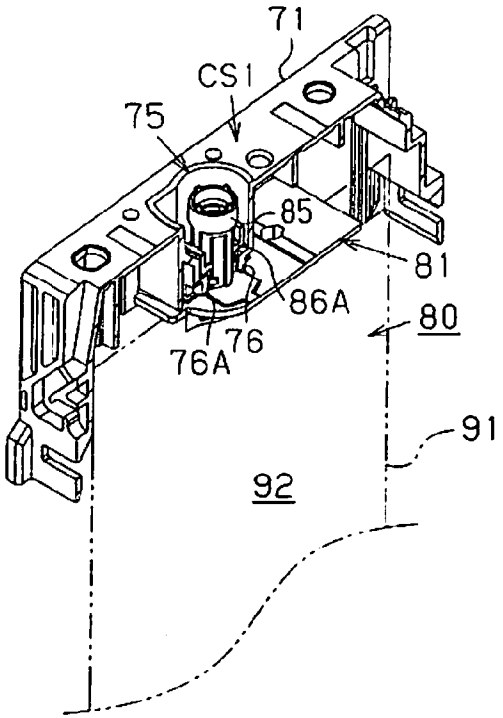
FIG. 22C is a diagram of a state where a first supply member is rotated after insertion.
Figure 22B:
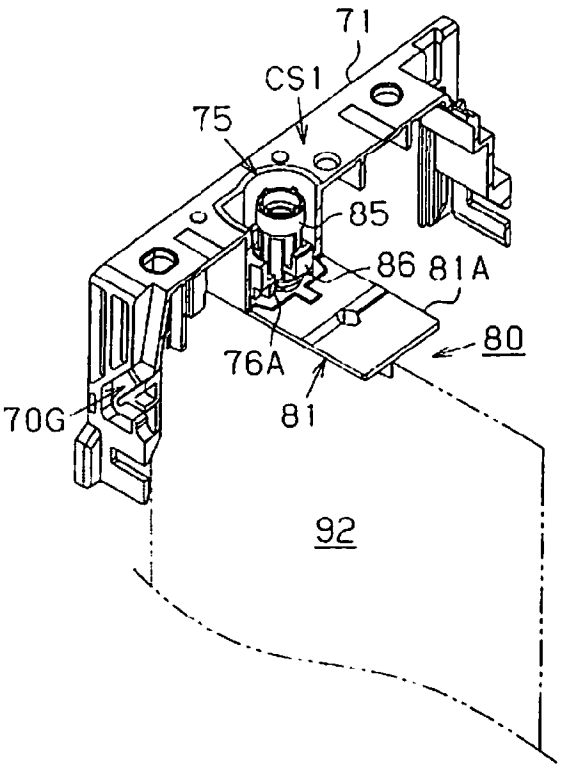
Figure 22A:
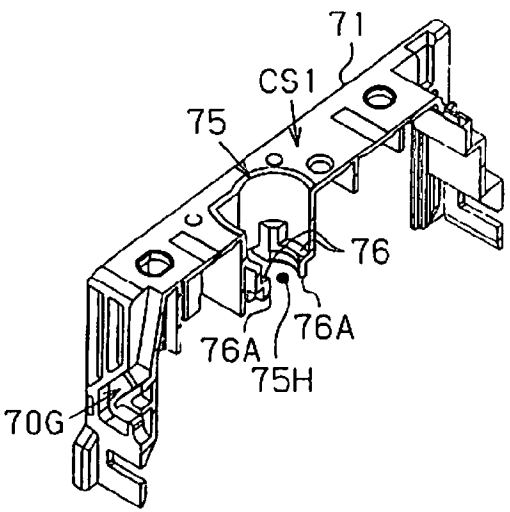

First, as shown in FIG. 21A and FIG. 22A, the through hole forming section 75, which is formed with the through hole 75H where inserting of the cylindrical flow path section 85, which is provided in the first supply member 81, along with the engaged section 86 is possible, are provided in the first casing member 71. The through hole forming section 75 has a concave shape which is recessed from the first surface CS1, and the through hole 75H is formed in the concave shape in a wall surface which is formed in a direction along the first surface CS1. Then, a side wall 76 is provided at a bottom wall around the through hole 75H which is formed, and an abutting section 76A, which abuts with the main body 81A of the first supply member 81 which is inserted, is provided in the side wall 76 on the opposite side to the first surface CS1 side which is the side where the first supply member 81 (the cylindrical flow path section 85) is inserted.

Next, as shown in FIG. 21B and FIG. 22B, the cylindrical flow path section 85, which is provided in the first supply member 81, is inserted along with the engaged section 86 with regard to the through hole forming section 75 of the first casing member 71 through the through hole 75H. That is, the through hole 75 is an opening with a shape where it is possible for the cylindrical flow path section 85 and the engaged section 86 to pass through. During inserting, the insertion posturing of the ink vessel 80 is so that a direction which intersects with regard to the longitudinal direction of the first casing member 71 is the longitudinal direction of the joining section 82. That is, in the present embodiment, this direction is at 90 degrees with regard to the longitudinal direction of the first casing member 71. Then, at this time, it is possible for the user to easily identify the insertion posturing using the main body 81A which is formed in an asymmetrical manner.

In addition, the first engaged section 86A in the engaged section 86 and the support member 76 in the through hole forming section 75 are provided at positions which do not overlap when viewed from a direction which intersects (here, is orthogonal) with the insertion direction in a state where the first supply member 81 is inserted until the main body 81A abuts with the abutting section 76A in the first casing member 71.

Next, as shown in FIG. 21C and FIG. 22C, in a state of abutting with the abutting section 76A, the first supply member 81, where the cylindrical flow path section 85 is inserted with regard to the through hole 75H in the first casing member 71 (the through hole forming section 75), is rotated centered on the cylindrical flow path section 85 with the insertion direction as the axis direction. In the present embodiment, the first supply member 81 is rotated by 90 degrees in the clockwise direction when viewed from the front side in the insertion direction for the cylindrical flow path section 85. Due to the rotating, the pack body 91 is so that the extending direction of the pack members 92 is a direction along the longitudinal direction of the first casing member 71, and the first engaged section 86A is moved to an engaging position which overlaps with the side wall 76 when viewed from the insertion direction. As a result, movement of the cylindrical flow path section 85 of the ink vessel 80 in the insertion direction and the opposite direction to the insertion direction in the through hole forming section 75 is regulated due to engaging of the first engaged section 86A and the side wall 76. Due to this, movement of the ink vessel 80 along the insertion direction is restricted and the ink vessel 80 is supported by being attached to the first casing member 71. Here, in the present embodiment, in a state where the ink vessel 80 is attached to the first casing member 71, the first engaged section 86A in the cylindrical flow path section 85 is engaged with the side wall 76 in the through hole forming section 75 in a state where there are no gaps in the insertion direction using the circular pillar 86P which protrudes to the main body 81A side. With this point, the side wall 76 functions as an engaging section which engages with regard to the first supply member 81 so that movement of the first supply member 81 in the opposite direction to the insertion direction is regulated.

Furthermore, as shown in FIG. 21C, a fastening section, which regulates rotating of the cylindrical flow path section 85 is provided in a state where the ink vessel 80 is attached to the first casing member 71. The fastening section regulates rotating in a state where the first engaged section 86A in the cylindrical flow path section 85 is engaged with the side wall 76 due to being fastened with the first supply member 81. In detail, a first protuberance section 71A and a second protuberance section 71B, which protrude to the first supply member 81 side which is attached, are provided in the first casing member 71 as the fastening section in the rotation trajectory of the L shape section 81F which is provided in the first supply member 81 which is rotated in a clockwise direction.

The first protuberance section 71A functions as the fastening section which fastens with the first supply member 81 on the rotation direction side by abutting with the rotation direction side of the L shape section 81F which is moved in the rotation direction side when the ink vessel 80 is attached to the first casing member 71. On the other hand, the second protuberance section 71B functions as the fastening section which fastens with the first supply member 81 in opposite direction to the rotation direction by abutting with the L shape section 81F in the opposite direction side to the rotation direction side when the ink vessel 80 is attached to the first casing member 71. In addition, the L shape section 81F functions as a fastened section.

Figure 23:
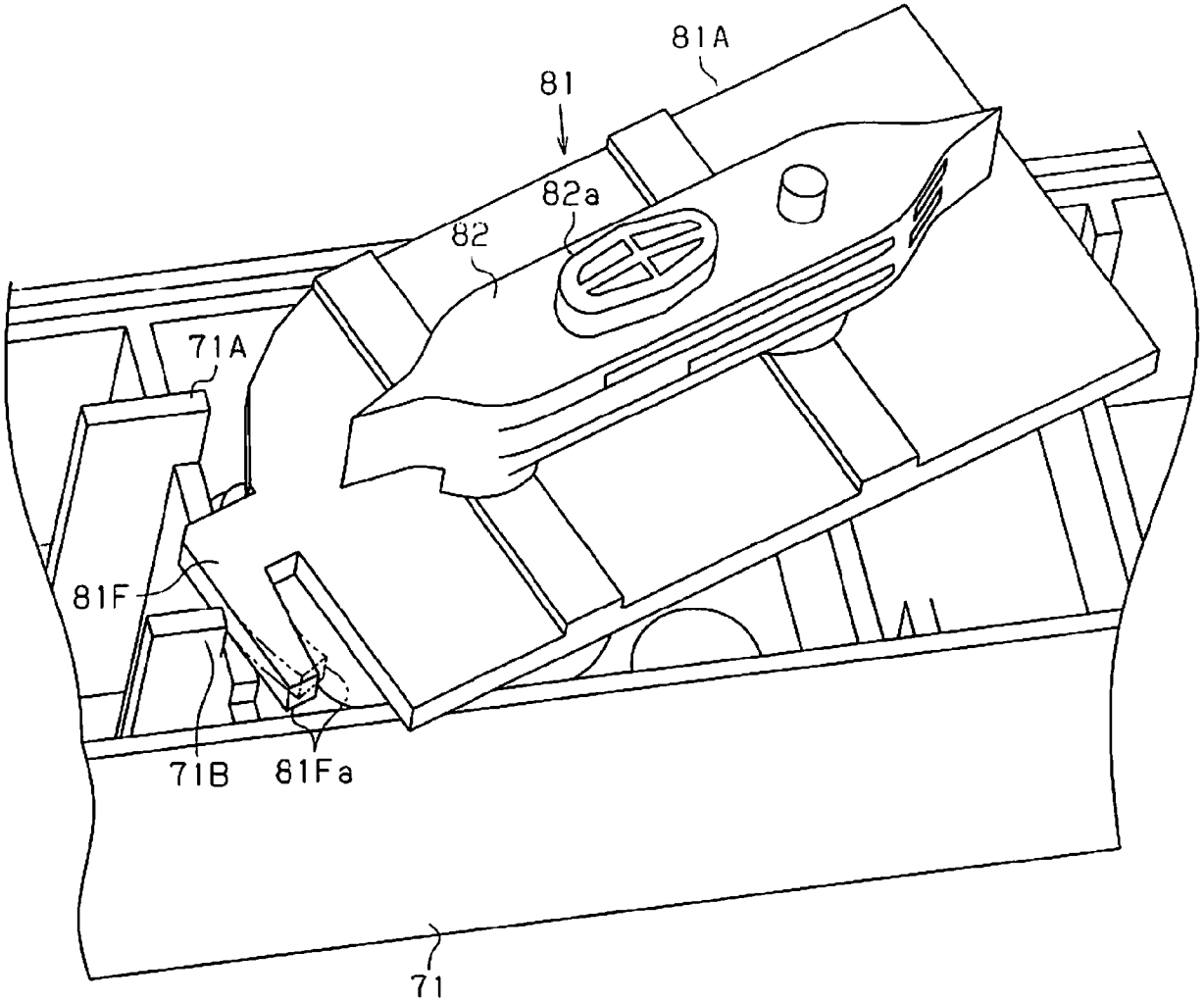
FIG. 23 is an explanatory diagram illustrating shape changing of an L shape section which is provided in a first supply member.

As a result, as shown in FIG. 23, the L shape section 81F is formed so as to change shape as shown by the two-dot chain line in FIG. 23 while being rotated when the ink vessel 80 (the first supply member 81) is attached to the first casing member 71 by being rotated in a clockwise direction. That is, the L shape section 81F is formed so that a locking mechanism 81Fa engages with the second protuberance section 71B while being rotated and so that the locking mechanism 81Fa is fastened to the second protuberance section 71B by the change in shape reverting back at a point in time when engaging with the second protuberance section 71B is terminated after the locking mechanism 81Fa temporarily changes shape to accompany the rotating. Accordingly, when a user attaches the ink vessel 80 to the first casing member 71 by the ink vessel 80 being rotated in a clockwise direction, it is possible to easily recognize a state where the attachment position is rotated due to the change in rotational force which is generated when the shape of the locking mechanism 81Fa changes reverts back to its original shape. Here, it is obvious that it is preferable that the changing of shape by the locking mechanism 81Fa be changing of shape in an elastic manner.

Accordingly, in the present embodiment, it is possible for the ink vessel 80 to be removed from the first casing member 71. That is, it is possible for the ink vessel 80 to be removed from the first casing member 71 due to terminating of the state of the locking mechanism 81Fa, which is in a state of being fastened with the second protuberance section 71B, being fastened with the second protuberance section 71B by changing shape as shown by the two-dot chain line in FIG. 23 and the ink vessel 80 (the first supply member 81) being rotated in a counterclockwise direction.

<Actions of Mounting of Ink Cartridge in Mounting Section>

Next, a case will be described where, out of the four ink cartridges 70 which are inserted in the cartridge holding body 22 in the mounting section 20, the ink cartridge 70W with a larger width is inserted in the cartridge holding body 22 at a position which is farthest to the left side in the scanning direction X. It is obvious that the actions of mounting the ink cartridge 70, which is inserted in the cartridge holding body 22 at a position which is farthest to the left side in the scanning direction X, in the mounting section 20 are the same with regard to the other three ink cartridges 70.

Figure 24:
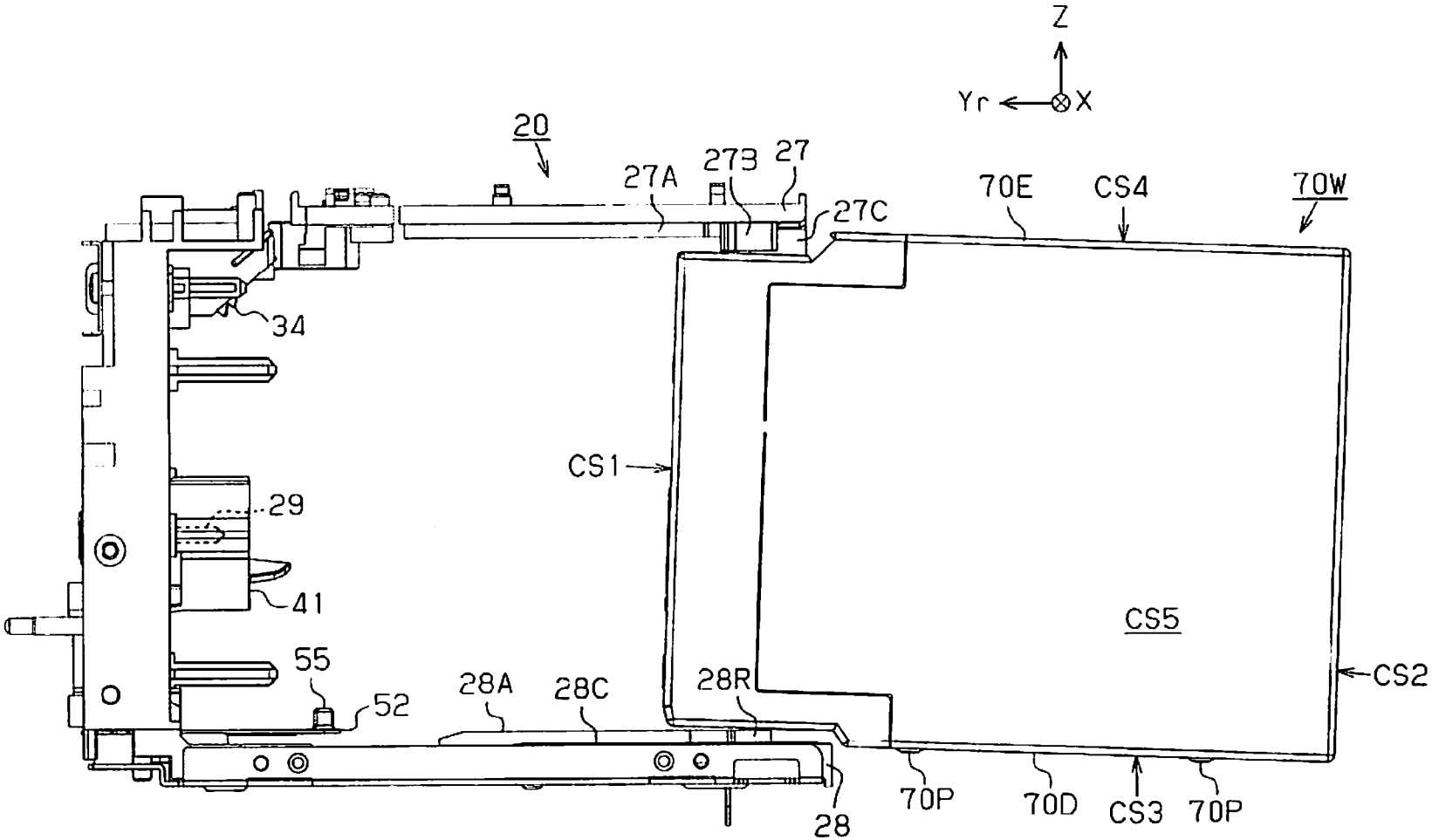
FIG. 24 is a side surface diagram illustrating a state before starting insertion of an ink cartridge in a mounting section.

As shown in FIG. 24, the ink cartridge 70W is in a state where the insertion direction Yr side which is the third surface CS3 (the bottom surface) is placed on the lower guide ribs 28A (the arc shaped ribs 28R) of the bottom member 28 due to the ink cartridge 70W being inserted from the opening side of the cartridge holding body 22 to between the insertion guiding sections 27C which are provided to protrude on the upper member 27 of the cartridge holding body 22. Accordingly, in a state of starting to be inserted, the fifth surface CS5 and the sixth surface CS6 of the ink cartridge 70W are provided as guiding wall sections which are guided by the insertion guiding section 27C of the cartridge holding body 22 and the positions thereof in the scanning direction X are generally set. Here, in order for it to be easy to insert the ink cartridge 70 (70W), the insertion guiding section 27C is provided with a gap between the insertion guiding section 27C and the fifth surface CS5 or the sixth surface CS6 of the ink cartridge 70W which is being inserted.

In addition, in the state of starting to be inserted, the upper side convex sections 70E and the lower side convex sections 70D of the ink cartridge 70W are at positions which do not yet respectively oppose the upper guide ribs 27A and the upper guide ribs 28A of the cartridge holding body 22 in the scanning direction X. In addition, four of the protuberance sections 70P which are provided in the third surface are in a state of not yet being inserted in the cartridge holding body 22. Accordingly, the ink cartridge 70W is in a state where an operation of appropriate position aligning in the mounting section 20 is not yet performed and the positioning of the ink cartridge 70W is unstable. Here, there is a possibility that the ink cartridge 70W will be in an inclined state where the opposite direction side to the insertion direction Yr is lower in the gravity direction due to the weight of ink which is contained in the ink vessel 80 and the like. This inclined state is shown in FIG. 24.

Figure 25:
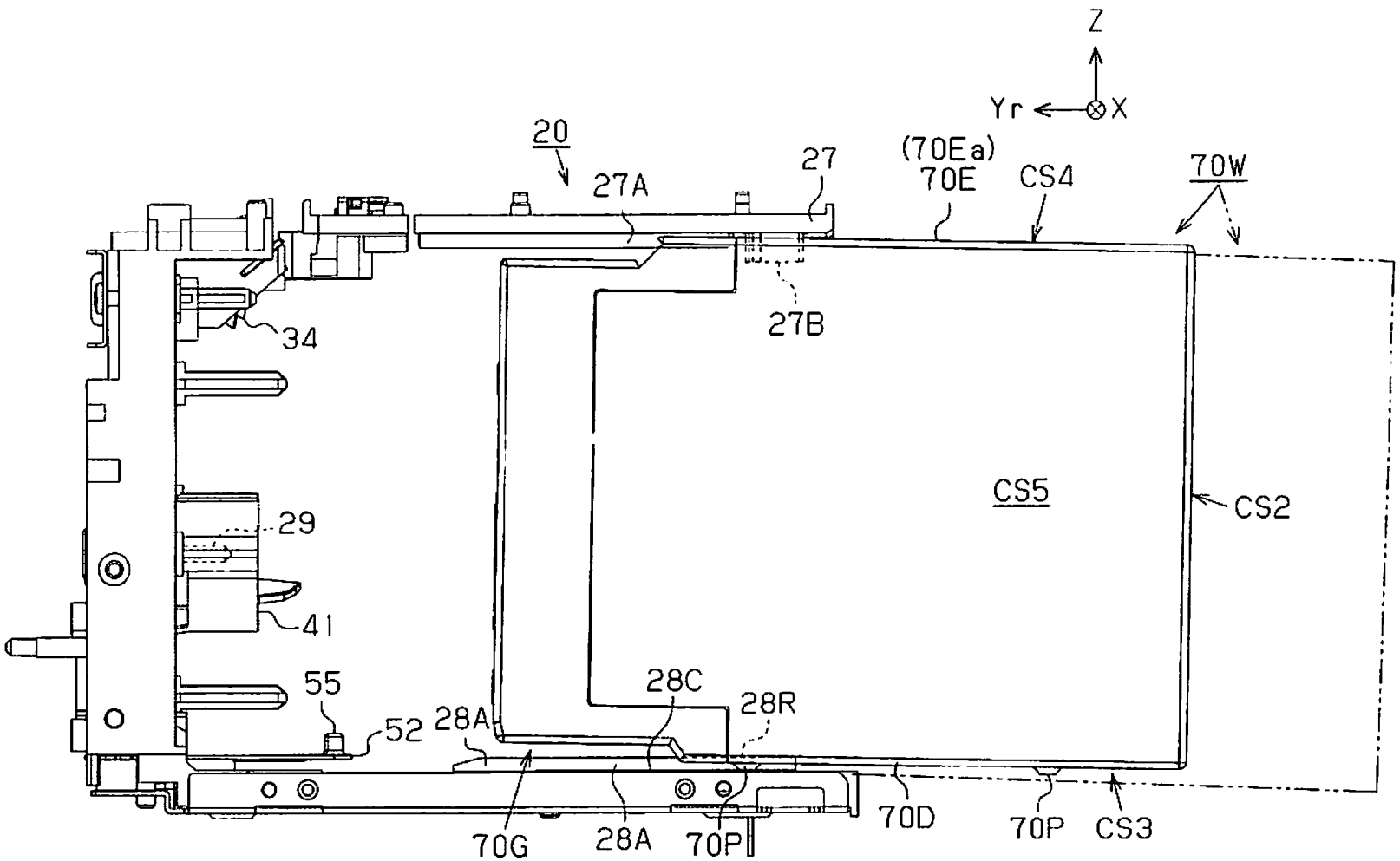
FIG. 25 is a side surface diagram illustrating a state where an ink cartridge is in the process of being inserted in a mounting section.

Next, as shown in FIG. 25, movement of the ink cartridge 70W in the X direction is regulated (positioning is determined) by guiding using the arc shaped ribs 28R of the lower guide ribs 28A in a state where the ink cartridge 70W is further pushed in the insertion direction Yr (a state where the ink cartridge 70W is in the process of being inserted in the mounting section 20) from a state (a state where the ink cartridge 70W is starting to be inserted in the mounting section 20) which is shown by the two-dot chain line in FIG. 25. That is, the arc shaped ribs 28R of the lower guide ribs 28A enter between the lower side convex sections 70D which are formed in the third surface CS3 (the bottom surface) to accompany the ink cartridge 70W being pushed further in the insertion direction Yr. Due to the entering of the arc shaped ribs 28R, the insertion direction Yr side of the third surface CS3 side which is the bottom surface of the ink cartridge 70W is in the state of opposing the lower guide ribs 28A in the bottom member 28 in the scanning direction X. In addition, the upper side convex sections 70E (the inner side convex section 70Ea) are also at a position which opposes the upper guide ribs 27A, and the positions of both the third surface CS3 which is the bottom surface and the fourth surface CS4 which is the upper surface in the ink cartridge 70W are regulated in the scanning direction X. As a result, the ink cartridge 70W is in a state of being generally positionally aligned in the mounting section 20 in the scanning direction X.

Here, in the state of the ink cartridge 70W being in the process of being inserted with regard to the mounting section 20, impeding of the ink cartridge 70W being mounted in the mounting section 20 is avoided (refer to FIG. 28C) due to the guide sections 27B in the cartridge holding body 22 being inserted in the grooves 70H which are provided in the ink cartridge 70W. In addition, since the linking rib 70R, which is provided on the second surface CS2 side of the third surface CS3 of the ink cartridge 70W, is separated in the insertion direction Yr without abutting with the arc shaped ribs 28R of the lower guide ribs 28A of the cartridge holding body 22, there is no impeding of the ink cartridge 70W being mounted in the mounting section 20 (refer to FIG. 28B and FIG. 29B).

Figure 26:
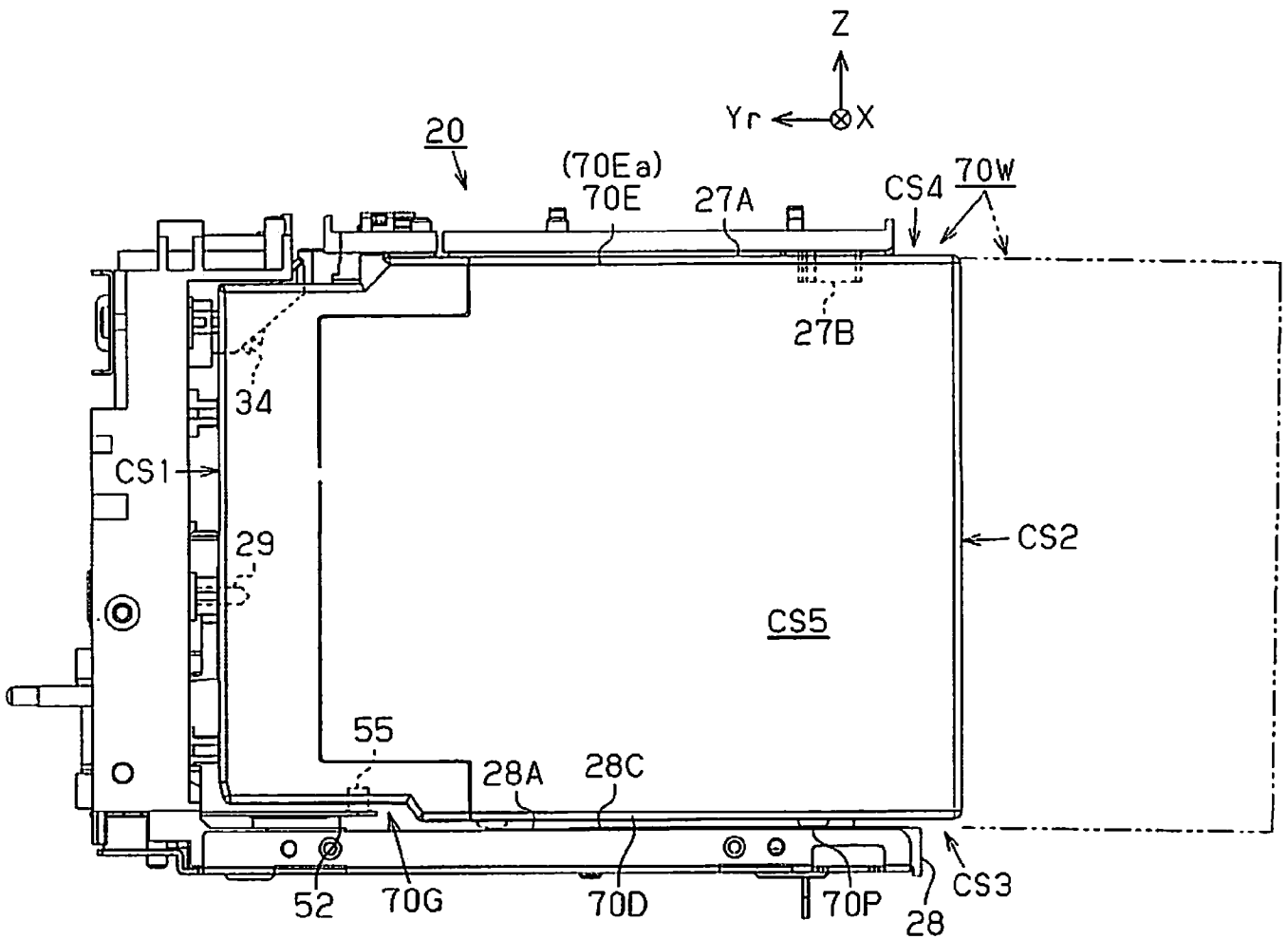
FIG. 26 is a side surface diagram illustrating a mounting state of an ink cartridge in a mounting section.

Next, as shown in FIG. 26, the supply needle 29 is inserted in the liquid supply opening 81K (refer to FIG. 9A) by the moving body 41 being moved in the insertion direction Yr due to the ink cartridge 70W being pushed in the insertion direction Yr from the state of the ink cartridge 70W being in the process of being inserted with regard to the mounting section 20 which is shown by the two-dot chain line in FIG. 26. In addition, the second terminal 34 on the mounting section 20 side and the first terminal 35 on the ink cartridge 70W side (refer to FIG. 9A) abut and are electrically connected and the ink cartridge 70W is in a state of being mounted in the mounting section 20.

Figure 27:
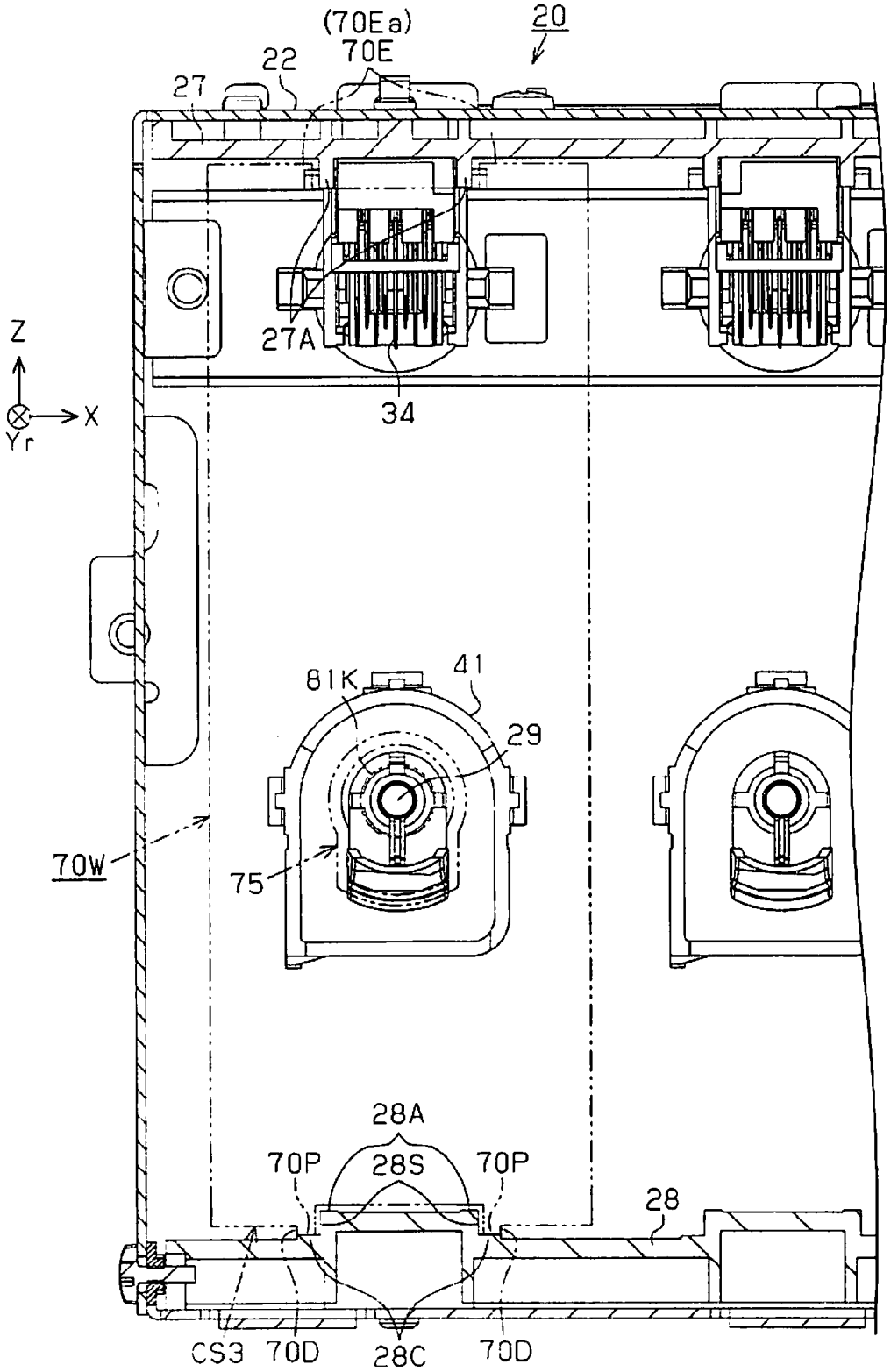
FIG. 27 is a partial exploded diagram illustrating a state viewed from an insertion direction for an ink cartridge in a mounting section.

As shown in FIG. 27, the ink cartridge 70W, which is moved in the insertion direction Yr when reaching the state where the ink cartridge 70W is mounted in the mounting section 20, is moved so as to maintain a state of being positionally aligned in the mounting section 20 in the scanning direction X due to the lower side convex sections 70D and the lower guide ribs 28A which oppose each other in the scanning direction X and the upper side convex sections 70E and the upper guide ribs 27A which oppose each other in the scanning direction X. In addition, when being moved, two of the protuberance sections 70P, which are positioned on the insertion direction Yr side out of the four protuberance sections 70P which are provided in the third surface CS3 of the ink cartridge 70W, are in a state of sliding by coming into contact with the rails 28C (when the ink cartridge 70W is in the process of being mounted in the mounting section 20). Furthermore, in the state where the ink cartridge 70W is mounted in the mounting section or the state where the ink cartridge 70W is in the process of being mounted in the mounting section 20, two of the protuberance sections 70P, which are positioned on the opposite side to the insertion direction Yr side out of the four protuberance sections 70P which are provided in the third surface CS3 of the ink cartridge 70W, are in a state of being in contact with or a state of sliding by coming into contact with the rails 28C as shown in FIG. 27.

As a result, the ink cartridge 70W moves to a stable state where rotating with the scanning direction X as the axis in addition to rotating with the insertion direction Yr as the axis is suppressed due to at least two of the protuberance sections 70P sliding while coming into contact with the rails 28C. In addition, in the mounting state, the ink cartridge 70W is in a stable state where rotating with the insertion direction Yr as the axis is suppressed due to contact between the rails 28C and two of the protuberance sections 70P which are provided to be separated from each other in the scanning direction X.

In addition, as shown in FIG. 26, when the ink cartridge 70W is in the mounting state, the groove section 70G which is provided in the third surface CS3 is positionally aligned in the insertion direction Yr by engaging with the lever member 52. When positionally aligned, pressing force from the lever member 52 to the direction Z side which is the opposite direction to the gravity direction, that is, to the upper side, is received. As a result, there are cases where the insertion direction Yr side of the ink cartridge 70W is in a state of being lifted upward due to the pressing force from the lever member 52.

In this case, the ink cartridge 70W is maintained in a stable state where rotating with the scanning direction X as the axis is suppressed due to two of the protuberance sections 70P which are in contact with the rails 28C on the opposite direction side to the insertion direction Yr as shown in FIG. 27 even in a case where two of the protuberance sections 70P which are positioned on the insertion direction Yr side are in a state of being separated from the rails 28C. Due to this, since positional deviation of the liquid supply opening 81K, which is provided in the first surface CS1, with regard to the supply needle 29 is suppressed, the supply needle 29 is stably inserted with regard to the liquid supply opening 81K.

Furthermore, in the present embodiment, when the ink cartridge 70W is fastened in the mounting section 20 due to engaging of the groove section 70G and the lever member 52, the ink cartridge 70W is positionally aligned in a state where movement in the scanning direction X is restricted.

Figure 28A:
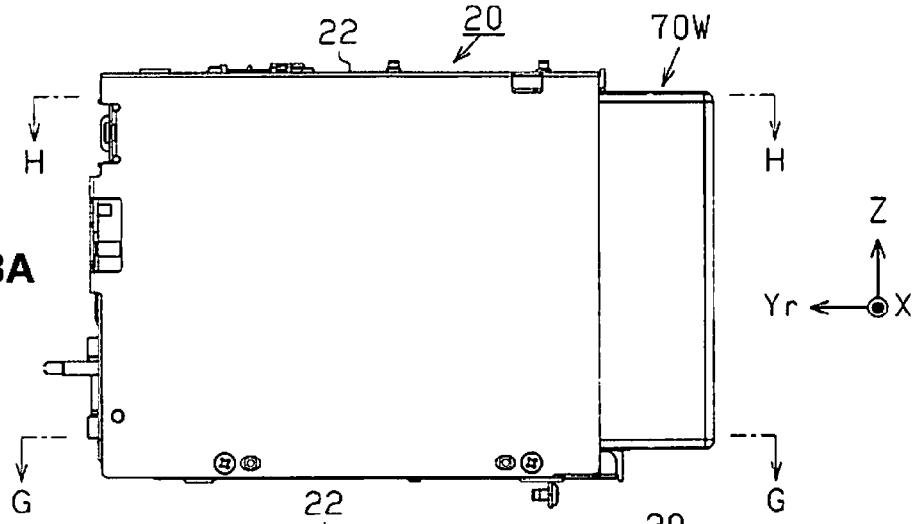
FIGS. 28A to 28C are diagrams illustrating a state where a lever member of a mounting section starts to engage with a groove section of an ink cartridge.
Figure 28B:
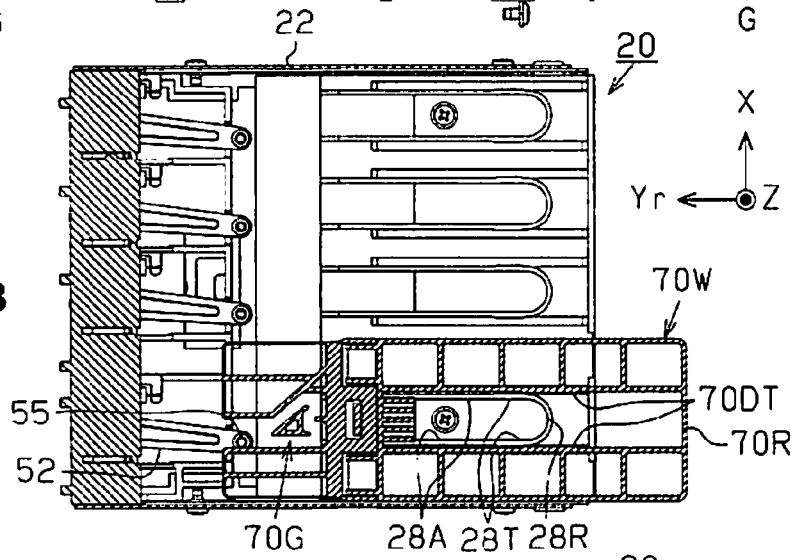
Figure 28C:
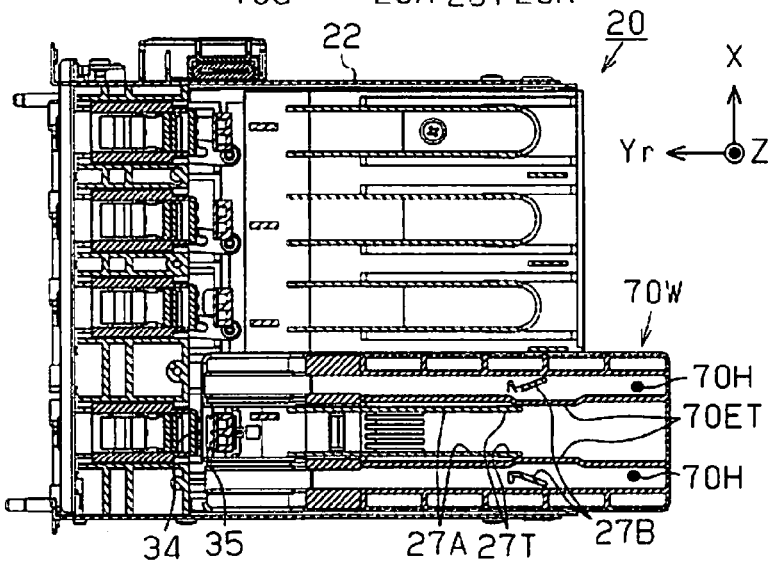

That is, as shown in FIGS. 28A, 28B, and 28C, first, the ribs 28T of the lower guide ribs 28A start to engage with the lower convex wall sections 70DT which are formed in the lower side inner walls 70B of the ink cartridge 70W in a state where the ink cartridge 70W is pushed to a position where the pin 55 of the lever member 52 starts to engage with regard to the groove section 70G. In addition, the ribs 27T of the upper guide ribs 27A start to engage with the upper convex wall sections 70ET which are formed in the upper side inner walls 70A of the ink cartridge 70W. In other words, the ribs 28T of the lower guide ribs 28A and the lower convex wall sections 70DT are formed in positions which are in a state so as to respectively start engaging in this manner.

Due to the start of engaging, the ink cartridge 70W is a state where there are not any gaps as lower side gaps between the ribs 28T of the lower guide ribs 28A and the lower convex wall sections DT in the scanning direction X nor as upper side gaps between the ribs 27T of the upper guide ribs 27A and the upper convex wall sections 70ET in the scanning direction X. Alternatively, the lower side gaps and the upper side gaps may be gaps which are respectively smaller than the gaps between the lower guide ribs 28A and the lower side inner walls 70B and the gaps between the upper guide ribs 27A and the upper side inner walls 70A. In addition, in a state where there are not any gaps, it is permissible for there to be engaging between the ribs 28T of the lower guide ribs 28A and the lower convex wall sections DT and between the ribs 27T of the upper guide ribs 27A and the upper convex wall sections 70ET in a state where a pushing force is generated therebetween.

In this manner, due to the ink cartridge 70W which is inserted in the mounting section 20 being in a state where there are not any gaps or only small gaps in the scanning direction X, the groove section 70G engages with regard to the lever member 52 which is the moveable fastening section without any positional deviation. Accordingly, the lever member 52 moves smoothly along the cam shape which is formed in the groove section 70G. Here, in the state which is shown in FIGS. 28A, 28B, and 28C, inserting of the supply needle 29 in the liquid supply opening and electrical connecting of the first terminal 35 and the second terminal 34 have not yet been performed.

Figure 29A:
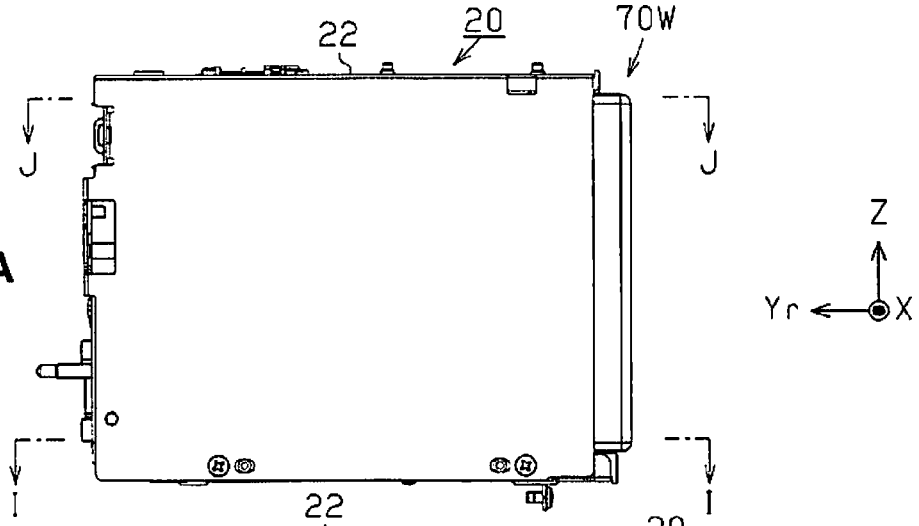
FIGS. 29A to 29C are diagrams illustrating a state where an ink cartridge is at a position with a reference numeral 55 in a mounting section.
Figure 29B:
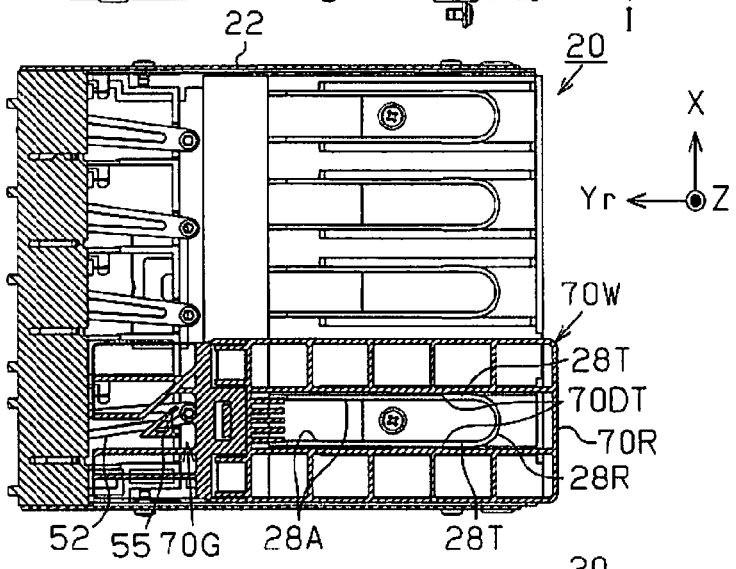
Figure 29C:
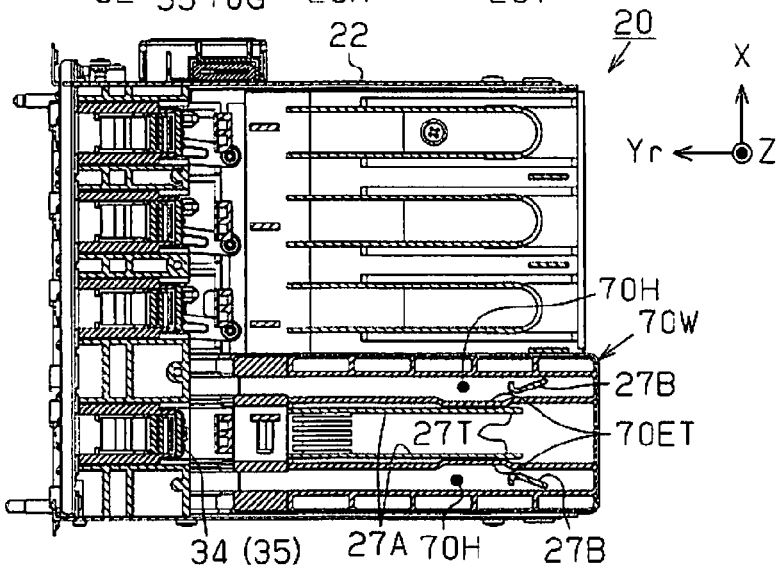

Next, as shown in FIGS. 29A, 29B, and 29C, the ink cartridge 70W which is being inserted is pushed in to the position with the reference numeral 55B which is at the far back with regard to the mounting section 20 in the insertion direction Yr. That is, the position of the pin 55 of the lever member 52 with regard to the groove section 70G is pushed to the position with the reference numeral 55B in FIG. 11A. In the state where there is pushing in this manner, the lower convex wall sections 70DT which are moved in the insertion direction Yr are maintained in a state of being engaged with regard to the ribs 28T of the lower guide ribs 28A in the present embodiment. That is, the lower convex wall sections 70DT are relatively moved in the insertion direction Yr within a range where engaging with the ribs 28T is maintained. In addition, engaging of the ribs 27T of the upper guide ribs 27A with the upper convex wall sections 70ET which are formed in the upper side inner walls 70A in the ink cartridge 70W is also maintained. In other words, the ribs 28T of the lower guide ribs 28A, the lower convex wall sections 70DT, the ribs 27T of the upper guide ribs 27A, and the upper convex wall sections 70ET are formed with specific lengths so respective engaging is maintained in this manner.

Due to engaging being maintained in this manner, the lever member 52 engages with the groove section 70G which suppresses positional deviation in the scanning direction X which accompanies insertion since the ink cartridge 70W moves in the insertion direction Yr with a state being maintained so that there are not any gaps or only small gaps in the scanning direction X. Then, at this time, the supply needle 29 is inserted with positional deviation of the liquid supply opening 81K being suppressed and the first terminal 35 is connected with regard to the second terminal 34 with positional deviation being suppressed.

In addition, due to the moving body 41 being pushed in the insertion direction Yr to accompany the movement of the ink cartridge 70W when the supply needle 29 is inserted in the liquid supply opening 81K, the first pressing member 48 (refer to FIG. 10B) is compressed and a pressing force is generated from the first pressing member 48 with regard to the ink cartridge 70. Accordingly, due to a user pushing the second surface CS2 of the ink cartridge 70W at the mark MK (refer to FIG. 8E) which indicates a pushing position which is displayed on the label 74 on the second surface CS2, it is possible to suppress rotating, with the bottom surface side as a pivot against the pressing force of the first pressing member 48, from being generated and to stably push the ink cartridge 70W in the insertion direction Yr.

Figure 30A:
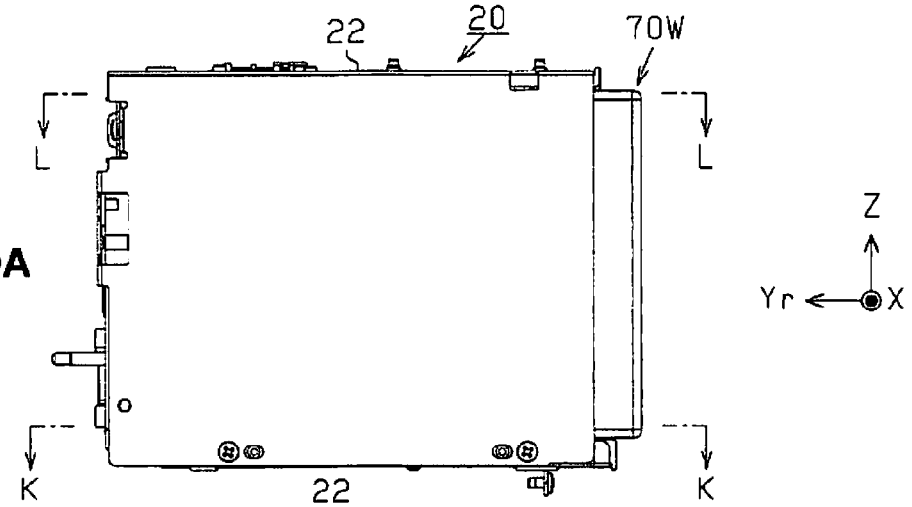
FIGS. 30A to 30C are diagrams illustrating a state where an ink cartridge is at a position of being mounted in a mounting section.
Figure 30B:
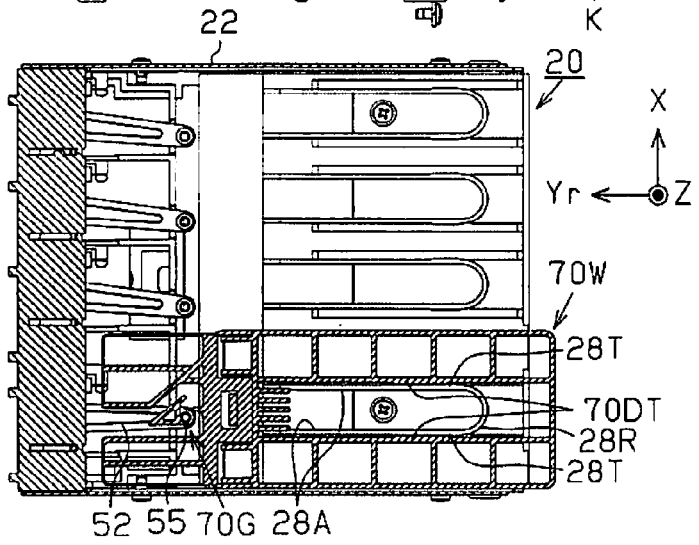
Figure 30C:
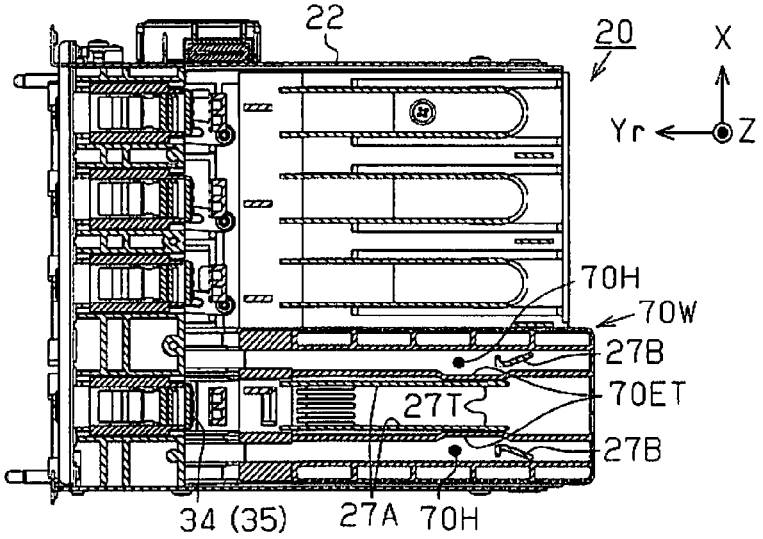

Next, as shown in FIGS. 30A, 30B, and 30C, the ink cartridge 70W is pressed back in the extraction direction due to the pressing force of the first pressing member 48 by the pushing with regard to the ink cartridge 70W, which is moved to the position with the reference numeral 55B, in the insertion direction Yr being terminated. Due to this, the ink cartridge 70W is at the mounting position of being fastened using the lever member 52 so as to not fall out from the cartridge holding body 22 due to the pin 55 of the lever member 52 being moved to the restricting position (refer to reference numeral 55C in FIG. 11A) in the groove section 70G. Accordingly, even if a pushing force is generated between the ribs 28T of the lower guide ribs 28A and the lower convex wall sections 70DT or a pushing force is generated between the ribs 27T of the upper guide ribs 27A and the upper convex wall sections 70ET, the pressing force of the first pressing member 48 is set so that the ink cartridge 70W is moved against the pushing forces.

With movement of the ink cartridge 70W from the position with the reference numeral 55B to the mounting position, the lower convex wall sections 70DT which are moved in the extraction direction are maintained in the state of engaging with regard to the ribs 28T of the lower guide ribs 28A. In addition, the ribs 27T of the upper guide ribs 27A are maintained in the state of engaging with the upper convex wall sections 70ET which are formed in the upper side inner walls 70A of the ink cartridge 70W. It is obvious that the state of abutting between the first terminal 35 and the second terminal 34 is maintained. In addition, the state where the supply needle 29 is inserted with regard to the liquid supply opening 81K is maintained at the mounting position of the ink cartridge 70W.

In this manner, the upper convex wall sections 70ET and the lower convex wall sections 70DT of the ink cartridge 70W function as position aligning sections which positionally aligned respectively using the ribs 27T of the upper guide ribs 27A and the ribs 28T of the lower guide ribs 28A in the mounting section 20 when fastened due to engaging of the groove section 70G with the lever member 52. Then, in the present embodiment, the upper convex wall sections 70ET and the lower convex wall sections 70DT which function as the position aligning sections are provided to be arranged to be positioned on both sides to respectively interpose the upper guide ribs 27A and the lower guide ribs 28A when the ink cartridge 70W is inserted in the mounting section 20 and positionally align the ink cartridge 70W in a direction which intersects with the insertion direction Yr which is the insertion direction.

Here, the ink cartridge 70W which is at the mounting position is moved again to the position which is shown in FIGS. 29A, 29B, and 29C due to the ink cartridge 70W being again pushed to the insertion direction Yr side against the pressing force of the first pressing member 48. Due to being moved to this position, the pin 55 moves to the position which is indicated by the reference numeral 55D in FIG. 11A. Due to the pin 55 moving to the position with the reference numeral 55D, the state of fastening of the groove section 70G and the pin 55 in the level member 52 is terminated at this time and the ink cartridge 70W is pushed back to a position where extraction by a user is possible through the moving member 41 using the pressing force of the first pressing member 48.

According to the embodiment described above, it is possible for the following effects to be obtained.

(1) Since the filter chamber 60F and the low pressure chamber 60D are both provided in the ink chamber IS, it is possible to suppress ink which includes bubbles (gas) or foreign matter other than bubbles (dirt, dust, or the like) from flowing out from the ink chamber IS through the liquid supply opening 81K.

(2) Due to the filter chamber 60F overlapping with the low pressure chamber 60D in a direction which maximizes the projection area of the filter chamber 60F, it is possible for bubbles (gas) in the filter chamber 60F to easily and effectively flow to the low pressure chamber 60D.

(3) It is possible for the first opening section 65 to be positioned in the ink chamber IS on the gravity direction side in the vertical direction. Accordingly, it is possible for the ink in the ink vessel 80, which is reduced due to flowing out from the liquid supply opening 81K, to easily flow into the filter chamber 60F through the first opening section 65 which is positioned on the gravity direction side due to the ink physically remaining on the gravity direction side.

(4) Since at least a portion of the filter chamber 60F and the low pressure chamber 60D is formed as the shared member, it is possible for the filter chamber 60F and the low pressure chamber 60D to be formed in adjacent positions. Accordingly, it is possible for gas to be removed from ink which flows into the filter chamber 60F using the low pressure chamber 60D which is adjacent to the filter chamber 60F. In addition, since it is possible to form the filter chamber 60F and the low pressure chamber 60D with an overall volume which is smaller due to the filter chamber 60F and the low pressure chamber 60D being formed using the shared member, it is possible to suppress a reduction in the amount of ink which is able to be contained in the ink chamber IS.

(5) It is possible to replace the members which configure the filter chamber 60F and the low pressure chamber 60D. It is possible to, for example, replace the filter chamber 60F and the low pressure chamber 60D in a case when it is necessary during manufacturing of the ink vessel 80. Accordingly, it is also possible to, for example, change the filter chamber 60F and the low pressure chamber 60D.

(6) It is possible for ink to be led to the filter chamber 60F by flowing in a gap which is formed by the convex sections 61A, 61B, and 61C so as not to remain in the ink chamber IS.

(7) Since the changing of shape of the filter 66 in the filter chamber 60F is regulated by the rib 64*b*, it is possible to suppress a reduction in the filter chamber 60F and to suppress damage to the filter 66 due to the filter 66 changing shape.

(8) Since the flow speed of ink which flows out to the first supply member 81 side is slower in the filter chamber 60F, it is possible for ink to easily flow to the liquid supply opening 81K.

(9) Since gas is removed from ink in the filter chamber 60F using the low pressure chamber 60D which is configured using the second supply member 61, it is possible to suppress ink which includes dirt or bubbles (gas) from flowing out from the ink chamber IS.

(10) Since air escapes in the space 83 which is formed by the joining of the pack body 91 and the first supply member 81, it is possible to suppress joining of the pack body 91 and the first supply member 81 from peeling due to expansion of air in the space 83 to accompany changes in temperature.

(11) In a case where the space 83 is formed in the first supply member 81 as in the present embodiment, it is possible for the space 83 to easily communicate with the outside using the communication opening 84 which is provided in the first supply member 81.

(12) Since blocking off of the communication opening 84 due to a circular rod or the like is easily suppressed, it is possible to suppress the joining (fusing) of the pack body 91 and the first supply member 81 (the joining section 82) from peeling by suppressing the expansion of air in the space 83 to accompany changes in temperature using the communication opening 84.

(13) Since blocking off of the communication opening 84 due to a sheet or the like is suppressed, it is possible for air to escape in the space 83 at the joining of the pack body 91 and the first supply member 81 and it is possible to suppress the joining of the pack body 91 and the first supply member 81 from peeling by suppressing the expansion of air in the space 83 to accompany changes in temperature using the communication opening 84.

(14) Blocking off of the communication opening 84 is suppressed since foreign matter and the like which is attached to the stepped section 81D is positioned more to the gravity direction side than the communication opening 84. As a result, it is possible to suppress the joining of the pack body 91 and the first supply member 81 from peeling by suppressing the expansion of air in the space 83 to accompany changes in temperature using the communication opening 84.

(15) Since it is possible to suppress blocking off of the communication opening 84 using the steps of the stepped section 81D with a high probability, it is possible to suppress the joining of the pack body 91 and the first supply member 81 from peeling by suppressing the expansion of air in the space 83 to accompany changes in temperature using the communication opening 84.

(16) Since blocking off of the communication opening 84, which is positioned on the direction Z side which is the opposite direction to the gravity direction of the liquid supply opening 81K, due to ink, which leaks out from the liquid supply opening 81K, is suppressed, it is possible to suppress the joining of the pack body 91 and the first supply member 81 from peeling by suppressing the expansion of air in the space 83 to accompany changes in temperature using the communication opening 84.

(17) Blocking off of the communication opening 84 is suppressed since the communication opening 84 is concealed in a state of being mounted in the printer 11. As a result, it is possible to suppress the joining of the pack body 91 and the first supply member 81 from peeling by suppressing the expansion of air in the space 83 to accompany changes in temperature using the communication opening 84.

(18) It is possible for the ink cartridge 70 (70W) to be provided with the ink vessel 80 where the joining of the pack body 91 and the first supply member 81 is suppressed from peeling.

(19) The ink vessel 80 is positionally aligned by the cylindrical flow path section 85 of the first supply member 81 being engaged with the first casing member 71 by being rotated with the insertion direction Yr as an axis in a state of being inserted in the through hole 75H of the first casing member 71. Accordingly, it is possible for the first supply member 81 of the ink vessel 80 to be supported with regard to the first casing member 71 in a state of being positionally aligned using a simple configuration (and with fewer processes). As a result, it is possible to obtain the ink cartridge 70 (70W) where movement of the ink vessel 80 is suppressed even when a shock is applied due to being dropped or the like.

(20) Since the first supply member 81 is fastened using the first protuberance section 71A and the second protuberance section 71B which regulates rotating in a state of engaging so that movement of the cylindrical flow path section 85 in the opposite direction to the insertion direction into the through hole forming section 75 is regulated, it is possible to maintain a state where the first supply member 81 is supported in a state of being positionally aligned with regard to the first casing member 71.

(21) Since it is possible to recognize a state where the L shape section 81F of the first supply member 81 is fastened to the first protuberance section 71A and the second protuberance section 71B of the first casing member 71 due to the locking mechanism 81Fa changing shape, it is possible for the first supply member 81 to reliably be in a state of being supported by the first casing member 71.

(22) When the first supply member 81 is attached to the first casing member 71, it is easy for a rotation angle of 90 degree to be a guide and assembly is easy.

(23) Since the first supply member 81 falling out in the opposite direction to the insertion direction in a state of being supported by the first casing member 71 is suppressed due to the state of fastening of the fastened section 86 of the cylindrical flow path section 85 with regard to the side wall 76 of the through hole forming section 75, a state where the first support member 81 is firmly positionally aligned and supported in the first casing member 71 is possible.

(24) Due to the first supply member 81 being rotated in a state where movement of the cylindrical flow path section 85 in the insertion direction Yr is restricted, it is possible for the first supply member 81 to be easily and reliably supported by the first casing member 71.

(25) It is possible to suppress mistakes in the insertion posturing of the first supply member 81 when the cylindrical flow path section 85 is inserted in the through hole 75H when the first supply member 81 is supported by the first casing member 71.

(26) Since the ink cartridge 70 (70W) is positionally aligned at a plurality of locations due to the convex sections 70C which are provided at the respective surface sides which oppose each other in a direction which intersects with the insertion direction Yr in a state of being mounted in the mounting section 20, it is possible for the ink cartridge 70 (70W) to be mounted in the mounting section 20 in a stable state.

(27) It is possible for the ink cartridge 70 (70W) which is pressed upward in the vertical direction to be positionally aligned in the mounting section 20 while suppressing inclining of the ink cartridge 70 (70W).

(28) Since rotating of the ink cartridge 70 (70W) with the insertion direction Yr as an axis is suppressed during mounting in the mounting section 20, the ink cartridge 70 (70W) is mounted in a stable state where positional deviation of the liquid supply opening 81K is suppressed.

(29) Since inclining of the first terminal 35 of the circuit board 30 is suppressed during mounting in the mounting section 20, positional deviation of the first terminal 35 with regard to the mounting section 20 is suppressed. Accordingly, it is possible for information relating to ink which is sent from the printer 11 to be stably stored.

(30) Since a pressing force is generated in the extraction direction due to inclining during mounting in the mounting section 20 in a case where a pressing force is applied in order to perform an electrical connection with regard to the first terminal 35, it is possible to stably extract the ink cartridge 70 (70W) from the mounting section 20.

(31) Due to suppressing of rotating with the bottom surface (the third surface CS3) side of the ink cartridge 70 (70W) as a pivot due to a pressing force in the extraction direction during mounting in the mounting section 20, it is possible to mount the ink cartridge 70 (70W) in the mounting section 20 in a stable state.

(32) The lower side convex sections 70D of the convex sections 70C generally positionally align the ink cartridge 70 (70W) when the ink cartridge 70 (70W) is inserted in the mounting section 20, and the ink cartridge 70 (70W) which is mounted in the mounting section 20 is accurately positionally aligned due to the protuberance sections 70P of the convex sections 70C. Accordingly, it is possible to mount the ink cartridge 70 (70W) with regard to the mounting section 20 in a stable state.

(33) In a case where the ink cartridge 70 (70W) is inserted in the mounting section 20 in a reverse manner with the second surface CS2 as the inserting side, the linking rib 70R enters deep in the mounting section 20 compared to a case where the ink cartridge 70 (70W) is inserted in the mounting section 20 in the correct manner with the first surface CS1 side as the inserting side. Accordingly, it is possible to suppress the ink cartridge 70 (70W) from being erroneously inserted in the mounting section 20 by providing the arc shaped ribs 28R, which is the engaging section which engages with the linking rib 70R in a case where the ink cartridge 70 (70W) is inserted in the mounting section 20 in a reverse manner.

(34) Since the ink cartridge 70 (70W) is positionally aligned when being inserted in the mounting section 20 due to the groove section 70G being fastened with the lever member 52, the operation of mounting the ink cartridge 70 (70W) in the mounting section 20 is smoothly performed and the ink cartridge 70 (70W) is reliably fastened in the mounting section 20 when mounting is completed.

(35) Since rotating of the ink cartridge 70 (70W) in a direction which intersects with the insertion direction Yr is regulated when the ink cartridge 70 (70W) is mounted by being inserted in the mounting section 20, the groove section 70G reliably engages with regard to the lever member 52 when the ink cartridge 70 (70W) is being mounted.

(36) The ink cartridge 70 (70W) is guided due to the lower side inner walls 70B of the lower side convex sections 70D opposing the side surfaces 28S of the lower guide ribs 28A and is reliably fastened using the lever member 52 while the groove section 70G reliably engages with the lever member 52 due to the lower convex wall sections 70DT which are provided in the lower side convex sections 70D.

(37) Since the upper convex wall sections 70ET and the lower convex wall sections 70D of the ink cartridge 70 (70W) are respectively positioned on both sides of the upper guide ribs 27A and the lower guide ribs 28A, it is possible for the ink cartridge 70 (70W) to be more reliably positionally aligned in the mounting section 20.

(38) Since positional deviation between the groove section 70G and the lever member 52 is suppressed, it is possible to more reliably perform fastening of the groove section 70G and the lever member 52.

(39) Since the electrical connection section of the ink cartridge 70 (70W) is provided in the extending region R4 which is a surface which is interposed by the pair of upper convex wall sections 70ET, electrical connection with the electrical connection section on the printer 11 side is reliably performed due to the positional aligning by the upper convex wall sections 70ET.

(40) Since the liquid supply opening 81K is also positionally aligned in a state where positional deviation is suppressed due to the upper convex wall sections 70ET and the lower convex wall sections 70DT, the liquid supply opening 81K is reliably connected with the supply needle 29 of the mounting section 20 of the printer 11.

(41) Since it is possible to insert the ink cartridge 70 (70W) to be guided by the insertion guiding section 27C when the ink cartridge 70 (70W) is being inserted in the mounting section 20, it is possible for the ink cartridge 70 (70W) to be mounted in an appropriate position with regard to the mounting section 20.

(42) Since the upper side convex sections 70E and the lower side convex sections 70D are respectively guided by the upper guide ribs 27A and the lower guide ribs 28A and the guide sections 27B are inserted in the grooves 70H, it is possible for the ink cartridge 70W with a larger width to be easily mounted in an appropriate position when inserted in the mounting section 20.

(43) Erroneous inserting of the ink cartridge 70W in the mounting section 20 is suppressed since it is difficult for the side surface, which is opposite to the one of the side surfaces (the fourth surface CS4) where the upper side convex sections 70E and the grooves 70H are provided, to be inserted on the side of the upper guide rail 27A and the guide sections 27B when inserting the ink cartridge 70W with a larger width.

Here, the embodiment described above may be modified to other embodiments as follows.

In the ink vessel 80 of the embodiment described above, the inclined surface 64*a*, where the cross sectional area of the flow path at the first position which is close to the ink outflow opening 64H is larger than the cross sectional area of the flow path at the second position which is further from the ink outflow opening 64H than the first position, need not necessarily be provided in the filter chamber 60F. For example, the filter chamber 60F may substantially be a rectangular cube shape with no inclined surface in a case where it is not necessary for the flow of ink which flows out from the filter chamber 60F to be slower.

In the ink vessel 80 of the embodiment described above, the rib 64*b* which is the abutting section with the filter 66 which changes shape need not necessarily be provided in the filter chamber 60F. For example, the rib 64*b* is unnecessary in a case where the filter 66 hardly changes shape or in a case where the function of the filter chamber 60F is maintained without the first opening section 65 being opened up due to the filter 66 peeling from the second supply member 61 even when the filter 66 changes shape.

In the ink vessel 80 of the embodiment described above, at least one of the convex sections out of the convex sections 61A, 61B, and 61C may be provided in the second supply member 61. In addition, the one convex section which is provided may be a convex section where a single protuberance is formed instead of a plurality of protuberances. Alternatively, the convex sections 61A, 61B, and 61C need not necessarily be provided in a case where, for example, the pack body 91 does not change shape or the change in shape is small due to a reduction in the amount of ink in the ink chamber IS since there is a low probability that the pack members 92 will abut with the second supply member 61.

In the ink vessel 80 of the embodiment described above, there need not necessarily be a configuration where the filter chamber 60F and the low pressure chamber 60D are connected so as to be able to be attached and detached with regard to the first supply member 81 due to the second supply member 61 being formed integrally with the first supply member 81 (the joining section 82)

in a case where, for example, it is not necessary to replace the second supply member 61.

In the ink vessel 80 of the embodiment described above, the first opening section 65 where it is possible for ink to flow into the filter chamber 60F through the filter 66 need not necessarily have a length in the vertical direction which is shorter than the length in a direction which intersects with the vertical direction. For example, the first opening section 65 may be a square or a rectangle which is long in the vertical direction according to the shape of the pack body 91.

In the ink vessel 80 of the embodiment described above, the low pressure chamber 60D need not be formed in a state where at least a portion overlaps with the filter chamber 60F in the projection direction where the projection area of the filter chamber 60F is maximized.

In the ink vessel 80 of the embodiment described above, the filter chamber 60F and the low pressure chamber 60D need not necessarily be formed using the shared member. For example, the second supply member 61 may be formed as two members which are divided in the thickness direction which is the scanning direction X, the filter chamber 60F may be formed from one of the two members of the second supply member 61 which is divided, and the low pressure chamber 60D may be formed from the other member.

In the ink vessel 80 of the embodiment described above, the second supply member 61 where the low pressure chamber 60D is formed need not necessarily be formed in a position where it is possible to reduce the proportion of gas which is dissolved in ink in the filter chamber 60F. This is permissible in a case where, for example, there is a low probability that gas will be dissolved in ink which flows into the filter chamber 60F in the ink chamber IS.

In the ink vessel 80 of the embodiment described above, the filter chamber 60F and the low pressure chamber 60D need not necessarily be provided in a case where, for example, ink which is contained in the ink chamber is ink with hardly any dirt or dissolved gas. One modified example of this will be described below with reference to the drawings.

Figure 31A:
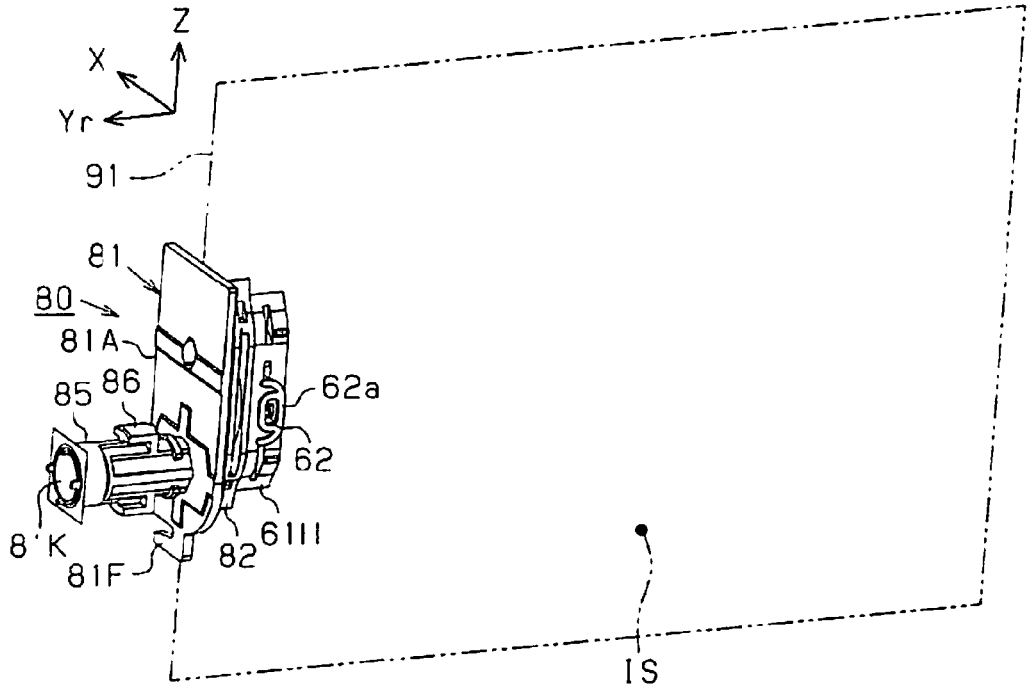
FIGS. 31A and 31B are diagrams illustrating a first supply member which is a modified example where a filter chamber and a low pressure chamber are not provided and FIGS. 31A and 31B are perspective diagrams of a first supply member viewed from the opposite side to each other.
Figure 31B:
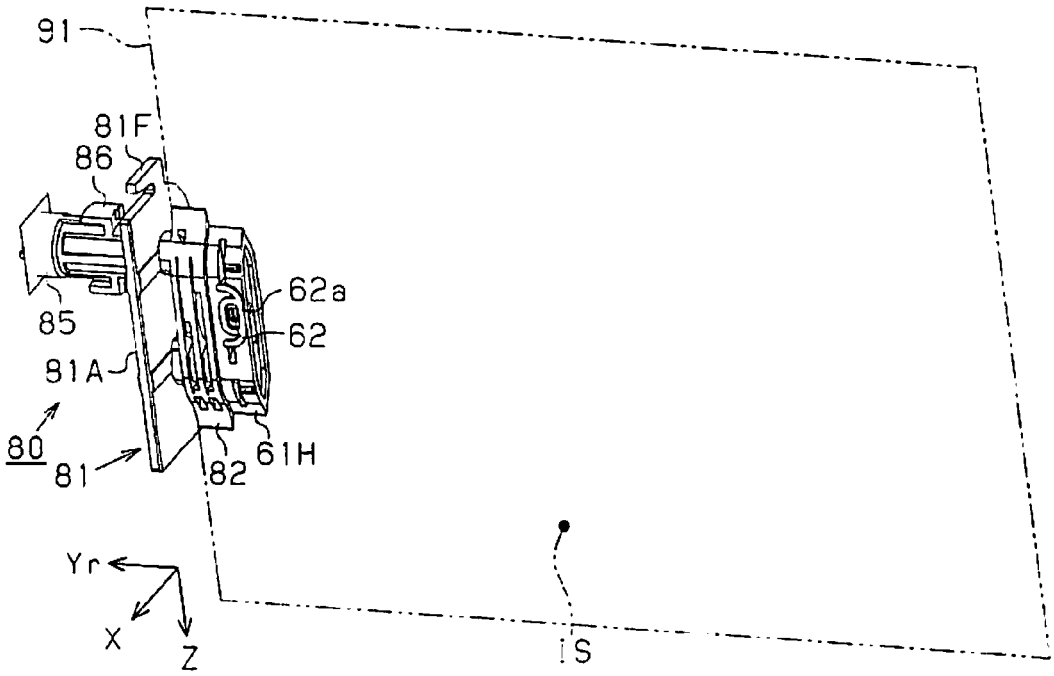

As shown in FIGS. 31A and 31B, the first supply member 81 where the liquid supply opening 81K is formed and the ink chamber IS, which is an ink containing space using the pack body 91 which is joined with the first supply member 81, are formed in the ink vessel 80 of the present modified example. Then, the injection opening 62 is provided in the joining section 82 on the ink chamber IS side when ink is injected in the ink chamber IS and a second supply member 61H, where the valve 93 which is a check valve is provided inside, is connected. Accordingly, the second supply member 61H has generally a shape where a forming member portion for the filter chamber 60F and the low pressure chamber 60D is cut away from the second supply member 61 of the embodiment. Due to this shape, it is not necessary to change the shape of the first supply member 81 and it is possible to easily form the ink vessel 80 without the filter chamber 60F and the low pressure chamber 60D. In other words, it is possible to easily manufacture the ink vessel 80 which is provided with the filter chamber 60F and the low pressure chamber 60D and the ink vessel 80 which is not provided with the filter chamber 60F and the low pressure chamber 60D with the same shape according to the type of ink which is contained.

In the ink vessel 80 of the embodiment described above, the communication opening 84 need not necessarily be positioned in the first supply member 81 on the insertion direction Yr side toward the mounting section 20 of the printer 11 if it is a location where the communication opening 84 is open to air and there is a low probability that the communication opening 84 will be covered by a sheet or the like. For example, the communication opening 84 may be an opening on the side surface of the main body 81A.

In the ink vessel 80 of the embodiment described above, the communication opening 84 need not necessarily be positioned more to the direction Z side which is the opposite direction to the gravity direction in the vertical direction than the liquid supply opening 81K in a state of being mounted in the mounting section 20. The communication opening 84 may be provided at any position in the main body upper surface 81S of the main body 81A in a case such as where ink does not flow on the main body 81A in a case where, for example, ink leaks out from the liquid supply opening 81K.

In the ink vessel 80 of the embodiment described above, the width W1 of the stepped section 81D along the vertical direction may be the same as or may be wider than the width W2 of the communication opening 84 along the vertical direction. Due to, for example, a stepped section on the direction Z side which is the opposite direction to the gravity direction of the stepped section 81D being formed in the stepped section 81D so as to be positioned within the width W2 of the communication opening 84, it is possible to suppress the communication opening 84 from being blocked off since it is possible for steps to be formed in at least two locations in the communication opening 84.

In the ink vessel 80 of the embodiment described above, the stepped section 81D need not necessarily be positioned on the gravity direction side of the communication opening 84 in the vertical direction in a state of being mounted in the mounting section 20. The stepped section 81D may be positioned in the direction Z side which is the opposite direction to the gravity direction of the communication opening 84 in a case where, for example, there is a low probability that foreign matter or the like will be attached to the stepped section 81D.

In the ink vessel 80 of the embodiment described above, the stepped section 81D, where steps in the perpendicular direction to the main body upper surface 81S are formed in at least a portion of the communication opening 84, need not be provided in the first supply member 81 in the main body upper surface 81S where the communication opening 84 is formed. The stepped section 81D need not be provided in this manner in a case where, for example, there is a low probability that the communication opening 84 will be blocked off.

In the ink vessel 80 of the embodiment described above, the stepped section 81D of the first supply member 81 may be a groove which is provided in the main body upper surface 81S.

Figure 32B:
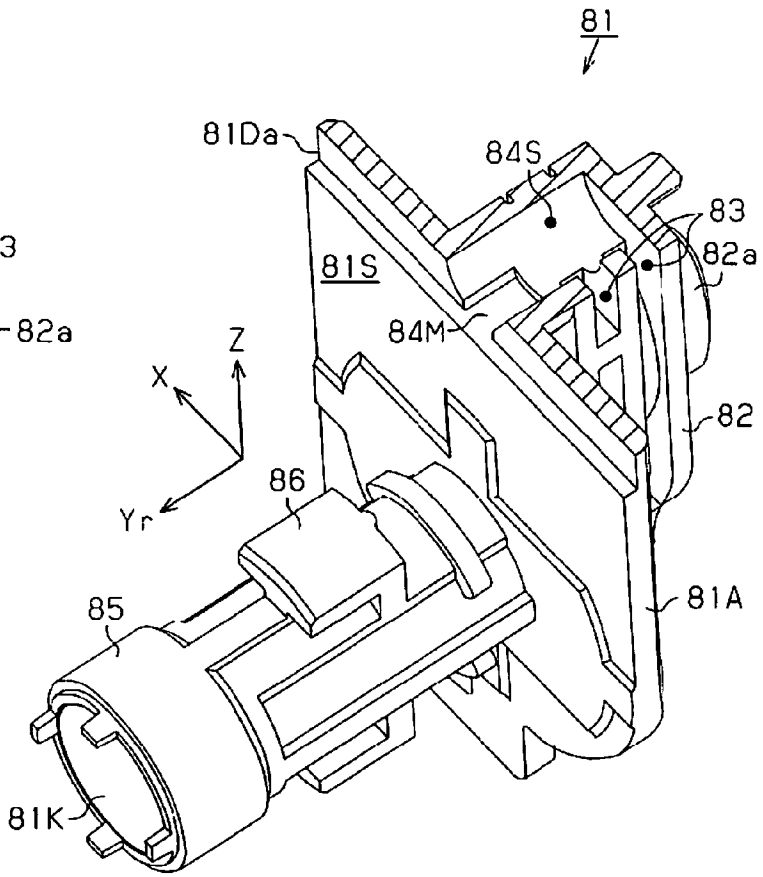
FIG. 32A is a perspective diagram illustrating a first supply member which is a modified example where a groove which intersects with a communication opening is formed and FIG. 32B is a perspective diagram where a first supply member which is a modified example is cut along a groove.
Figure 32A:
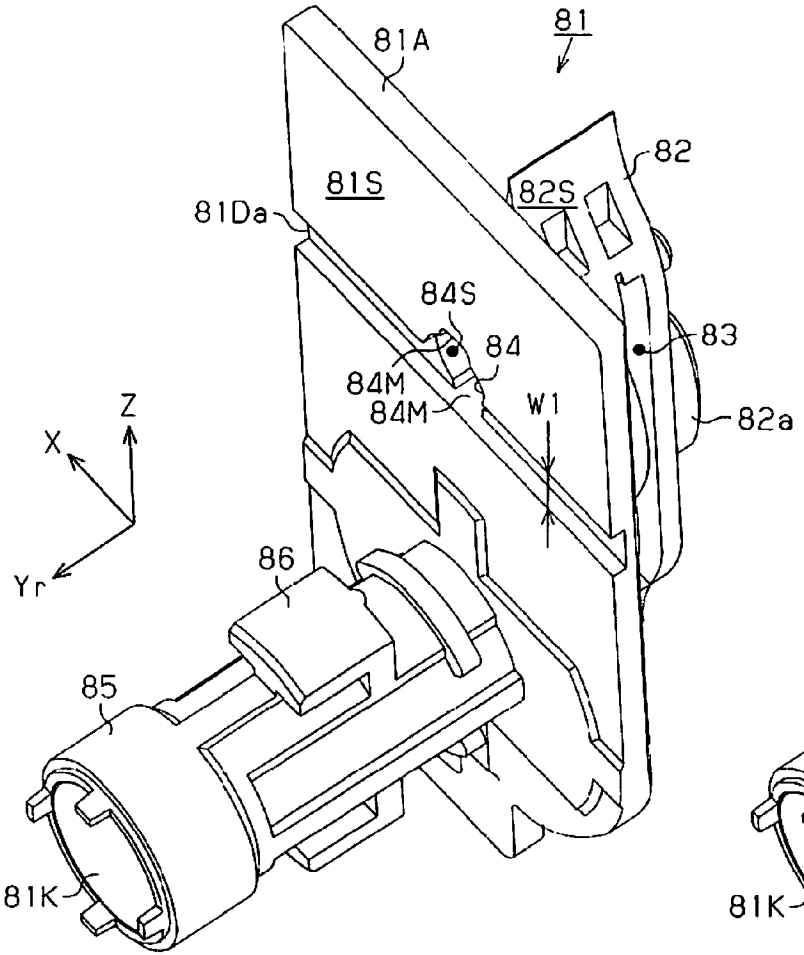

For example, as shown in FIGS. 32A and 32B, a concave groove is formed in the present modified example as a stepped section 81Da in the first supply member 81 in the main body upper surface 81S of the main body 81A so as to cut across the communication opening 84 which communicates with air. Accordingly, the stepped section 81Da communicates with the space 84S with a cylindrical shape. In addition, in the present modified example, the concave groove of the stepped section 81Da is provided to extend to both end sections of the main body 81A in the latitudinal direction and it is possible to maintain the communication opening 84 so as to be open to air due to the side end of the main body 81A being open even if the main body upper surface 81S where the communication opening 84 is provided is covered.

In the ink vessel 80 of the embodiment described above, the shape of the communication opening 84 is not necessarily limited to a polygon shape. For example, the shape of the communication opening 84 may be a circle or may be an ellipse. Alternatively, the shape of the communication opening 84 may be a boat shape which is the same as the joining section 82. It is possible for any shape to be adopted as the shape of the communication opening 84 if it is a shape where it is possible for the possibility that the communication opening 84 is blocked off is reduced.

In the ink vessel 80 of the embodiment described above, the space 83 need not necessarily communicate with the outside using the communication opening 84 which is formed in the first supply member 81. The space 83 may communicate with the outside due to a hole which communicates with the space 83 being opened in a portion in the pack members 92 of the pack body 91 which is joined with the joining surface 82S of the first supply member 81.

In the ink cartridge 70 (70W) of the embodiment described above, the first supply member 81 of the ink vessel 80 need not necessarily be formed in an asymmetrical manner when viewed from the insertion direction into the first casing member 71. In a case where, for example, the cylindrical flow path section 85 is formed in the center of the main body 81A, it is permissible for the main body 81*a* to be formed in a symmetrical manner since it is not necessary to identify the insertion posturing of the first supply member 81 when the cylindrical flow path section 85 is inserted in the through hole 75H. In addition, the main body 81A may be symmetrical in a case where, for example, a shape or a display such as a gate during molding or a colored section, where it is possible to identify the insertion posturing of the first supply member 81 when the cylindrical flow path section 85 is inserted in the through hole 75H, is provided in the first supply member 81 or the main body 81A.

In the ink cartridge 70 (70W) of the embodiment described above, the abutting section 76A which is able to abut with the main body 81A in the insertion direction for the cylindrical flow path section 85 need not necessarily be provided in the through path forming section 75. It is possible for the first supply member 81 to be supported by the first casing member 71 due to, for example, a marking which indicates the insertion amount for the cylindrical flow path section 85 being provided in the cylindrical flow path section 85 and the first supply member 81 being rotated in a state where the cylindrical flow path section 85 is inserted up to the marking.

In the ink cartridge 70 (70W) of the embodiment described above, the engaged section 86 which regulates movement of the first supply member 81 in the opposite direction to the insertion direction into the through hole 75H need not necessarily be provided in the cylindrical flow path section 85. It is not necessary to provide the engaged section 86 in the cylindrical flow path section 85 in a case of the first supply member 81 being supported with regard to the first casing member 71 so that movement of the first supply member 81 in the opposite direction to the insertion direction in the through hole 75H is suppressed due to, for example, a portion of the first supply member 81 other than the cylindrical flow path section 85 in a state where the cylindrical flow path section 85 is rotated after being inserted in the through hole 75H. Here, in this case, it is preferable that the engaging section which engages the engaged section 86 which is provided in the through hole forming section 75 be formed in the first casing member 71 at a portion other than the side wall 76.

In the ink cartridge 70 (70W) of the embodiment described above, the positions of the first protuberance section 71A and the second protuberance section 71B which are the fastening sections, which are rotated by 90 degree from the position where the cylindrical flow path section 85 is inserted in the through hole 75H, need not necessarily be positions where the first supply member 81 is fastened with the fastening section. The angle of rotation may be, for example, 30 degrees, 45 degrees, or 60 degrees as long as the angle when the first supply member 81 is attached to the first casing member 71 is used as a guide.

In the ink cartridge 70 (70W) of the embodiment described above, the first supply member 81 need not necessarily be provided with the L shape section 81F where the locking mechanism 81Fa which is able to change shape is formed when fastening with the first protuberance section 71A and the second protuberance section 71B. For example, the second protuberance section 71B may change shape (elastically change shape) so as to escape from within the rotation trajectory of the L shape section 81F without the L shape section 81F changing shape.

In the ink cartridge 70 (70W) of the embodiment described above, the first protuberance section 71A and the second protuberance section 71B, which regulate rotating of the cylindrical flow path section 85 in a state of being engaged with the cylindrical flow path section 85 due to being fastened with the first supply member 81, need not be provided in the first casing member 71. It is possible for the state where the first supply member 81 is supported by the first casing member 71 to be maintained using a configuration where, for example, rotating of the cylindrical flow path section 85 is regulated due to engaging of the second engaged section 86B of the engaged section 86 and the through hole forming section 75.

In the ink cartridge 70 (70W) of the embodiment described above, the linking rib 70R as the second convex section which is provided in the third surface CS3 need not necessarily be provided so as to configure a portion of the second surface CS2. This modified example will be described with reference to the drawings.

Figure 33B:
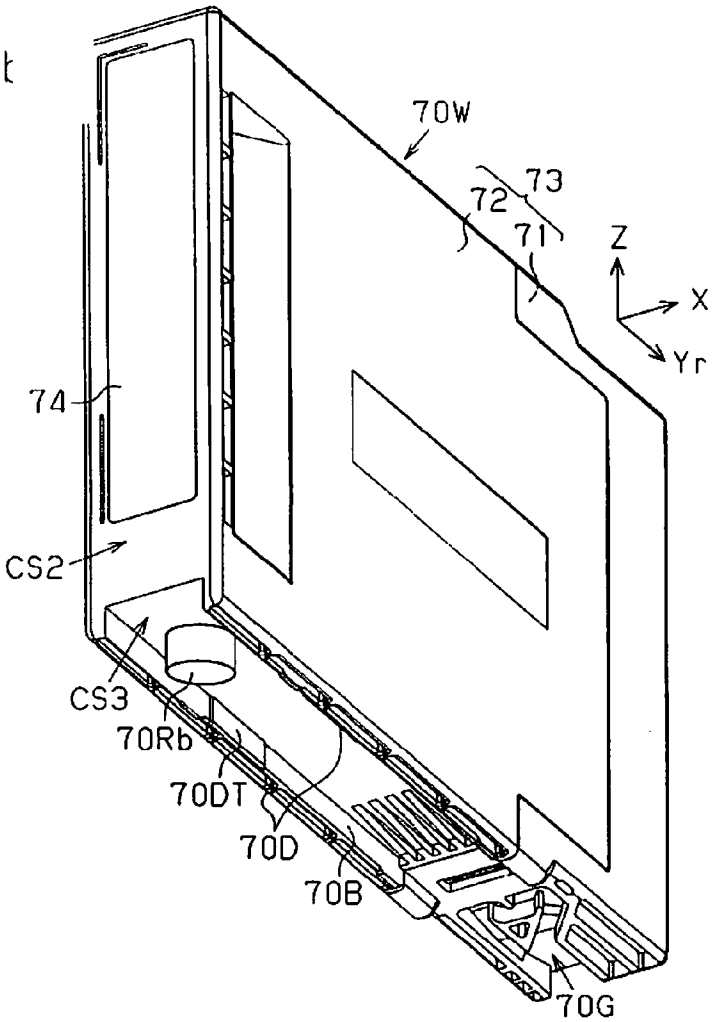
FIGS. 33A and 33B are perspective diagrams illustrating a modified example of a convex section which suppresses erroneous insertion of an ink cartridge in a mounting section.
Figure 33A:
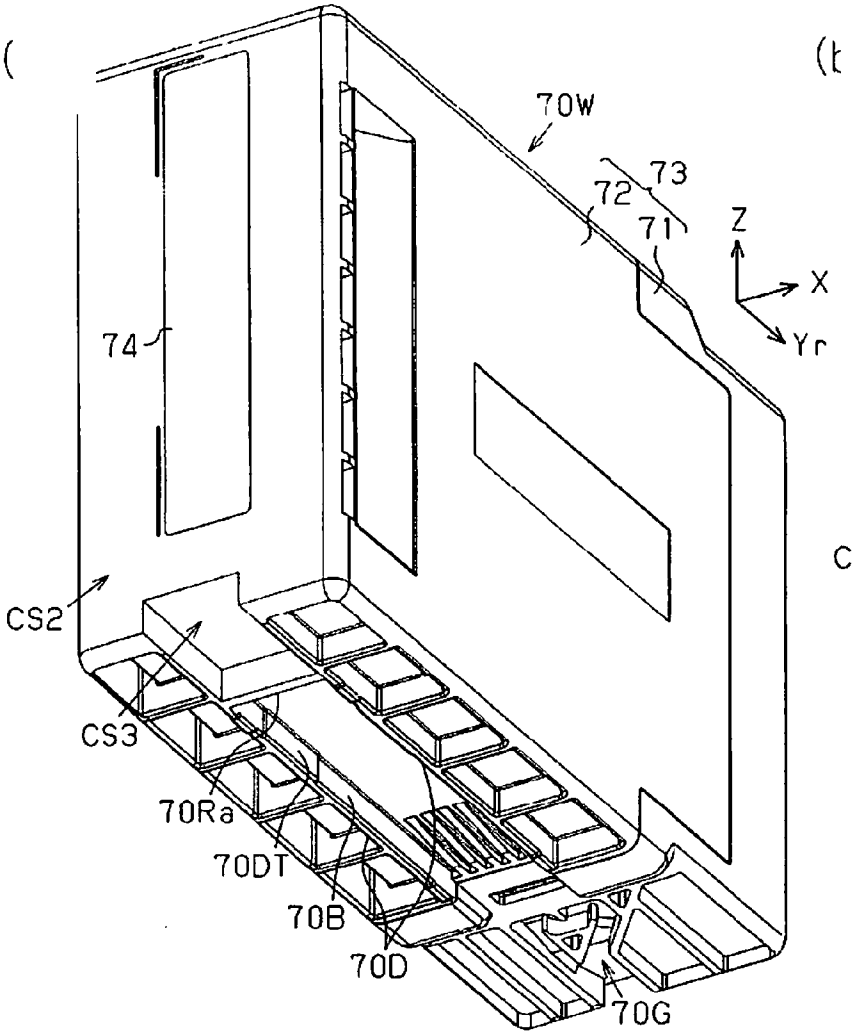

As shown in FIG. 33A, a linking rib 70Ra which links the pair of lower side convex sections 70D may be formed as the second convex section in the third surface CS3 of the ink cartridge 70W (70) at a position on the second surface CS2 side. According to this configuration, a rectangular cut away section is formed in the ink cartridge 70W (70) on the bottom surface side of the second surface CS2 when viewed from the second surface CS2 side. Accordingly, erroneous inserting of the ink cartridge 70W (70) in the mounting section 20 is suppressed since it is possible for a user to easily recognize the bottom surface and the upper surface due to the cut away section.

Alternatively, as shown in FIG. 33B, a circular boss 70Rb which protrudes with a circular pillar shape may be formed instead of a linking rib as the second convex section in the third surface CS3 of the ink cartridge 70W (70) at a position on the second surface CS2 side. According to this configuration, a rectangular cut away section is formed in the ink cartridge 70 (70W) on the bottom surface side of the second surface CS2 when viewed from the second surface CS2 side. Accordingly, erroneous inserting of the ink cartridge 70

(70W) in the mounting section 20 is suppressed since it is possible for a user to easily recognize the bottom surface and the upper surface due to the cut away section.

In the ink cartridge 70 (70W) of the embodiment described above, the convex sections 70C need not necessarily be configured by the pair of lower side convex sections 70D which are provided to extend in the insertion direction Yr and the protuberance sections 70P which are provided in the lower side convex sections 70D. For example, the lower side convex sections 70D may function as the convex section due to being formed with the length in the insertion direction Yr being shorter.

In the ink cartridge 70 (70W) of the embodiment described above, the first surface pressed section need not be in the first surface CS1 at a position which is closer to the third surface CS3 than the fourth surface CS4. Conversely, the first surface pressed section may be at a position which is closer to the fourth surface CS4 or may be at a position which is equal distances from the third surface CS3 and the fourth surface CS4.

In the ink cartridge 70 (70W) of the embodiment described above, the circuit board 30 need not be necessarily inclined with regard to the insertion direction Yr toward the mounting section 20. For example, the circuit board 30 may be inclined in a direction which intersects with the insertion direction Yr.

In the ink cartridge 70 (70W) of the embodiment described above, the first terminal 35 which is the electrical connection section which is provided in the circuit board 30 need not necessarily be positioned between the convex sections 70C when viewed in the insertion direction Yr toward the mounting section 20. It is preferable that the first terminal 35 be arranged according to the position of the second terminal 34 in the mounting section 20.

In the ink cartridge 70 (70W) of the embodiment described above, the liquid supply opening 81K need not necessarily be positioned between the convex sections 70C when viewed in the insertion direction Yr toward the mounting section 20. It is preferable that the liquid supply opening 81K be arranged according to the position of the supply needle 29 in the mounting section 20.

In the ink cartridge 70 (70W) of the embodiment described above, the convex sections 70C which are provided in the third surface CS3 need not necessarily be positioned more to the second surface CS2 side than the groove section 70G which is the third surface pressed section. It is preferable that the convex section 70C be provided on the first surface CS1 side in a case where, for example, the position of the groove section 70G is provided in the third surface CS3 on the second surface CS2 side.

In the ink cartridge 70 (70W) of the embodiment described above, the convex sections 70C need not necessarily be provided on the third surface CS3. For example, the convex sections 70C may be provided on the fourth surface CS4 or may be provided on both the third surface CS3 and the fourth surface CS4. In short, it is sufficient if the convex sections 70C are provided according to the direction in which the ink cartridge 70 (70W) is pressed in the mounting section 20.

In the ink cartridge 70 (70W) of the embodiment described above, two of the protuberance sections 70P need not necessarily be provided in each of the lower side convex sections 70D to be spaced with an interval in the insertion direction Yr. For example, one of the protuberance sections 70P may be provided or three or more of the protuberance sections 70P may be provided to be spaced in the insertion direction Yr. Here, in a case where one of the protuberance sections 70P is provided, it is preferable that the protuberance section 70P be provided in the lower side convex sections 70D to be closer to the second surface CS2 on the opposite side to the insertion direction Yr.

In the ink cartridge 70 of the embodiment described above, the inner side convex sections 70Ea and the grooves 70H need not necessarily be provided in the fourth surface CS4 which is one of the side surfaces. For example, there may be a configuration where the inner side convex section 70Ea is provided on the fourth surface CS4 and the grooves 70H are provided on the third surface CS3 side. In this case, the guide sections 27B are provided in the bottom member 28 of the mounting section 20.

In the ink cartridge 70 (70W) of the embodiment described above, the grooves 70H need not necessarily be provided so that it is possible for the guide sections 27B which are provided in the mounting section 20 to be inserted. The guide sections 27B are unnecessary if there is a configuration where, for example, the ink cartridge 70 is not inserted at the position of the ink cartridge 70W in the mounting section 20. In this case, the grooves 70H are unnecessary.

In the ink cartridge 70 (70W) of the embodiment described above, the fifth surface CS5 and the sixth surface CS6 need not necessarily be provided as the guide wall sections which are guided by the insertion guiding sections 27C which are provided in the mounting section 20. It is not necessary to use the fifth surface CS5 and the sixth surface CS6 as the guide wall sections which are guided by the insertion guiding sections 27C in a case where, for example, the insertion guiding sections 27C are not necessary when the ink cartridge 70 (70W) is inserted in the mounting section 20.

In the ink cartridge 70 (70W) of the embodiment described above, the liquid supply opening 81K need not be provided to be arranged in the region R1 where the extending surface R3 of the third surface CS3 and the extending surface R4 of the fourth surface CS4 intersect. It is preferable that the liquid supply opening 81K be arranged according to the position of the supply needle 29 in the mounting section 20.

In the ink cartridge 70 (70W) of the embodiment described above, the first terminal 35 need not necessarily be provided on the extending region R4 toward the insertion direction Yr which is a region which is interposed by the upper convex wall sections 70ET which are the position aligning sections. It is preferable that the first terminal 35 be arranged according to the position of the second terminal 34 which is the electrical connection section which is provided in the mounting section 20 of the printer In the ink cartridge 70 (70W) of the embodiment described above, the groove section 70G need not necessarily be provided on the extending region R3 toward the insertion direction Yr which is a region which is interposed by the lower convex wall sections 70DT which is the position aligning section. It is preferable that the groove section 70G be arranged according to the position of the lever member 52 which is the moveable fastening section which is provided in the mounting section 20 of the printer 11.

In the ink cartridge 70 (70W) of the embodiment described above, the upper convex wall sections 70ET and the lower convex wall sections 70DT need not necessarily be positioned at both sides to interpose the upper guide ribs 27A or the lower guide ribs 28A when the ink cartridge 70 (70W) is mounted in the mounting section 20. The upper convex wall sections 70ET or the lower convex wall sections 70DT may be respectively positioned, for example, on one side of the upper guide ribs 27A or on one side of the lower guide ribs 28A as long as positional aligning is possible.

In the ink cartridge 70 (70W) of the embodiment described above, the upper convex wall sections 70ET or the lower convex wall sections 70DT need not necessarily be provided in the lower side convex sections 70E (the inner side convex sections 70Ea) or the lower side convex sections 70D. For example, the upper convex wall sections 70ET and the lower convex wall sections 70DT may be provided on the fourth surface CS4 or the third surface CS3 as portions which are different to the lower side convex sections 70E (the inner side convex sections 70Ea) and the lower side convex sections 70D.

In the ink cartridge 70 (70W) of the embodiment described above, the upper convex wall sections 70ET or the lower convex wall sections 70DT need not necessarily positionally align the ink cartridge 70 (70W) in a direction which intersects with the insertion direction Yr. For example, the upper convex wall sections 70ET or the lower convex wall sections 70DT may positionally align the ink cartridge 70 (70W) in the insertion direction Yr. By doing this, the ink cartridge 70 (70W) is stably positionally aligned with regard to the mounting section 20 in the insertion direction Yr using the upper convex wall sections 70ET or the lower convex wall sections 70DT even if there is variation in the insertion direction Yr in the positioning of the ink cartridge 70 (70W) which is fastened using the movable fastening section (the lever member 52).

In the ink cartridge 70 (70W) of the embodiment described above, it is permissible that there be a configuration where at least either of the upper convex wall sections 70ET or the lower convex wall sections 70DT be provided as the positional aligning section in the mounting section 20.

In the embodiment described above, the ribs 27T or the ribs 28T need not necessarily be provided in the upper guide ribs 27A or the lower guide ribs 28A. In addition, the rails 28C need not be provided in the bottom member 28 of the mounting section 20.

In the embodiment described above, the lower convex wall section 70DT need not be in a state of engaging with regard to the ribs 28T of the lower guide ribs 28A in a state where the ink cartridge 70 (70W) is pushed in the position with the reference numeral 55B in the mounting section 20. Alternatively, the ribs 27T of the upper guide ribs 27A need not be in a state of engaging with regard to upper convex wall sections 70ET. There may be a configuration where these state of engaging are maintained at least in the mounting state.

In the embodiment described above, the first terminal 35 need not necessarily be provided in the ink cartridge 70 at the inclined surface 71K which is inclined in a direction which intersects with the insertion direction Yr toward the cartridge holding body 22. The first terminal 35 may be provided, for example, at a side surface where the insertion direction Yr is a perpendicular direction (that is, along a direction which is perpendicular to the insertion direction Yr).

In the embodiment described above, the first pressing member 48 need not necessarily be provided to be arranged in the surroundings of the supply needle 29 and may be provided to be arranged, for example, more to the direction Z side which is the opposite direction to the gravity direction (the upper side) than the supply needle 29 or more to the gravity direction side (the lower side) than the supply needle 29.

In the embodiment described above, for example, the first pressing member 48 which presses the moving body 41 or the second pressing member 38 which presses the moveable member 31 may be members other than a coil spring such as a U shape plate spring.

In the embodiment described above, the number of the ink cartridges 70 which are held in the cartridge holding bodies 22 is not necessarily limited to four. In addition, the position where the ink cartridge 70W with a larger width is held is not necessarily limited to the position farthest to the left side out of the cartridge holding bodies 22.

In the embodiment described above, there may be a configuration where the mounting section 20 is provided on the outer side of the casing 11*a* of the printer 11. In a case where ink is supplied from the mounting section 20 which is provided on the outside of the casing 11*a* to the ink ejecting head 18 which is inside the casing 11*a*, it is necessary for the ink supply tube TB for supplying ink to be led from the outside to the inside of the casing 11*a*. As such, in this case, it is preferable that a hole or a cutting where it is possible for the ink supply tube TB to pass through be provided in the casing 11*a*. Alternatively, the ink supply tube TB may be led from the outside to the inside of the casing 11*a* through a gap which is provided in the casing 11*a*. By doing this, it is possible to easily perform supplying of ink with regard to the liquid ejecting head 18 which uses an ink flow path with the ink supply tube TB.

The liquid ejecting head 18 is not limited to a so-called series head type which ejects ink by moving back and forth along with the carriage 16 in a direction which intersects with the transport direction of the sheet P. That is, the liquid ejecting head 18 may be so-called a line head type which ejects ink from a plurality of nozzles, which are provided to span across substantially the entire width of the medium in the longitudinal direction, toward the medium, in a state of being arranged to be fixed so that the longitudinal direction is along the width direction which intersects with the transport direction of the sheet P, with an overall shape where the length size corresponds to the width size of the sheet P.

In the embodiment described above, the printer 11 may be a liquid consumption apparatus which ejects or discharges liquids other than ink. Here, as the state of liquid which is discharged from the liquid consumption apparatus as liquid droplets in minute amounts, liquid droplets which have a granular shape, a tear shape, and a trailing shape are included. In addition, it is sufficient if the liquid referred to here is a material which is able to be ejected by the liquid consumption apparatus. For example, it is sufficient if the liquid is in a state where a substance is in a liquid phase, and the substance includes a liquid with high or low viscosity and a body with a fluid form such as a sol, a gel water, another inorganic solvent, an organic solvent, a solution, a liquid resin, or a liquid metal (a metal melt). In addition, not only liquid bodies with substance in one state are included but particles of a functional material formed of solid matter such as pigments and metal particles being dissolved, dispersed, or mixed into a solvent and the like are also included. Typical examples of the liquids include inks, liquid crystals, and the like as described in the embodiment described above. Here, the inks encompass various types of liquid compositions such as typical water-based inks and oil-based inks, gel inks, and hot melt inks. Specific examples of liquid consumption apparatuses may include, for example, liquid consumption apparatuses which eject liquids which include materials in a dispersed or dissolved form such as electrode materials or coloring materials which are used in the manufacturing or the like of liquid crystal displays, electroluminescence (EL) displays, surface-emitting displays, and color filters. In addition, there may also be liquid consumption apparatuses which eject bio-organic material which is used in biochip manufacturing, liquid consumption apparatuses which are used as precision pipettes and which eject liquids which are samples, textile printing apparatuses, micro dispensers, and the like. Furthermore, there may also be liquid consumption apparatuses which eject a lubricant in a pin point manner in precision machines such as watches or cameras and liquid consumption apparatuses which eject a transparent resin liquid such as an ultraviolet curable liquid onto a substrate in order to form minute hemispherical lenses (optical lenses) which are used in optical communication elements or the like. There may also be liquid consumption apparatuses which eject an etching liquid such as an acid or an alkali in order to etch a substrate or the like.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. A liquid containing vessel comprising:

a liquid containing chamber containing a liquid, the liquid containing chamber having a filter chamber with a filter through which the liquid is configured to pass, and a low pressure chamber having a pressure that is lower than atmospheric pressure.

2. The liquid containing vessel according to claim 1, wherein the low pressure chamber is arranged such that at least a portion of the low pressure chamber overlaps with the filter chamber in a projection direction where a projection area of the filter chamber to the low pressure chamber is maximized.

3. The liquid containing vessel according to claim 1, wherein the length of a liquid inflow region where the liquid is configured to flow into the filter chamber in a vertical direction is shorter than the length in a direction that intersects with the vertical direction.

4. The liquid containing vessel according to claim 1, further comprising:

a supply member defining the liquid containing chamber by being joined with a containing chamber member, and including a liquid supply opening through which the liquid is configured to flow out from the liquid containing chamber to an outside; and a second supply member defining the filter chamber and the low pressure chamber, and being connected, when the supply member is a first supply member, with the first supply member, at least a portion of the filter chamber and the low pressure chamber of the second supply member being formed using a shared member.

5. The liquid containing vessel according to claim 4, wherein the second supply member is attachably and detachably connected with regard to the first supply member.

6. The liquid containing vessel according to claim 4, wherein the containing chamber member is formed using a flexible member that is deformable while the liquid flows out from the liquid containing chamber, and the second supply member that defines the filter chamber including at least one convex section that defines a flow path in which the liquid in the liquid containing chamber is configured to flow to the filter chamber by passing through the filter between the containing chamber member and the second supply member while abutting with the containing chamber member that is deformable.

7. The liquid containing vessel according to claim 4, wherein the filter of the filter chamber extends along a direction that intersects with a deforming direction of the containing chamber member, and the filter chamber includes an abutting section that is abuttable with regard to the filter that deforms while the containing chamber member deforms.

8. The liquid containing vessel according to claim 4, wherein the filter chamber defines a flow path in which the liquid is configured to flow to the first supply member side, and a cross sectional area of the flow path at a first position that is close to the first supply member is larger than a cross sectional area of the flow path at a second position that is farther from the first supply member than the first position.

9. The liquid containing vessel according to claim 1, wherein the low pressure chamber is disposed at a position where a proportion of gas that is dissolved in the liquid with regard to the liquid in the filter chamber is reduced.

10. The liquid containing vessel according to claim 1, wherein a film is disposed in the low pressure chamber to blocked off an opening section of a concave region of the low pressure chamber.

11. The liquid containing vessel according to claim 10, wherein the film is configured such that gas dissolved in the liquid to pass therethrough.

12. A filter unit disposed in a liquid containing chamber containing a liquid, the filter unit comprising:

a filter chamber with a filter through which the liquid is configured to pass;

a low pressure chamber having a pressure that is lower than atmospheric pressure; and a connected section configured to be attached and detached with respect to a connecting section provided in a supply member supplying the liquid from the liquid containing chamber to outside.

13. The filter unit according to claim 12, wherein a film is disposed in the low pressure chamber to blocked off an opening section of a concave region of the low pressure chamber.

14. The filter unit according to claim 13, wherein the film is configured such that gas dissolved in the liquid to pass therethrough.

15. A liquid containing vessel comprising the filter unit according to claim 12.

16. A filter unit disposed in a liquid containing chamber containing a liquid, the filter unit comprising:

a filter chamber with a filter blocking off a first opening section disposed in a first concave region; and a low pressure chamber with a film blocking off a second opening section disposed in a second concave region, the low pressure chamber having a pressure that is lower than atmospheric pressure, the filter chamber and the low pressure chamber being arranged with a front and back relationship to each other.

17. The filter unit according to claim 16, wherein the film is configured such that gas dissolved in the liquid to pass therethrough.

18. A liquid containing vessel comprising the filter unit according to claim 16.

* * * * *